US012025391B2

(12) United States Patent
Underwood et al.

(10) Patent No.: US 12,025,391 B2
(45) Date of Patent: Jul. 2, 2024

(54) ROLLER AND BEARING DELAYED FIREARM OPERATING SYSTEMS

(71) Applicants: James Matthew Underwood, Kennesaw, GA (US); Larry Cullen Underwood, Canton, GA (US)

(72) Inventors: James Matthew Underwood, Kennesaw, GA (US); Larry Cullen Underwood, Canton, GA (US)

( * ) Notice: Subject to any disclaimer, the term of this patent is extended or adjusted under 35 U.S.C. 154(b) by 0 days.

(21) Appl. No.: 18/077,224

(22) Filed: Dec. 7, 2022

(65) Prior Publication Data

US 2023/0108620 A1 Apr. 6, 2023

Related U.S. Application Data

(63) Continuation of application No. 17/367,288, filed on Jul. 2, 2021, now Pat. No. 11,543,195.

(60) Provisional application No. 63/170,411, filed on Apr. 2, 2021, provisional application No. 63/144,670, filed on Feb. 2, 2021, provisional application No. 63/134,301, filed on Jan. 6, 2021, provisional application No. 63/048,057, filed on Jul. 3, 2020.

(51) Int. Cl.
*F41A 3/62* (2006.01)

(52) U.S. Cl.
CPC ..... *F41A 3/62* (2013.01)

(58) Field of Classification Search
CPC ..... F41A 3/36; F41A 3/44; F41A 3/46; F41A 3/62
USPC ..... 89/180, 183, 187.01, 187.02
See application file for complete search history.

(56) References Cited

U.S. PATENT DOCUMENTS

| | | | |
|---|---|---|---|
| 1,085,698 | A | 2/1914 | Nelson |
| 1,168,024 | A | 1/1916 | Nelson |
| 1,349,345 | A | 8/1920 | Payne |
| 1,365,355 | A | 1/1921 | Thompson |
| 2,089,671 | A | 8/1937 | Stecke |
| 2,182,693 | A | 12/1939 | Harton |
| 2,370,189 | A | 2/1945 | Penney |
| 2,651,974 | A | 9/1953 | Simpson |
| 2,691,232 | A | 10/1954 | Hoopes |
| 2,717,535 | A | 9/1955 | Taylor |
| 2,978,826 | A | 4/1961 | Ivy |
| 3,101,648 | A | 8/1963 | Walther |
| 3,283,435 | A | 11/1966 | Koch |
| 3,415,000 | A | 12/1968 | Koucky et al. |
| 3,540,147 | A | 11/1970 | Cream et al. |

(Continued)

FOREIGN PATENT DOCUMENTS

| | | | |
|---|---|---|---|
| DE | 1242477 | B | 6/1967 |
| DE | 3627573 | A1 | 2/1988 |
| WO | 2005108900 | A1 | 11/2005 |

*Primary Examiner* — Bret Hayes

(57) ABSTRACT

A firearm operating system includes a forward bolt with an internal cavity, a carrier disposed on a rear side of the forward bolt where the carrier includes a cavity, a short cam pin, a plurality of bearings, a retracted configuration, and a deployed configuration. At least a portion of a forward section of the short cam pin is disposed within the internal cavity of the forward bolt. At least a portion of a rear section of the short cam pin is disposed within the cavity of the carrier. Movement from the retracted configuration to the deployed configuration includes movement in a forward/aft direction of the short cam pin relative to the forward bolt and movement of the plurality of bearings.

20 Claims, 61 Drawing Sheets

(56) References Cited

U.S. PATENT DOCUMENTS

| | | | |
|---|---|---|---|
| 3,715,826 | A | 2/1973 | Seifried |
| 3,848,510 | A | 11/1974 | Wolpert |
| 4,031,648 | A | 6/1977 | Thomas |
| 4,246,830 | A | 1/1981 | Krieger |
| 4,420,899 | A | 12/1983 | Bourlet et al. |
| 4,521,985 | A | 6/1985 | Smith et al. |
| 4,549,465 | A | 10/1985 | Charron |
| 4,594,935 | A | 6/1986 | Smith |
| 4,619,062 | A | 10/1986 | Johnson |
| 4,742,634 | A | 5/1988 | Swenson |
| 4,815,226 | A | 3/1989 | Ruger |
| 5,036,612 | A | 8/1991 | Jennings |
| 5,090,147 | A | 2/1992 | Pastor |
| 5,105,570 | A | 4/1992 | Lishness et al. |
| 5,259,137 | A | 11/1993 | Blenk et al. |
| 5,299,374 | A | 4/1994 | Mathys |
| 5,386,659 | A | 2/1995 | Vaid et al. |
| 5,388,362 | A | 2/1995 | Melcher |
| 5,438,784 | A | 8/1995 | Lenkarski et al. |
| 5,447,092 | A | 9/1995 | Dobbins |
| 5,537,769 | A | 7/1996 | Hargraves et al. |
| 5,640,794 | A | 6/1997 | Gardner et al. |
| 5,682,007 | A | 10/1997 | Dobbins |
| 5,926,987 | A | 7/1999 | Novak |
| 6,073,380 | A | 6/2000 | Hauser et al. |
| 6,079,138 | A | 6/2000 | Meaker |
| 6,141,895 | A | 11/2000 | Rost et al. |
| 6,374,526 | B1 | 4/2002 | Mochak |
| 6,457,271 | B1 | 10/2002 | Vaid et al. |
| 6,655,066 | B2 | 12/2003 | Fluhr |
| 6,665,973 | B1 | 12/2003 | Peev |
| 6,820,606 | B1 | 11/2004 | Duffey |
| 6,880,281 | B1 | 4/2005 | Orr |
| 6,931,978 | B1 | 8/2005 | Dionne |
| 7,140,141 | B2 | 11/2006 | Vaid |
| 7,194,833 | B1 | 3/2007 | Curry |
| 7,299,737 | B2 | 11/2007 | Hajar et al. |
| 7,516,570 | B2 | 4/2009 | Stone |
| 7,571,671 | B2 | 8/2009 | Engel |
| 7,617,628 | B2 | 11/2009 | Curry |
| 7,703,230 | B2 | 4/2010 | Curry et al. |
| 7,721,639 | B2 | 5/2010 | Wössner |
| 7,770,507 | B1 | 8/2010 | Hajjar et al. |
| 7,810,268 | B1 | 10/2010 | McGarry |
| 7,810,269 | B2 | 10/2010 | Zukowski et al. |
| 7,866,077 | B2 | 1/2011 | Constant et al. |
| 7,930,848 | B2 | 4/2011 | Dye, Jr. |
| 7,958,661 | B2 | 6/2011 | Strayer |
| 8,015,742 | B2 | 9/2011 | Zedrosser |
| 8,033,043 | B2 | 10/2011 | McGarry |
| 8,122,634 | B2 | 2/2012 | Constant et al. |
| 8,191,298 | B2 | 6/2012 | Cash et al. |
| 8,359,778 | B2 | 1/2013 | Doll et al. |
| 8,438,768 | B2 | 5/2013 | Kallio |
| 8,459,165 | B2 | 6/2013 | Doll et al. |
| 8,572,878 | B2 | 11/2013 | Gentilini et al. |
| 8,656,619 | B2 | 2/2014 | Popikov |
| 8,667,881 | B1 | 3/2014 | Hawbaker |
| 8,726,555 | B2 | 5/2014 | Carr |
| 8,820,211 | B1 | 9/2014 | Hawbaker |
| 8,844,425 | B2 | 9/2014 | Mueller |
| 8,863,425 | B2 | 10/2014 | Lee |
| 8,925,232 | B2 | 1/2015 | Silveira |
| 8,935,872 | B2 | 1/2015 | Zukowski |
| 8,955,422 | B1 | 2/2015 | Schumacher |
| 8,959,818 | B2 | 2/2015 | Mayerl |
| 9,038,525 | B2 | 5/2015 | Sullivan et al. |
| 9,217,614 | B2 | 12/2015 | Pizano |
| 9,222,742 | B2 | 12/2015 | Steuwer et al. |
| 9,347,738 | B1 | 5/2016 | Schumacher |
| 9,482,481 | B2 | 11/2016 | LaValley et al. |
| 9,488,423 | B2 | 11/2016 | Sullivan et al. |
| 9,541,341 | B2 | 1/2017 | Macy |
| 9,835,397 | B2 | 12/2017 | Stussak |
| 9,964,369 | B2 | 5/2018 | Garrow |
| 10,101,102 | B2 | 10/2018 | Eitan et al. |
| 10,151,544 | B1 | 12/2018 | Sugg |
| 10,401,102 | B1 | 9/2019 | Carroll |
| 10,436,530 | B2 | 10/2019 | Overstreet et al. |
| 10,557,673 | B2 | 2/2020 | Overstreet et al. |
| 10,739,095 | B2 | 8/2020 | Underwood et al. |
| 11,371,789 | B2 | 6/2022 | Underwood et al. |
| 11,421,954 | B2 | 8/2022 | Underwood et al. |
| 11,543,195 | B2 * | 1/2023 | Underwood ..... F41A 3/62 |
| 2005/0132627 | A1 | 6/2005 | Wossner et al. |
| 2005/0257682 | A1 | 11/2005 | Hajjar et al. |
| 2006/0266209 | A1 | 11/2006 | Grabowski |
| 2008/0078284 | A1 | 4/2008 | Murello |
| 2010/0186581 | A1 | 7/2010 | Hajjar et al. |
| 2010/0229447 | A1 | 9/2010 | Metzger |
| 2010/0287806 | A1 | 11/2010 | Marfione et al. |
| 2011/0232148 | A1 | 9/2011 | Cain et al. |
| 2011/0271827 | A1 | 11/2011 | Larson et al. |
| 2013/0036900 | A1 | 2/2013 | Mueller |
| 2014/0041518 | A1 | 2/2014 | Neitzling |
| 2015/0219413 | A1 | 8/2015 | Karimullah et al. |
| 2015/0253096 | A1 | 9/2015 | Lee |
| 2015/0308784 | A1 | 10/2015 | Cho |
| 2015/0068092 | A1 | 12/2015 | Kallio |
| 2016/0010938 | A1 | 1/2016 | Merkley et al. |
| 2016/0033218 | A1 | 2/2016 | Folkestad et al. |
| 2016/0047614 | A1 | 2/2016 | Larson, Jr. |
| 2016/0178303 | A1 | 6/2016 | Macy |
| 2016/0187082 | A1 | 6/2016 | Pizano |
| 2016/0187090 | A1 | 6/2016 | Mather et al. |
| 2016/0187092 | A1 | 6/2016 | Mather et al. |
| 2016/0252316 | A1 | 9/2016 | Garrow |
| 2016/0377364 | A1 | 12/2016 | Santos Reis |
| 2018/0112944 | A1 | 4/2018 | Underwood et al. |
| 2018/0142981 | A1 | 5/2018 | Collazo et al. |
| 2018/0224227 | A1 | 8/2018 | Durham, III |
| 2019/0271524 | A1 | 9/2019 | Khoshnood |
| 2020/0072567 | A1 | 3/2020 | Michut |
| 2020/0340769 | A1 | 10/2020 | Underwood et al. |
| 2021/0108870 | A1 | 4/2021 | Underwood et al. |
| 2022/0003512 | A1 | 1/2022 | Underwood et al. |
| 2022/0268540 | A1 | 8/2022 | Underwood et al. |
| 2022/0299280 | A1 | 9/2022 | Sunseri |

* cited by examiner

ROLLER AND BEARING DELAYED FIREARM OPERATING SYSTEMS

CROSS REFERENCE TO RELATED APPLICATIONS

This application is a continuation of U.S. patent application Ser. No. 17/367,288 ("the '288 application") filed Jul. 2, 2021, which is related to and claims priority benefit from U.S. Provisional Application No. 63/048,057 ("the '057 application"), filed on Jul. 3, 2020; U.S. Provisional Application No. 63/134,301 ("the '301 application"), filed on Jan. 6, 2021; U.S. Provisional Application No. 63/144,670 ("the '670 application"), filed on Feb. 2, 2021; and U.S. Provisional Application No. 63/170,411 ("the '411 application"), filed on Apr. 2, 2021. The '288 application, the '057 application, the '301 application, the '670 application, and the '411 application are each hereby incorporated in their entirety by this reference.

FIELD OF THE INVENTION

The field of the invention relates to firearms, particularly firearms with operating systems that include a roller delay mechanism with a plurality of bearings.

BACKGROUND

Many modern firearms (including handguns, rifles, carbines, shotguns, etc.) rely on operating systems using blowback or gas pressure (including direct gas impingement arrangements, gas piston arrangements, or other appropriate arrangements). However, for compatibility with various calibers (including rifle calibers, pistol calibers, or other appropriate calibers), blowback or gas pressure operating systems are difficult to adapt to a wide variety of calibers. Adjustments for these operating systems may be necessary due to mass of the cartridge for various calibers to ensure suitable function of the firearm, including a sufficient delay between firing the projectile and rearward movement of the firearm bolt.

To simplify the firearm operating system, to increase reliability, and to increase safety, it may be desirable to design a new operating system that includes a roller delayed operating system that utilizes at least one cam pin. Such a design can allow for modular firearm components to be combined with the new roller delayed operating system.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm operating system comprises: a forward bolt comprising an internal cavity; a carrier disposed on a rear side of the forward bolt, wherein the carrier comprises a cavity; a short cam pin; a plurality of bearings; a retracted configuration; and a deployed configuration, wherein: at least a portion of a forward section of the short cam pin is disposed within the internal cavity of the forward bolt; at least a portion of a rear section of the short cam pin is disposed within the cavity of the carrier; and movement from the retracted configuration to the deployed configuration includes movement in a forward/aft direction of the short cam pin relative to the forward bolt and movement of the plurality of bearings.

According to certain embodiments of the present invention, a firearm operating system comprises: a forward bolt comprising an internal cavity; a carrier disposed on a rear side of the forward bolt, wherein the carrier comprises a cavity; a short cam pin; a plurality of bearings; a barrel extension; a retracted configuration; and a deployed configuration, wherein: at least a portion of a forward section of the short cam pin is disposed within the internal cavity of the forward bolt; at least a portion of a rear section of the short cam pin is disposed within the cavity of the carrier; and movement from the retracted configuration to the deployed configuration includes movement of the plurality of bearings.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
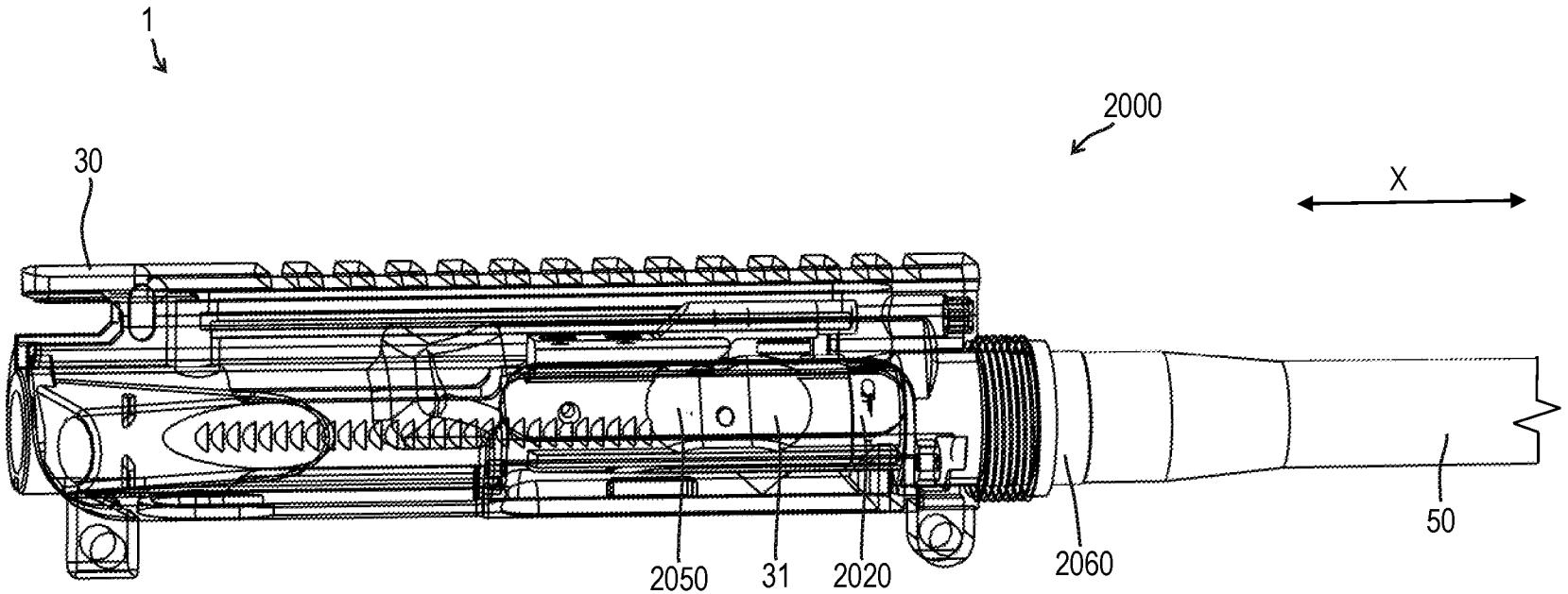
FIG. 1 is a perspective view of a firearm operating system for a firearm according to certain embodiments of the present invention.
Figure 57:
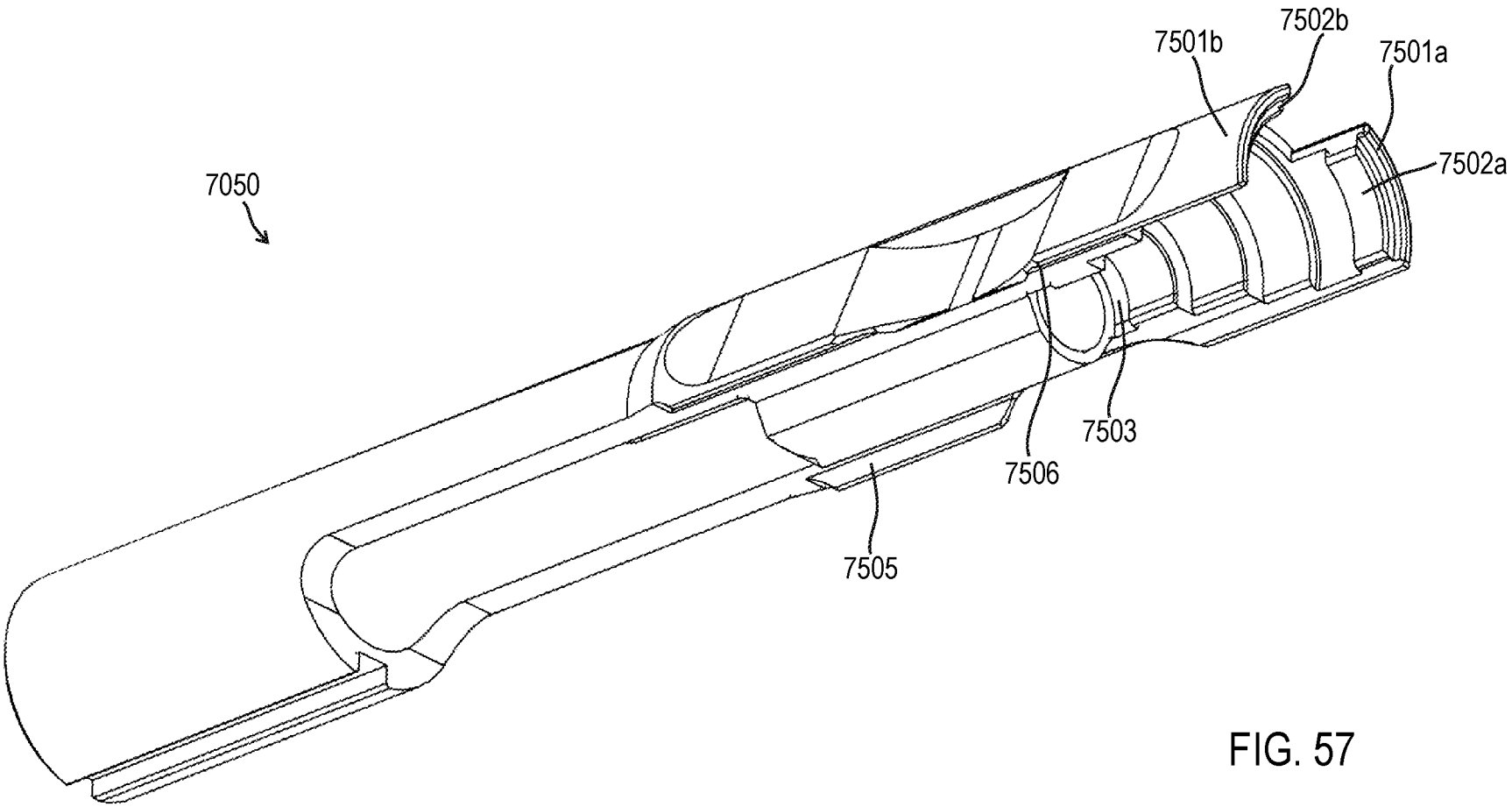
FIG. 57 is a front bottom right side perspective view of a carrier of the firearm operating system of FIG. 51.

Although the illustrated embodiments shown in FIGS. 1-57 illustrate components of various semi-automatic or automatic firearms, the features, concepts, and functions described herein are also applicable (with potential necessary alterations for particular applications) to handguns, rifles, carbines, pistols, shotguns, or any other type of firearm. Furthermore, the embodiments may be compatible with various calibers including rifle calibers such as, for example, 5.56×45 mm NATO, .223 Remington, 7.62×51 mm NATO, .308 Winchester, 7.62×39 mm, 5.45×39 mm; pistol calibers such as, for example, 9×19 mm, .45 ACP, .40 S&W, .380 ACP, 10 mm Auto, 5.7×28 mm; and shotgun calibers such as, for example, 12 gauge, 20 gauge, 28 gauge, 0.410 gauge, 10 gauge, 16 gauge.

In some embodiments, the firearm operating systems 2000, 3000, 5000, 6000, 7000 are configured to be inserted into a U.S. military specification (milspec) upper receiver for an AR-15 variant (civilian) or M16/M4 (military) firearm (i.e., collectively AR-15 style firearms).

According to certain embodiments of the present invention, as shown in FIGS. 1-18B, a firearm operating system 2000 may include a forward bolt 2020, a short cam pin 2030, a carrier 2050, and a barrel extension 2060. The firearm operating system 2000 may be incorporated into a firearm that includes an upper receiver 30 and a barrel 50 (for example, see firearm 1 shown in FIG. 1). Other components (e.g., lower receiver, magazine, charging handle, handguard, etc.) are not illustrated for simplicity. In some cases, the firearm operating system 2000 is located within the upper receiver 30. The firearm operating system 2000 may be designed as an assembly of components to fit within a standard upper receiver (e.g., upper receiver 30 shown transparent in FIG. 1) for a known modular firearm such that the upper receiver 30 (including the firearm operating system 2000) can interface with a standard lower receiver. For example, the firearm operating system 2000 may be designed to function and engage with (i) components of AR-15 variant (civilian) or M16/M4 (military) firearms; (ii) components of AR-10 variant firearms; or (iii) components of any other relevant firearm.

FIGS. 2A-4B show many of the relevant components of the firearm operating system 2000 in situ. As described in greater detail below, in some embodiments, at least a portion of a forward section 2038 of the short cam pin 2030 is disposed within an internal cavity of the forward bolt 2020 (e.g., rear cavity 2029) and at least a portion of a rear section 2039 of the short cam pin 2030 is disposed within an internal cavity of the carrier 2050 (e.g., cavity 2051) wherein the forward bolt 2020 is located on a forward side of the carrier 2050. The forward section 2038 of the short cam pin 2030 may include a lower flat portion 2035 to match the internal shape of the rear cavity 2029 of the forward bolt 2020. In addition to not showing the magazine, the upper receiver 30, and the handguard 40 (as described above), in FIG. 3, the forward bolt 2020 and the carrier 2050 are transparent to better illustrate components of the firearm operating system 2000. Cycling of the firearm operating system 2000 is based on linear motion of various components in the forward/aft direction X including, for example, the forward bolt 2020, the short cam pin 2030, the carrier 2050, and the firing pin 2080.

In some embodiments, the forward bolt 2020, short cam pin 2030, the carrier 2050, and the firing pin 2080 combine together as one unit within the firearm operating system 2000. As shown in FIG. 4B, the forward bolt 2020 may be disposed on a forward side of the carrier 2050 such that, in some conditions, there is a gap g between a rear face 2107 of the forward bolt 2020 and a forward face 2052 of the carrier 2050. The short cam pin 2030 and the firing pin 2080 may each extend internally into and/or through a rear cavity 2029 (see FIGS. 5A-5C) of the forward bolt 2020 and into/through the cavity 2051 of the carrier 2050 (see FIGS. 8A and 8B). In some cases, the firing pin 2080 extends through central hole 2027 of the forward bolt 2020 such that the firing pin 2080 may protrude into forward cavity 2028 of the forward bolt 2020 where the firing pin may interface with a cartridge. Although illustrated as a separate component, in some embodiments, the short cam pin 2030 may be an integral component of the carrier 2050. The firing pin 2080 may extend through a cavity 2033 of the short cam pin 2030 (see FIGS. 3, 6A, and 6B). The firearm operating system 2000 may include at least one forward retaining pin 2261 (see FIG. 12) to constrain movement of the short cam pin 2030 relative to the forward bolt 2020. The firearm operating system 2000 may include a vertical cam pin 2271 that extends through the carrier 2050 and the short cam pin 2030. In addition, the firearm operating system 2000 may include a bearing spacer 2040 that is disposed at least partially within a cavity 2059 of the carrier 2050.

Figure 4A:
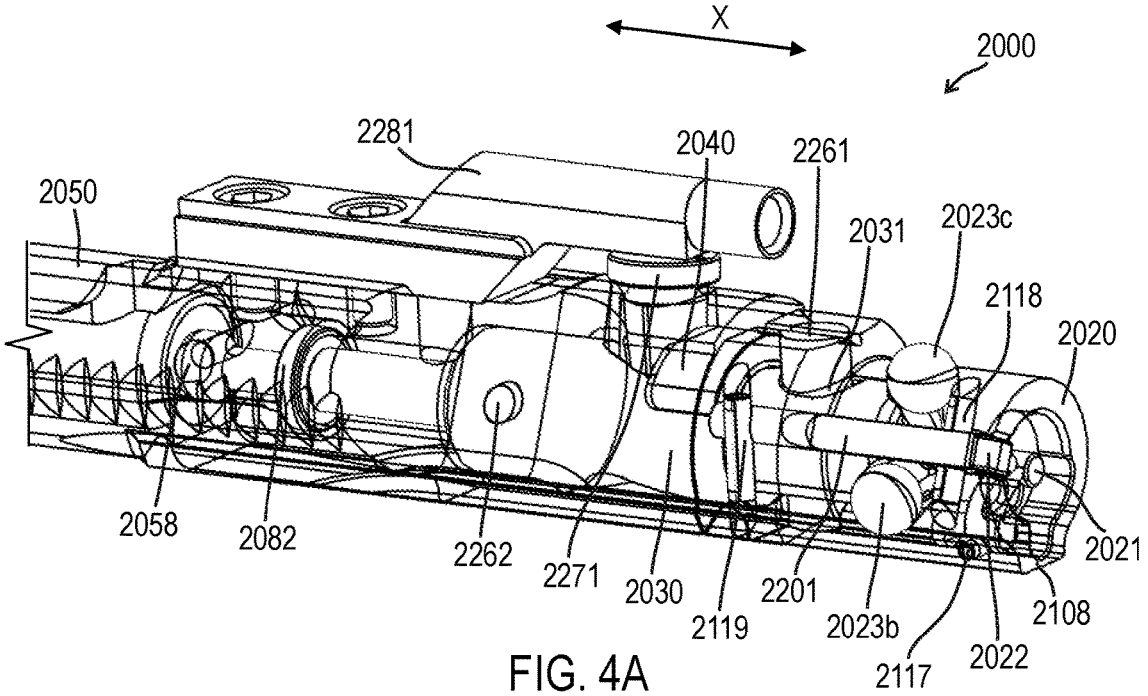
FIG. 4A is a right side perspective view of the firearm operating system of FIG. 1.
Figure 4B:
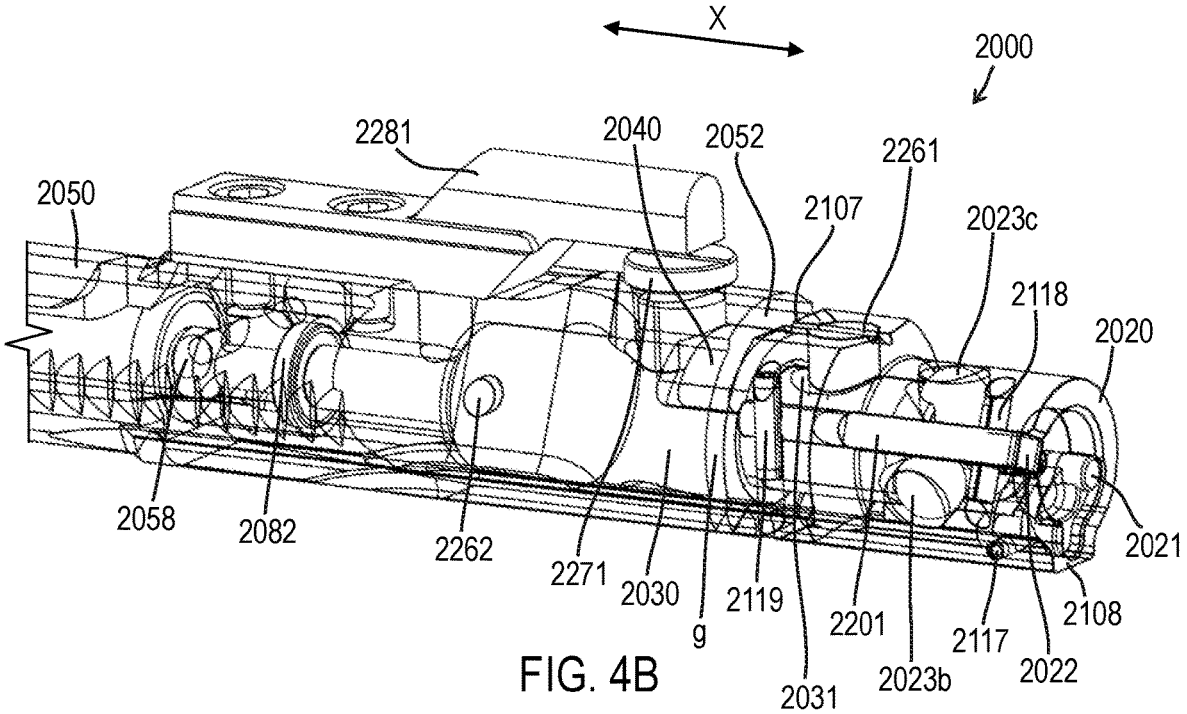
FIG. 4B is a right side perspective view of the firearm operating system of FIG. 1.

As shown in FIGS. 4A and 4B, the forward bolt 2020 and the short cam pin 2030 may be movable relative to one another in the X-direction such that the firearm operating system 2000 has a deployed configuration and a retracted configuration. In some embodiments, in the retracted configuration, the short cam pin 2030 is in a rear position relative to the forward bolt 2020, which creates the gap g between a rear face 2107 of the forward bolt 2020 and a forward face 2052 of the carrier 2050 (see FIG. 4B). When the firearm operating system 2000 moves to the deployed configuration, which is illustrated in FIG. 4A, the short cam pin 2030 moves to a forward position relative to the forward bolt 2020, which reduces or eliminates the gap g between the rear face 2107 of the forward bolt 2020 and the forward face 2052 of the carrier 2050.

Figure 12:
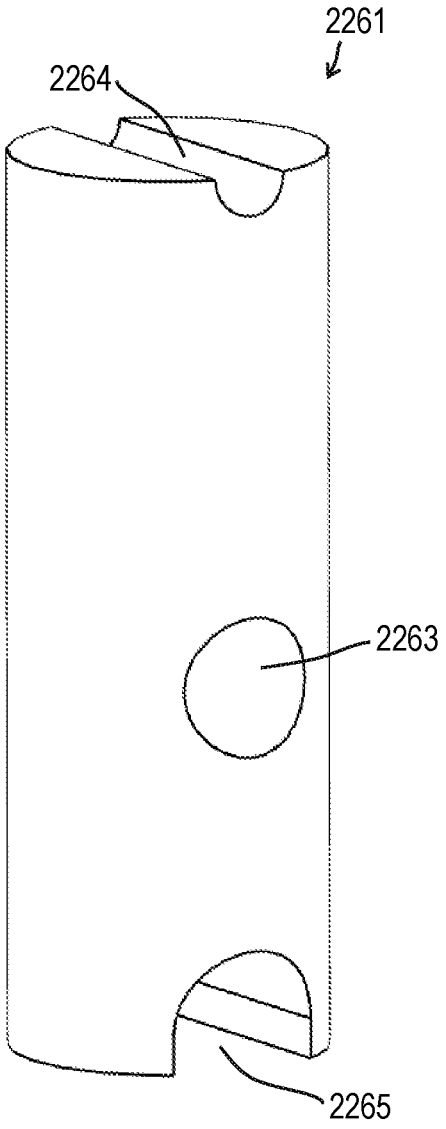
FIG. 12 is a top perspective view of a forward retaining pin of the firearm operating system of FIG. 1.

The distance or magnitude of gap g may be determined by the geometry of the interface between the forward bolt 2020 and the short cam pin 2030. In some embodiments, the interface between the forward bolt 2020 and the short cam pin 2030 is based on forward retaining pin 2261. An exemplary forward retaining pin 2261, which includes at least one hole 2263, is illustrated in FIG. 12. The forward retaining pin 2261 may interface with hole 2112 of the forward bolt 2020, and hole 2112 may be a tight tolerance hole that approximately matches the dimension of the forward retaining pin 2261. The forward retaining pin 2261 may also interface with hole 2031 of the short cam pin 2030 (located in the forward section 2038 of the short cam pin 2030). In some embodiments, the hole 2031 of the short cam pin 2030 is a slotted hole such that the forward retaining pin 2261 can slide in the X-direction to allow the short cam pin 2030 and the forward bolt 2020 to move in the X-direction relative to one another (i.e., to define the deployed configuration and the retracted configuration). In some embodiments, the geometry of the slotted hole 2031 defines the maximum relative motion between the forward bolt 2020 and the short cam pin 2030 and thus the carrier 2050 (i.e., the total distance of gap g).

In FIG. 4A, the forward retaining pin 2261 is biased toward the rear end of the slotted hole 2031, which dictates that the short cam pin 2030 and the carrier 2050 are located in a forward position relative to the forward bolt 2020 (i.e., reducing or eliminating the gap g). As discussed in greater detail below, forward movement of the short cam pin 2030 causes the forward surfaces 2036*a*, 2036*b*, and 2036*c* of the short cam pin 2030 to contact and push the bearings 2023*a*, 2023*b*, and 2023*c* (respectively) outward toward the exterior of the forward bolt 2020. In FIG. 4B, the forward retaining pin 2261 is biased toward the front end of the slotted hole 2031, which dictates that the short cam pin 2030 and the carrier 2050 are located in a rear position relative to the forward bolt 2020 (i.e., increasing the gap g). As discussed in greater detail below, rearward movement of the short cam pin 2030 causes the forward surfaces 2036*a*, 2036*b*, and 2036*c* of the short cam pin 2030 to move away from and thus allow the bearings 2023*a*, 2023*b*, and 2023*c* (respectively) to retract and move inward toward the interior of the forward bolt 2020.

In some embodiments, the forward retaining pin 2261 is cylindrical (e.g., see FIG. 12) such that rotation may occur within hole 2112 and/or hole 2031. In other embodiments, the forward retaining pin 2261 includes a shape that limits rotation within hole 2112 and/or hole 2031. As shown in FIG. 12, the forward retaining pin 2261 may include an upper slot 2264 and a lower slot 2265 to ensure that the hole 2263 remains aligned with the X-direction such that the firing pin 2080 passes through hole 2263. In particular, the lower slot 2265 may be aligned with hole 2111 of the forward bolt 2020 such that the lower slot 2265 engages the spring for ejector 2021. In other words, if the forward retaining pin 2261 was not properly aligned, the ejector 2021 and the related spring (within hole 2111) would not be capable of being installed properly (i.e., the forward retaining pin 2261 would block the spring for seating properly). The upper slot 2264 may act as a visual indicator for proper alignment and/or may be an interface for a flat-head screwdriver for rotating the forward retaining pin 2261.

As shown in FIGS. 2A-4B, 6A-6B, and 8A-8B, the firearm operating system 2000 may include a rear retaining pin 2262 that engages hole 2056 of the carrier 2050 and hole 2034 of the short cam pin 2030 (in the rear section 2039 of the short cam pin 2030). In some embodiments, the hole 2034 and the hole 2056 are both tight tolerance holes such that relative motion of the short cam pin 2030 and the carrier 2050 is constrained to prevent movement between the short cam pin 2030 and the carrier 2050. The rear retaining pin 2262 may include a first end 2267, a second end 2268, and a notch 2266 that engages the firing pin 2080 (see FIG. 14). The first end 2267 may include a contoured or angled surface to match an outer surface of the carrier 2050. As shown in FIG. 2B, the second end 2268 may be a flat surface that (when the rear retaining pin 2262 is installed) is disposed within a recess or counterbored area of the carrier 2050. In some embodiments, in addition to the rear retaining pin 2262, a location between the short cam pin 2030 and the carrier 2050 may also be defined by an interaction between an internal step 2054 of the carrier 2050 (see FIG. 8B) and a rear face 2037.2 of the short cam pin 2030 (see FIGS. 6A and 6B). The internal step 2054 of the carrier 2050 is optional and may not be included in some embodiments. The carrier 2050 is shown transparent in FIG. 8B for illustrative purposes.

Figure 13:
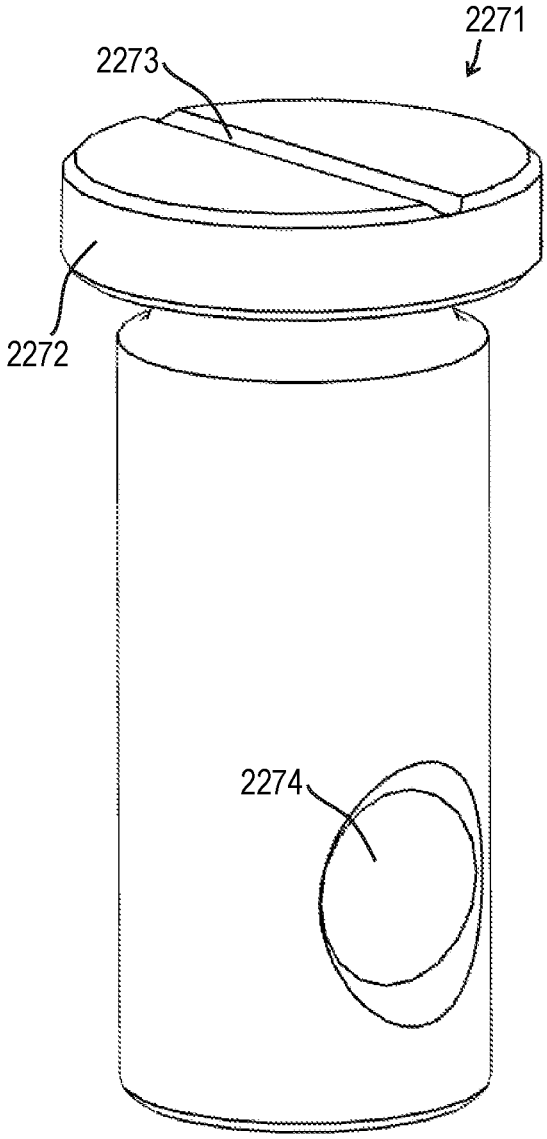
FIG. 13 is a top perspective view of a vertical cam pin of the firearm operating system of FIG. 1.
Figure 14:
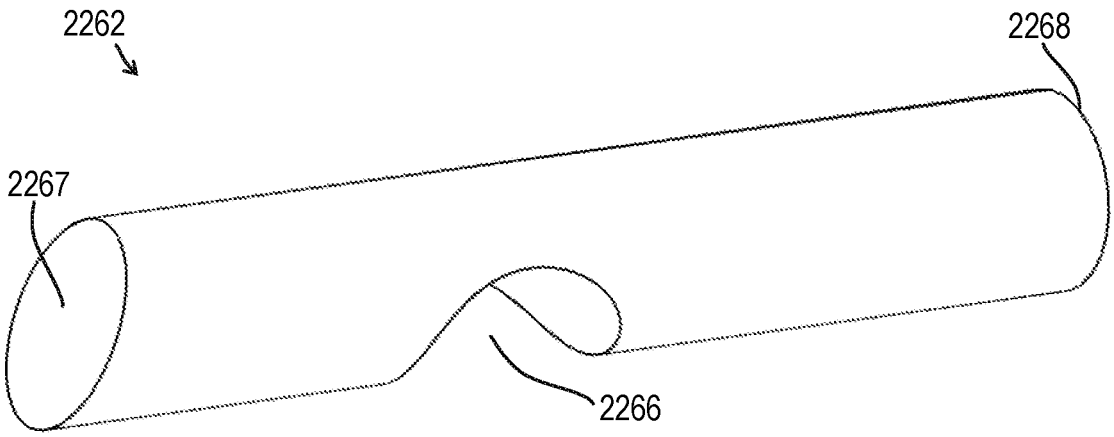
FIG. 14 is a perspective view of a rear retaining pin of the firearm operating system of FIG. 1.
Figure 15:
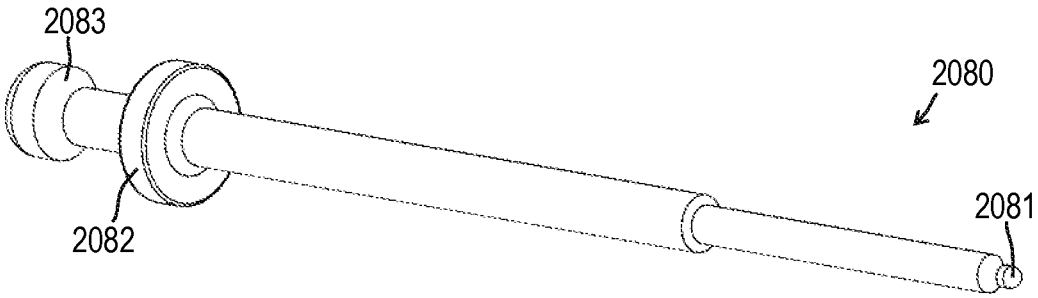
FIG. 15 is a front perspective view of a firing pin of the firearm operating system of FIG. 1.

The firearm operating system 2000 may also include a vertical cam pin 2271 that engages hole 2055 of the carrier 2050 and hole 2032 of the short cam pin 2030 (in the rear section 2039 of the short cam pin 2030). As shown in FIG. 13, the vertical cam pin 2271 may include a head 2272, at least one hole 2274 and a slot 2273 to ensure that the hole 2274 remains aligned with the X-direction such that the firing pin 2080 passes through hole 2274. The slot 2273 may act as a visual indicator for proper alignment and/or may be an interface for a flat-head screwdriver for rotating the vertical cam pin 2271. In some embodiments, the hole 2055 of the carrier 2050 and/or the hole 2032 of the short cam pin 2030 is contoured such that the vertical cam pin 2271 can rotate about hole 2274 (i.e., about the firing pin 2080).

Figure 7:
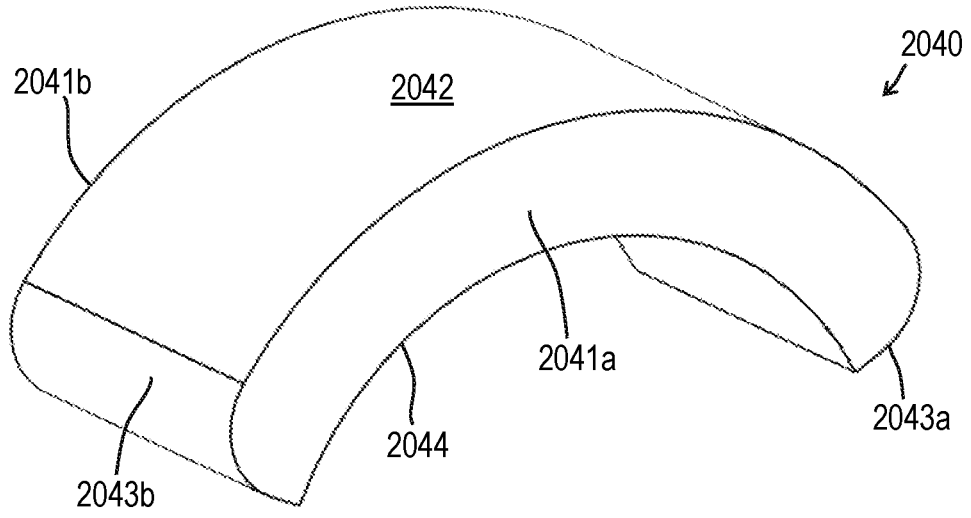
FIG. 7 is a top perspective view of a bearing retractor of the firearm operating system of FIG. 1.

In some embodiments, the vertical cam pin 2271 interacts with the bearing spacer 2040. As shown in FIG. 7, the bearing spacer 2040 may be a partially annular shape (i.e., a partial annular rod) that includes a forward surface 2041*a*, a rear surface 2041*b*, an outer surface 2042, an inner surface

2044, a left end 2043*a*, and a right end 2043*b*. The bearing spacer 2040 may be at least partially disposed within the cavity 2059 of the carrier 2050. In some embodiments, the shape of the cavity 2059 corresponds to the bearing spacer 2040 such that the left end 2043*a* and the right end 2043*b* engage with the outer edges of the cavity 2059 while at least part of the outer surface 2042 slides against the underside of the cavity 2059.

For the firing pin 2080 to function (i.e., for the forward end 2081 of the firing pin 2080 to contact and cause the cartridge to discharge), the firearm operating system 2000 must be in the deployed configuration (i.e., the short cam pin 2030 must be located in a forward position relative to the forward bolt 2020 as shown in FIG. 4A). In other words, the forward surfaces 2036*a*, 2036*b*, and 2036*c* of the short cam pin 2030 must be in a forward position, which affects the position of the bearings 2023*a*, 2023*b*, and 2023*c* thus causing these bearings to interface with recesses 2061*a*, 2061*b*, and 2061*c*, respectively, of the barrel extension 2060. In some cases, forward movement of the short cam pin 2030 relative to the forward bolt 2020 is constrained by (i) the bearing spacer 2040 pressing against the rear face 2107 of the forward bolt 2020, (ii) the front face 2037.1 of the short cam pin 2030 pressing against the rear face 2107 of the forward bolt 2020, and/or (iii) any other appropriate way. These constraints affect the firing pin 2080 because the flange 2082 of the firing pin 2080 engages at least one of (in some cases both) the rear portion 2302 of the short cam pin 2030 and internal step 2057 of the carrier 2050. Accordingly, a cartridge can only be fired when the firearm operating system 2000 is in the deployed configuration. As described in more detail below, the deployed configuration includes a condition where bearings 2023*a*, 2023*b*, and 2023*c* are engaged within recesses 2061*a*, 2061*b*, and 2061*c*, respectively.

The forward retaining pin 2261, the rear retaining pin 2262, and the vertical cam pin 2271 may be retained within their respective holes because the firing pin 2080 passes through hole 2263 of forward retaining pin 2261, through notch 2266 of rear retaining pin 2262, and through hole 2274 of vertical cam pin 2271 (as described above). Based on this configuration, to remove the forward retaining pin 2261, the rear retaining pin 2262, and/or the vertical cam pin 2271, the firing pin 2080 must first be removed. In addition, the hole 2112 of the forward bolt 2020 may be a blind hole such that the hole is only accessible from above (as shown in the drawings).

In addition, the firearm operating system 2000 allows the firearm 1 to include a barrel 50 without a hole for venting/redirecting gas pressure to the operating system. In other words, another advantage compared to conventional systems is that the barrel 50 of the firearm operating system 2000 is simpler and less likely to corrode or otherwise fail due to additional holes thus increasing longevity.

Figure 8A:
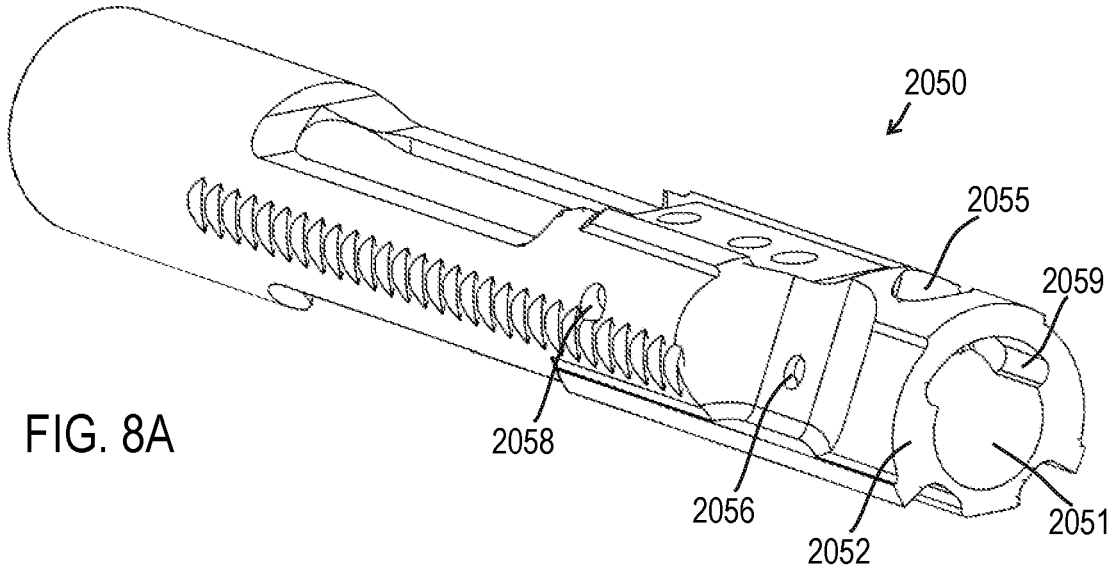
FIG. 8A is a front right side perspective view of a carrier of the firearm operating system of FIG. 1.
Figure 8B:
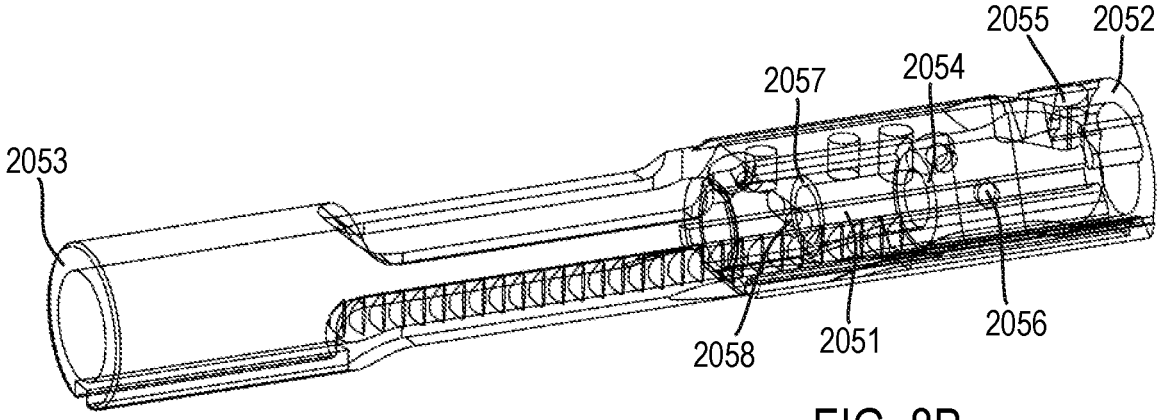
FIG. 8B is a rear right perspective view of the carrier of FIG. 8A.

In some embodiments, the firearm operating system 2000 includes an assembly pin that is inserted into hole 2058 of the carrier 2050 (see FIGS. 8A and 8B). When the assembly pin is inserted into hole 2058, the assembly pin may be at least partially disposed within cavity 2051 of the carrier 2050 such that the assembly pin interacts with the firing pin 2080. In particular, the assembly pin is disposed between the rear end 2083 and the flange 2082 of the firing pin 2080 such that the firing pin 2080 cannot be removed from the cavity 2033 of the short cam pin 2030 while the assembly pin is installed.

Figure 2A:
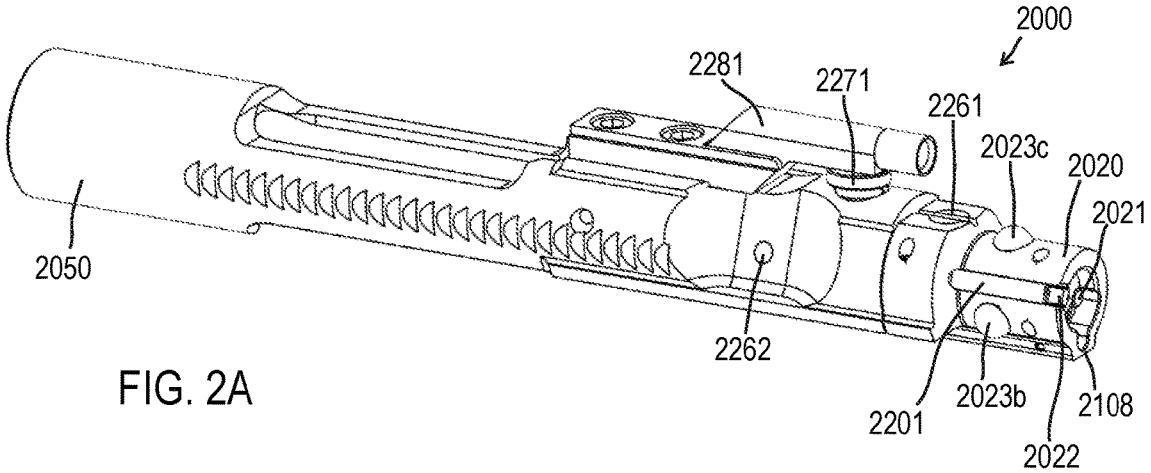
FIG. 2A is a right side perspective view of the firearm operating system of FIG. 1.
Figure 2B:
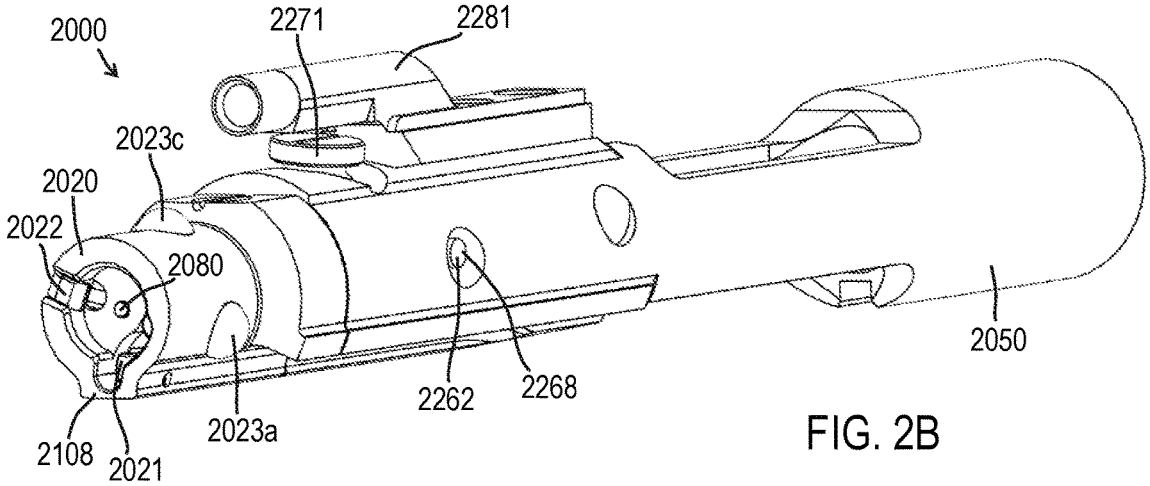
FIG. 2B is a left side perspective view of the firearm operating system of FIG. 1.
Figure 3:
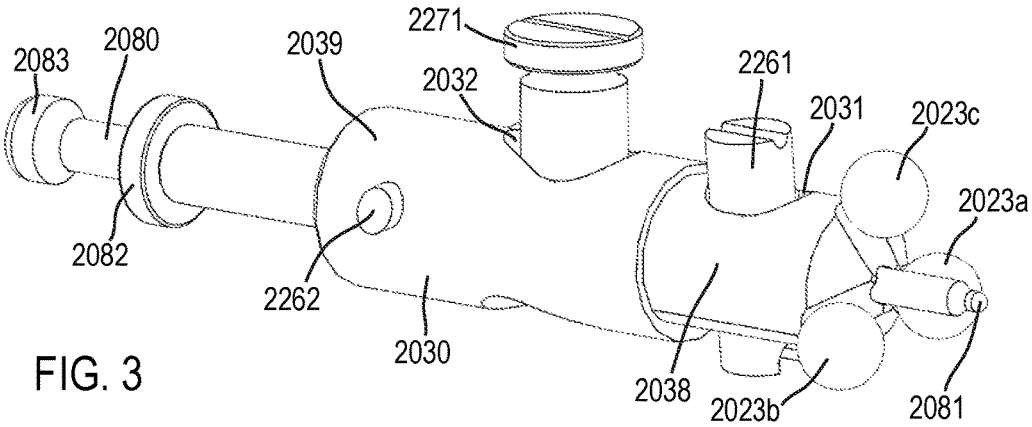
FIG. 3 is a right side partial perspective view of the firearm operating system of FIG. 1.
Figure 5A:
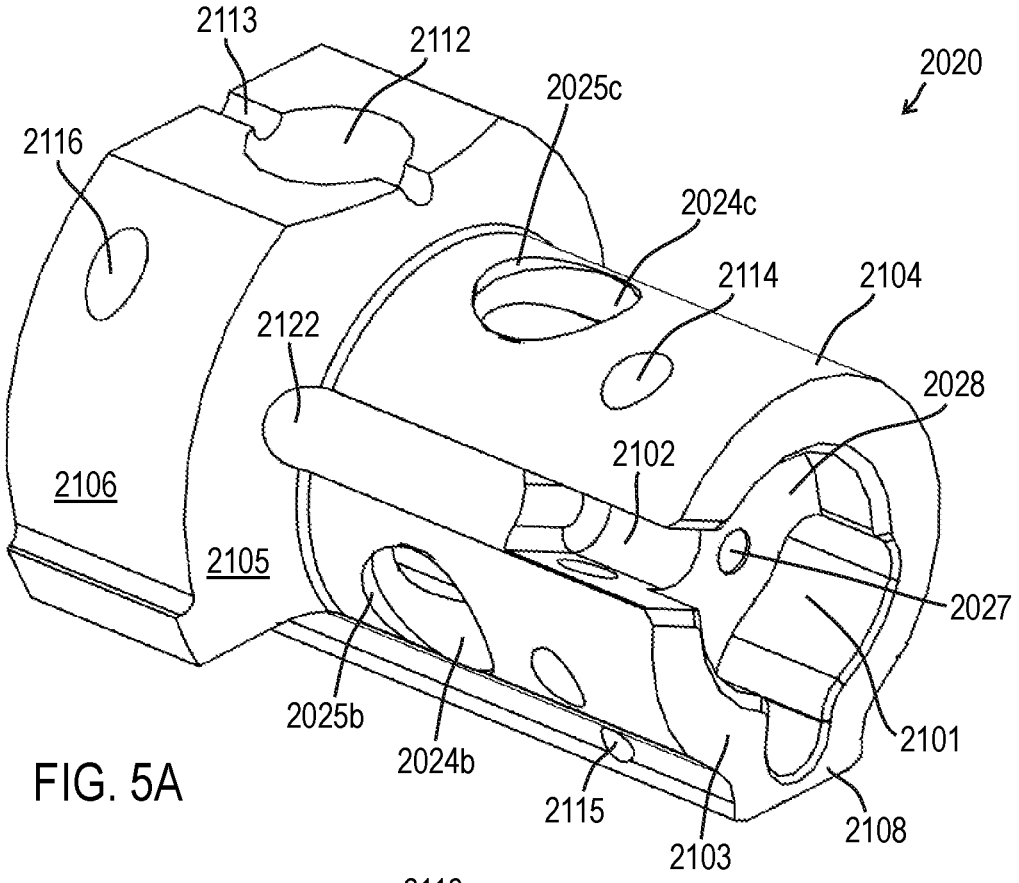
FIG. 5A is a front right side perspective view of a forward bolt of the firearm operating system of FIG. 1.
Figure 5B:
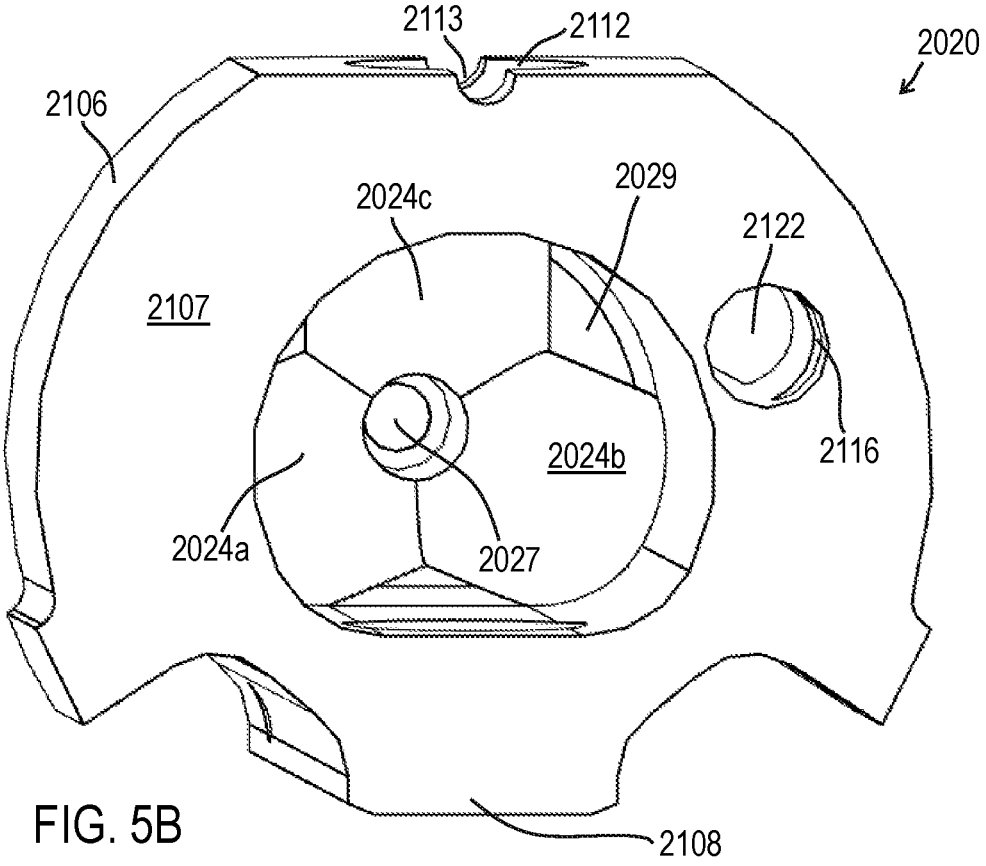
FIG. 5B is a rear left side perspective view of the forward bolt of FIG. 5A.
Figure 5C:
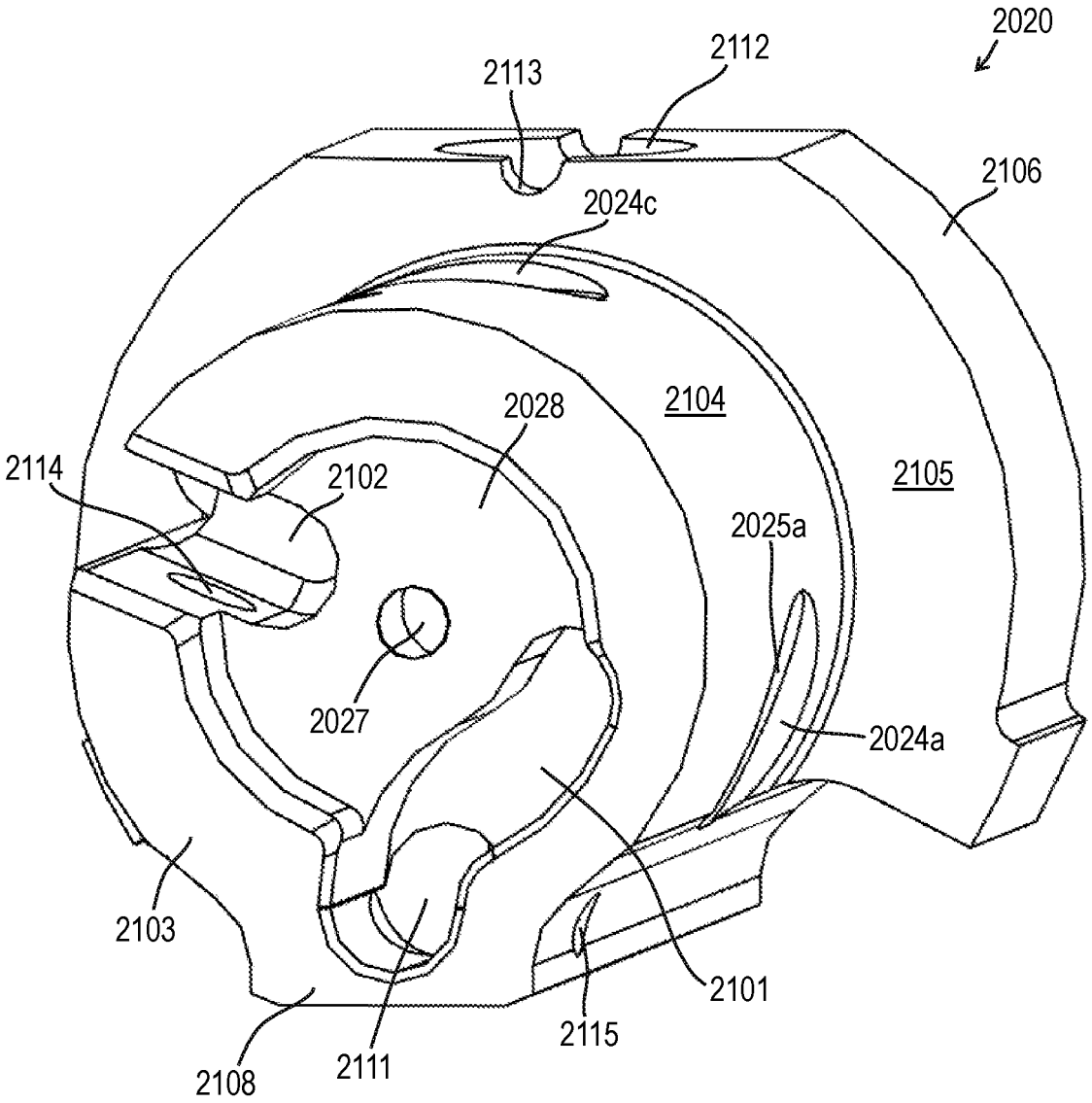
FIG. 5C is a front left side perspective view of the forward bolt of FIG. 5A.

The forward bolt 2020 includes a forward face 2103, a rear face 2107, a lower portion 2108, a rear cavity 2029, an ejector hole 2101, an extractor cavity 2102, at least one bearing cavity 2024, and a forward cavity 2028, (see FIGS. 5A-5C). In some embodiments, the at least one bearing cavity 2024 includes a first bearing cavity 2024*a*, a second bearing cavity 2024*b*, and a third bearing cavity 2024*c*. As shown in FIGS. 2A and 2B, the forward bolt 2020 may interface with an ejector 2021, an extractor 2022, and at least one bearing 2023. In some embodiments, the at least one bearing 2023 includes a first bearing 2023*a*, a second bearing 2023*b*, and a third bearing 2023*c*. Although the bearings 2023 are illustrated as spherical (ball) bearings, the bearings 2023 may have any configuration, including, for example, cylindrical, tapered, needle, toroidal, annular, etc. In some cases, the first bearing 2023*a* is disposed in the first bearing cavity 2024*a*, the second bearing 2023*b* is disposed in the second bearing cavity 2024*b*, and the third bearing 2023*c* is disposed in the third bearing cavity 2024*c*. The bearings may be retained within their respective cavities. For example, each cavity 2024 may include a retaining portion 2025 that prevents the bearing 2023 from passing entirely through the cavity 2024 (i.e., where the bearing 2023 can partially protrude but cannot move entirely through the cavity 2024). The first bearing cavity 2024*a* may include a first retaining portion 2025*a*, the second bearing cavity 2024*b* may include a second retaining portion 2025*b*, and the third bearing cavity 2024*c* may include a third retaining portion 2025*c*. As one example, each retaining portion 2025 may include a machined profile near the outer edge where the dimension (e.g., diameter) of the cavity 2024 decreases when nearing the outer portion of the cavity 2024. The retaining portion 2025 may be an integral feature (e.g., a machined feature as described above, a welded feature, etc.) or may be an additional component added to the forward bolt 2020.

Figure 18A:
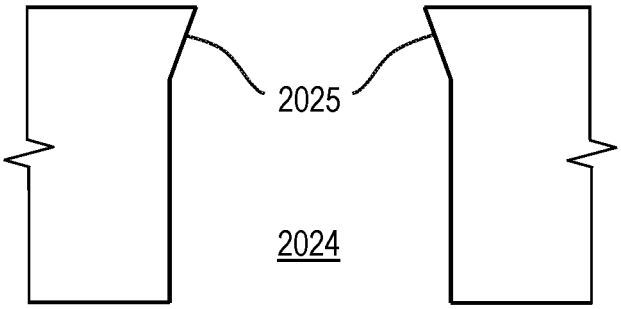
FIG. 18A is a schematic section view of a bearing cavity of the firearm operating system of FIG. 1.
Figure 18B:
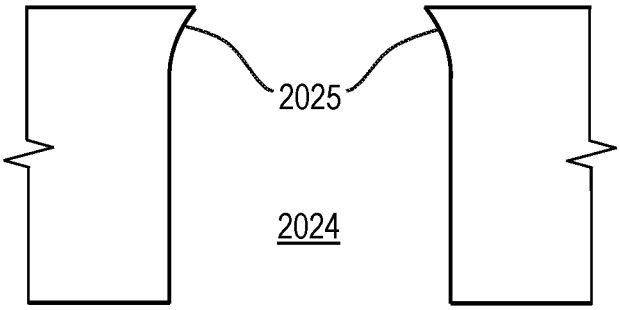
FIG. 18B is a schematic section view of a bearing cavity of the firearm operating system of FIG. 1.

FIGS. 18A and 18B each show schematic cross-section examples of a cavity 2024 that includes a retaining portion 2025. As shown in FIG. 18A, in some embodiments, the retaining portion 2025 is a tapered surface that reduces the size of the cavity 2024 linearly. For examples where the cavity 2024 has a circular cross-section, retaining portion 2025 is a tapered surface that reduces the diameter of the cavity 2024 and results in a conical profile. If the bearing 2023 is a spherical bearing (i.e., the illustrated embodiment for bearings 2023), the engagement between the retaining portion 2025 and the bearing 2023 may be formed as a curve (e.g., a circle). FIG. 18B shows embodiments where the retaining portion 2025 is a tapered surface that reduces the size of the cavity 2024 non-linearly. For examples where the cavity 2024 has a circular cross-section, retaining portion 2025 is a curved surface that reduces the diameter of the cavity 2024. In some examples, the interior of the retaining portion 2025 results in a spherical profile. If the bearing 2023 is a spherical bearing (i.e., the illustrated embodiment for bearings 2023), the engagement between the retaining portion 2025 and the bearing 2023 may be formed as a surface and/or a series of curves/circles.

Based on the configuration of the cavities 2024 and the retaining portions 2025, the bearings 2023 cannot exit outward through the cavities 2024. In some embodiments, the only option for removing the bearings 2023 is to disassemble the forward bolt 2020 and the short cam pin 2030 (which would require removing the firing pin 2080 and the forward retaining pin 2261). The bearings 2023 could then be removed through rear cavity 2029.

In some embodiments, the three bearings 2023 are evenly distributed around the surface of the forward bolt 2020 (i.e., approximately 120° apart from one another). In other cases, the bearings 2023 are not equally distributed in order to avoid features of the forward bolt 2020 (e.g., the ejector 2021, the extractor 2022, etc.). As one example, the first bearing 2023*a* is located at the 4 o'clock position when viewing the forward face 2103 of the forward bolt 2020 while the second bearing 2023*b* is located at the 8 o'clock position and the third bearing 2023*c* is located at the 12 o'clock position. Such an arrangement avoids the lower portion 2108 and the extractor cavity 2102 of the forward bolt 2020. In some cases, the overall shape of the forward bolt 2020 includes a forward portion 2104 and a rear portion 2106. The forward portion 2104 may include an approximately cylindrical shape with an approximately rectangular lower portion 2108. The rear portion 2106 may be approximately cylindrical with a horizontal planar top portion.

When the forward bolt 2020 moves forward over the top of the magazine (located in the magazine well 11 of the lower receiver), the lower portion 2108 pushes the uppermost cartridge out of the magazine and toward the chamber of the firearm 1. When the cartridge is in the chamber in a firing position, the cartridge is approximately aligned with a center of the forward face 2103 of the forward bolt 2020 such that the central hole 2027 of the forward bolt 2020 is aligned with the primer of the cartridge (to align the firing pin 2080 with the cartridge). When the cartridge is in the firing position, forward motion of a forward end 2081 of the firing pin 2080 (e.g., caused by a hammer interacting with the rear end 2083 of the firing pin 2080) causes the cartridge to discharge.

Figure 9A:
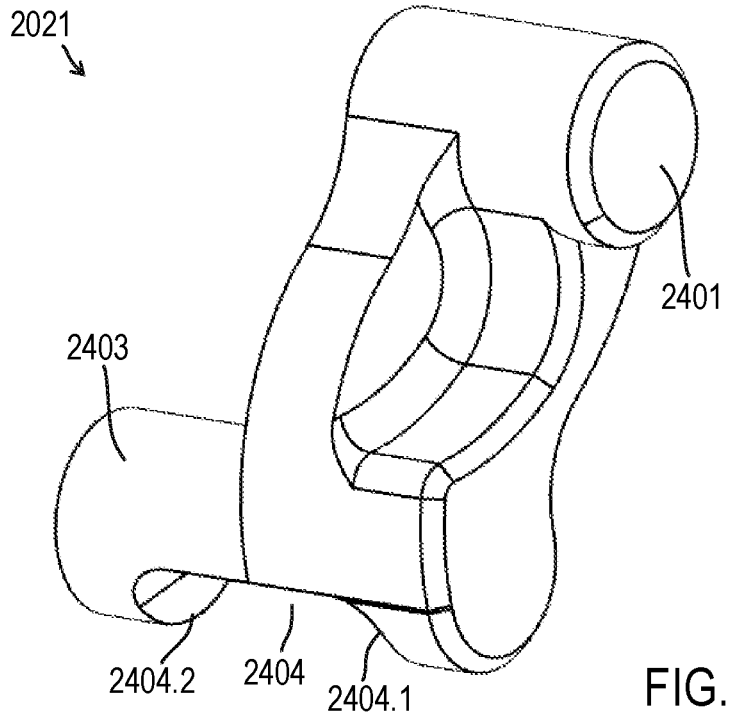
FIG. 9A is a front top perspective view of an ejector of the firearm operating system of FIG. 1.
Figure 9B:
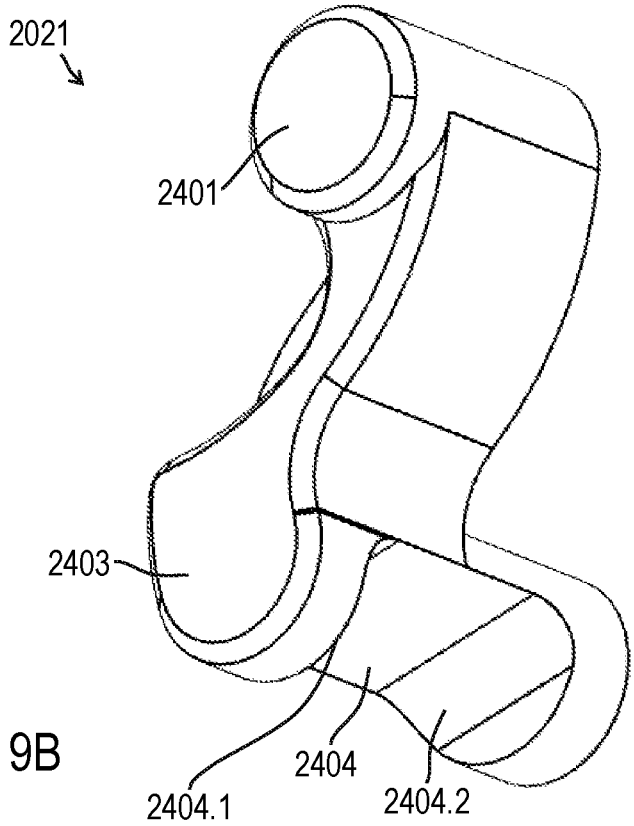
FIG. 9B is a front bottom perspective view of the ejector of FIG. 9A.

The ejector 2021 interfaces with the ejector hole 2101 of the forward bolt 2020. As shown in FIGS. 9A and 9B, in some embodiments, the ejector 2021 includes a forward interface 2401, a rear protrusion 2403, and a notch 2404. The forward interface 2401 may protrude forward relative to the other portions of the ejector 2021 such that the forward interface 2401 is the only portion of the ejector 2021 that contacts a cartridge disposed adjacent to a forward side of the forward bolt 2020. In some embodiments, the forward interface 2401 is disposed approximately 180° from the extractor 2022. However, based on the arrangement of the bearings 2023 described above, extending the ejector 2021 directly rearward from the forward interface 2401 would interfere with first bearing cavity 2024*a*. Accordingly, the ejector 2021 may be designed such that the rear protrusion 2403 extends rearward at the 6 o'clock position when viewing the forward face 2103 of the forward bolt 2020. To install the ejector 2021 into the forward bolt 2020, a spring is inserted into hole 2111, which will compress when the ejector 2021 is pushed rearward (see FIG. 5C). After inserting the ejector 2021 into the ejector hole 2101, the ejector 2021 is adjusted such that a portion of the notch 2404 is aligned with hole 2115 of the forward bolt 2020 and a pin 2117 is then inserted into hole 2115 (see FIGS. 4A and 4B). The pin 2117 may be a roll pin, a solid pin, or any other appropriate configuration used to retain the ejector 2021. The ejector spring is compressed within hole 2111 when the ejector 2021 is pushed rearward. For example, when a rim of a cartridge is retained by extractor 2022, the rear surface of the cartridge presses the ejector 2021 rearward such that the forward interface 2401 is approximately flush with a rear wall or floor of the forward cavity 2028. In some embodiments, when the forward interface 2401 is approximately flush with the rear wall of the forward cavity 2028, the forward end 2404.1 of notch 2404 is adjacent to or in contact with pin 2117. When the forward bolt 2020 moves rearward due to either (i) manual operation/movement (e.g., operating the charging handle) or (ii) cycling of the firearm 1 after firing a cartridge, the spring in hole 2111 pushes the ejector 2021 forward such that once the forward face 2103 reaches the ejection port 31 of the upper receiver 30, the ejector 2021 pushes the rear surface of a cartridge (or an empty shell of a cartridge if a round was fired) causing the cartridge/shell to pivot about the extractor 2022 and exit the firearm 1.

Figure 10A:
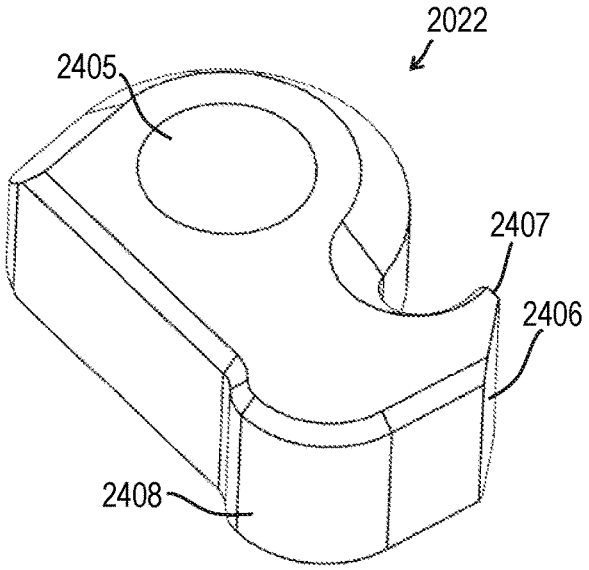
FIG. 10A is a front perspective view of an extractor of the firearm operating system of FIG. 1.
Figure 10B:
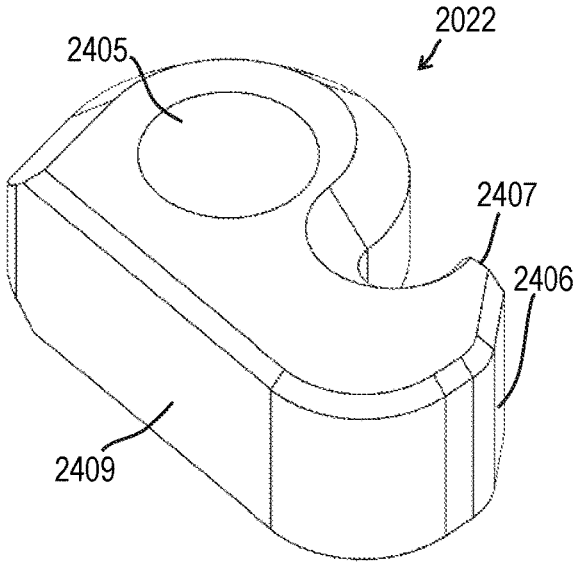
FIG. 10B is a front perspective view of an extractor of the firearm operating system of FIG. 1.

The extractor 2022 may be located within the extractor cavity 2102 of the forward bolt 2020 such that the extractor 2022 can move based on the geometry of the cavity 2102 and an interface with an extractor spring 2201 inserted into extractor spring cavity 2122. As shown in FIGS. 10A and 10B, the extractor 2022 may include a hole 2405, a front surface 2406, and a hook member 2407. In some embodiments, the extractor 2022 rotates about hole 2405 and lip 2407 engages the rim of a cartridge or empty shell. The extractor 2022 may be arranged such that the hole 2405 is aligned and/or coaxial with hole 2114 of the forward bolt 2020 (see FIGS. 5A and 5C). After inserting the extractor 2022 into the extractor cavity 2102, the extractor 2022 is adjusted such that hole 2405 is aligned with hole 2114 of the forward bolt 2020 and a pin 2118 is then inserted through hole 2114 and into hole 2405 (see FIGS. 4A and 4B). The pin 2118 may be a roll pin, a solid pin, or any other appropriate configuration used to retain the extractor 2022. The hook member 2407 of extractor 2022 may be configured to engage a cannelure and/or a rim of the cartridge such that the extractor 2022 guides the cartridge (or the empty shell of a cartridge if a round was fired) in the direction of the ejection port 31 of the upper receiver 30 using the force provided by the ejector 2021. The extractor 2022 may include an outer protrusion 2408 as shown in FIG. 10A, which acts as a cam surface. In some cases, the extractor 2022 may include a continuous or flat outer surface 2409 (see FIG. 10B). The barrel extension 2060 may include a corresponding recess 2064 for the extractor 2022 when the firearm operating system 2000 is in battery (see FIGS. 16A-16D).

Figure 11:
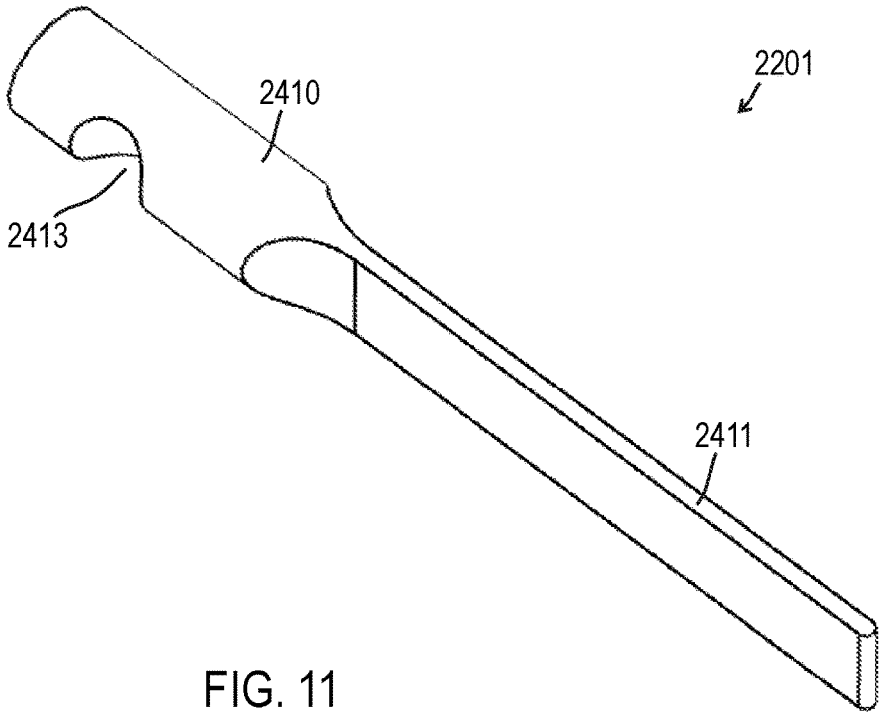
FIG. 11 is a front perspective view of an extractor spring of the firearm operating system of FIG. 1.

In some embodiments, rotation of the extractor 2022 depends on an interface with the extractor spring 2201 (see FIG. 11). The extractor spring 2201 may include a rear portion 2410, a front portion 2411, and a notch 2413. In some cases, the rear portion 2410 may be cylindrical and the front portion 2411 may include a blade shape having a rectangular cross section. The front portion 2411 may function similar to a leaf spring. The extractor spring 2201 is inserted into hole 2122 of the forward bolt 2020 such that the notch 2413 is aligned with hole 2116 of the forward bolt 2020. A pin 2119 is then inserted through hole 2116 and into notch 2413 (see FIGS. 4A-5B). The pin 2119 may be a roll pin, a solid pin, or any other appropriate configuration used to retain the extractor spring 2201.

Manual operation/cycling of the firearm operating system 2000 may include rearward movement of the charging handle where the charging handle engages a portion of the firearm operating system 2000. For example, in some embodiments, the charging handle engages the forward face 2052 of the carrier 2050. In other embodiments, the charging handle engages a gas key 2281. The gas key 2281 may include a cylindrical protrusion with an open cavity, as shown in FIG. 4A. In other cases, the gas key 2281 has a shorter overall length without any cylindrical protrusion, as shown in FIG. 4B.

As described above, the firearm operating system 2000 may include at least one bearing 2023. In some embodiments, each bearing 2023 has a diameter of approximately 0.1" (0.25 cm) to approximately 0.4" (1.02 cm). In other cases, each bearing 2023 has a diameter of approximately 0.2" (0.51 cm) to approximately 0.3" (0.76 cm). In other cases, each bearing has a diameter of approximately 0.25" (0.635 cm).

The bearings 2023 may interface with other components of the firearm operating system 2000. For example, the bearings 2023*a*, 2023*b*, and 2023*c* may each have an internal configuration (see FIG. 4B) where a surface of each bearing 2023 is approximately flush with a respective surface of the forward bolt 2020. For example, in the internal configuration, a portion of the surface of the first bearing 2023*a* is approximately flush with the left side surface of the forward bolt 2020. Similarly, a portion of the outer surface of the second bearing 2023*b* is approximately flush with the right side surface of the forward bolt 2020 and a portion of the outer surface of the third bearing 2023*c* is approximately flush with the upper surface of the forward bolt 2020. The bearings 2023*a*, 2023*b*, and 2023*c* may be capable of moving outward to an extended configuration where the bearings 2023*a*, 2023*b*, and 2023*c* move outward relative to their respective cavity 2024 such that at least a portion of each of the bearings 2023*a*, 2023*b*, and 2023*c* extend beyond the respective surfaces of the forward bolt 2020. For example, in the extended configuration, a portion of the surface of the first bearing 2023*a* protrudes beyond the left side surface of the forward bolt 2020, a portion of the surface of the second bearing 2023*b* protrudes beyond the right side surface of the forward bolt 2020, and a portion of the surface of the third bearing 2023*c* protrudes beyond the upper surface of the forward bolt 2020. In some embodiments, the bearings 2023*a*, 2023*b*, and 2023*c* may interface with (i) the short cam pin 2030 (internal to the forward bolt 2020) and/or (ii) the barrel extension 2060 (external to the forward bolt 2020).

When the firearm operating system 2000 is in the forwardmost configuration relative to the firearm 1 (see FIG. 1), the bearings 2023 interface with both the short cam pin 2030 and the barrel extension 2060. There is forward pressure on the rear portion 2053 of the carrier 2050 (e.g., due to forward momentum of the components of firearm operating system 2000 and/or pressure from a buffer spring, which is not shown), which consequently pushes the short cam pin 2030 in the forward direction. The forward end 2301 of the short cam pin 2030 may include a tapered or narrowed portion. In some embodiments, the forward end 2301 includes a conical profile that narrows toward the front. Forward pressure on the short cam pin 2030 causes the forward surfaces 2036*a*, 2036*b*, and 2036*c* to push the bearings 2023*a*, 2023*b*, and 2023*c* outward (respectively). Outward pressure on the bearings 2023*a*, 2023*b*, and 2023*c* causes each bearing to engage the relevant recess 2061 of the barrel extension 2060. Specifically, outward pressure from forward surface 2036*a* pushes bearing 2023*a* into recess 2061*a*, outward pressure from forward surface 2036*b* pushes bearing 2023*b* into recess 2061*b*, and outward pressure from forward surface 2036*c* pushes bearing 2023*c* into recess 2061*c*. Accordingly, when the firearm operating system 2000 is in the deployed configuration (see FIG. 4A) and located in a forward position as shown in FIG. 1, the bearing(s) 2023 engage the barrel extension 2060 to lock the firearm operating system 2000 in a condition ready to fire (i.e., in battery). In some embodiments, when the firearm operating system 2000 is in battery, the profile surface 2105 of the forward bolt 2020 is approximately in contact with the rear ramp surface 2062 of the barrel extension 2060. In other words, when the bearings 2023 engage the recesses 2061, these two surfaces (profile surface 2105 and rear ramp surface 2062) may be approximately line to line. The two surfaces (profile surface 2105 and rear ramp surface 2062) may be parallel to one another. When the firearm operating system 2000 is in battery, the lower portion 2108 of the forward bolt 2020 may be disposed in the corresponding recess 2063 of the barrel extension.

After a cartridge is fired, the mechanisms described above cause a delay before the bolt assembly (the forward bolt 2020, the carrier 2050 and other related components) can move rearward away from the chamber. In particular, the bearings 2023*a*, 2023*b*, and 2023*c* press against the curved/tapered surface on the rear side of the recesses 2061*a*, 2061*b*, and 2061*c*, respectively, of the barrel extension 2060. In other words, bearing 2023*a* presses against the surface of recess 2061*a*, bearing 2023*b* presses against the surface of recess 2061*b*, and bearing 2023*c* presses against the surface of recess 2061*c* (see FIGS. 16A-16C). Each of the recesses 2061 tapers to a smaller diameter when moving rearward. The rearward taper of these surfaces of the recesses 2061 may be linear and/or may be curved. The interaction between these recesses 2061 of the barrel extension 2060 and the bearings 2023 presses the bearings 2023 inward (toward the interior of the forward bolt 2020) while other portions of the bearings 2023 press against the forward surfaces 2036 of the short cam pin 2030. In some cases, the surface geometry of (i) the recesses 2061, (ii) the bearings 2023, and/or (iii) the forward surfaces 2036 may be designed to determine the distance, time, rate, force, etc. of the movement of the bearings 2023 after the cartridge has been fired. For example, the geometry of the recesses 2061 and/or the forward surfaces 2036 may be changed to increase/decrease cycling rate, adapt for different ammunition (e.g., caliber, powder charge, etc.), optimize for suppressed/unsuppressed, or any other appropriate purpose. Although the recesses 2061 are illustrated as being oriented in the radial direction (perpendicular to the outer surface of the forward bolt 2020 and intersecting a center), the recesses 2061 may be oriented in any other appropriate direction.

In some embodiments, the firearm operating system 2000 can be tuned by replacing the short cam pin 2030. Each short cam pin 2030 includes a geometric relationship between the forward surfaces 2036 and the axial direction (i.e., the axis through the center of the firing pin 2080 that is aligned with cavity 2033 and hole 2027). To tune the firearm operating system 2000, an operator may replace the short cam pin 2030 to change the geometric relationship between the bearings 2023 and the short cam pin 2030. Different short cam pins 2030 can be used to account for changes in caliber, bullet weight, powder charge, barrel length, etc. or may be designed to optimize for suppressed/unsuppressed, to increase/decrease cycling rate, or any other appropriate purpose. In some cases, different short cam pins 2030 have a different angle between the centerline of each forward surface 2036 and the axial direction. In other cases, different short cam pins 2030 have a more complex geometric relationship with the axial direction which may include a circular arc, a non-circular arc, a polynomial relationship, an average angle, and/or any other appropriate relationship. The operator may also replace the barrel extension 2060 to vary the geometric relationship between the recesses 2061 and the bearings 2023.

Accordingly, after sufficient force is applied to the forward surfaces 2036*a*, 2036*b*, and 2036*c*, the short cam pin 2030 moves rearward relative to the forward bolt 2020 due to the force applied between the recesses 2061 of the barrel extension 2060 and the bearings 2023, which causes the firearm operating system 2000 to move from the deployed configuration (FIG. 4A) to the retracted configuration (FIG.

4B). Once the bearings 2023 have moved inward a sufficient distance to allow clearance through the barrel extension 2060, the delay is over and the bolt assembly moves rearward into the upper receiver 30. As described above, the subsequent cycling includes extracting/ejecting a cartridge or empty shell, compressing a buffer spring (not shown), pushing the upper-most cartridge out of the magazine and toward the chamber of the firearm 1, etc.

In some embodiments, the barrel extension 2060 includes a plurality of flat portions on an outer surface thereof to facilitate an interface with a tool, such as a wrench. The barrel extension 2060 may be removably attached to the barrel 50 while in other embodiments, the barrel extension 2060 is integral or permanently attached to the barrel 50. For embodiments where the barrel extension 2060 is removably attached to the barrel 50, the barrel extension 2060 may be threaded onto the barrel 50, press-fit on the barrel 50, pinned to the barrel 50, and/or attached in any other appropriate way. Removable attachment of the barrel extension 2060 allows a barrel extension 2060 to be replaced if/when wear occurs to one or more of the recesses 2061.

Figure 6A:
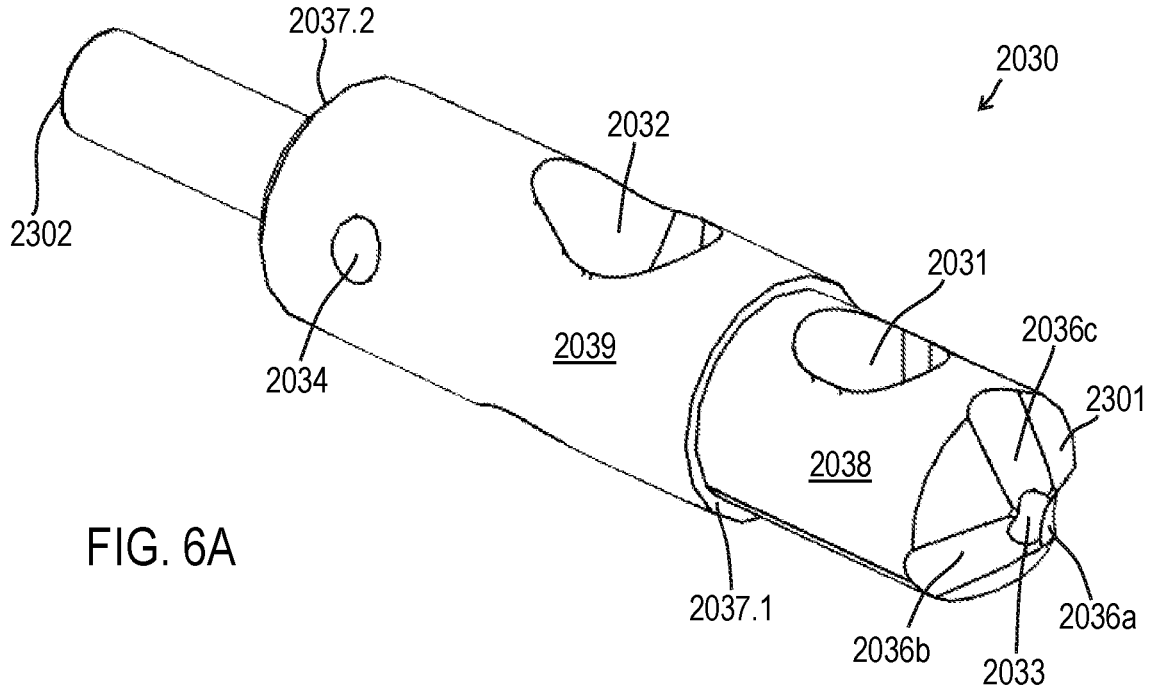
FIG. 6A is a top right side perspective view of a short cam pin of the firearm operating system of FIG. 1.
Figure 6B:
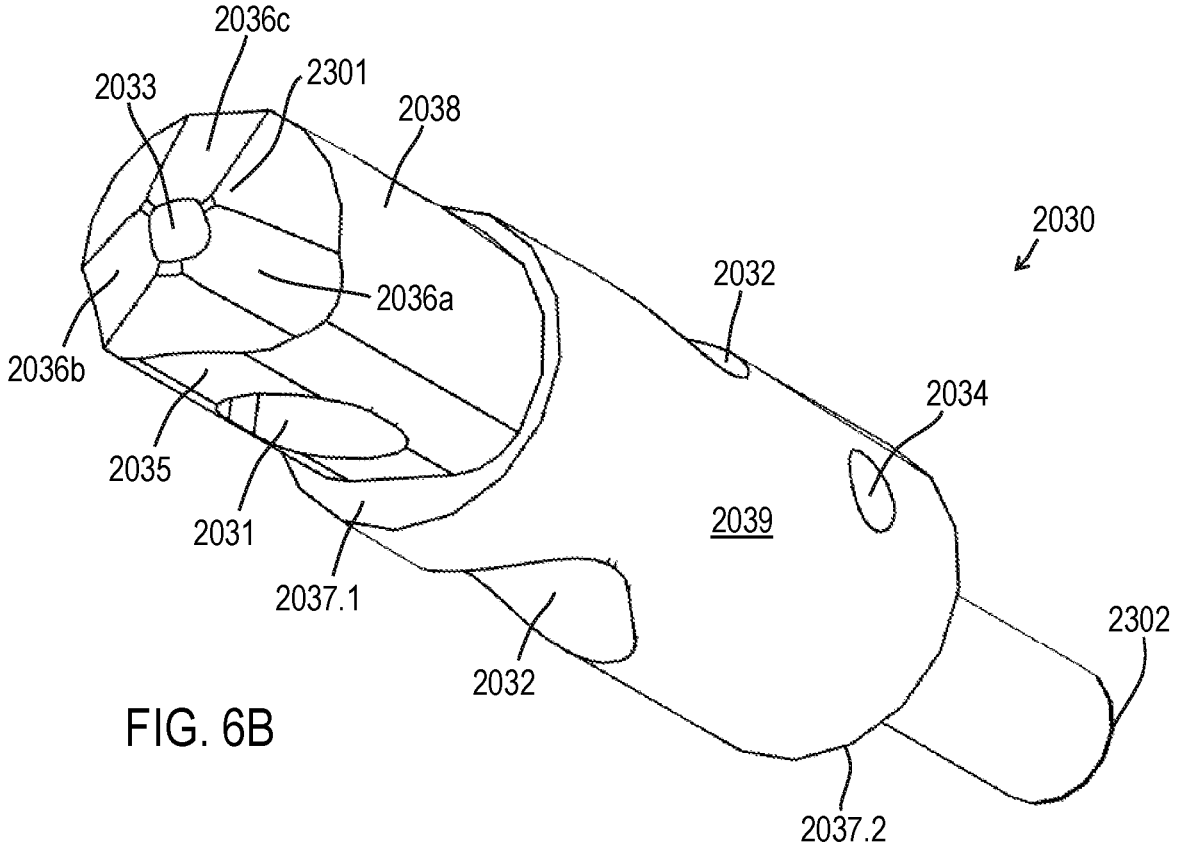
FIG. 6B is a bottom left side perspective view of the short cam pin of FIG. 6A.

As shown in FIGS. 6A and 6B, the forward surfaces 2036*a*, 2036*b*, and 2036*c* of the short cam pin 2030 may include concave surfaces. To promote continuous contact with the surface of the bearings 2023, each of the forward surfaces 2036 may include a curved surface that approximately matches the shape of the bearing 2023. For example, if one of the bearings 2023 is spherical, the corresponding forward surface 2036 may be concave with a partially cylindrical shape (i.e., a partially circular cross section) to interface with the bearing 2023. In some cases, the corresponding forward surface 2036 may be concave with a partially conical shape (i.e., a partially circular cross section) to interface with the bearing 2023. In other embodiments, the corresponding forward surface 2036 may have other shapes including, for example, a planar shape, a curved surface with a partially elliptical shape, or any other appropriate shape. The dimensions of the corresponding forward surface 2036 may be similar to the bearing 2023 (e.g., similar diameter) or, in some cases, may be larger than the bearing 2023 to ensure the bearing 2023 remains in contact with the forward surface 2036.

Figure 16A:
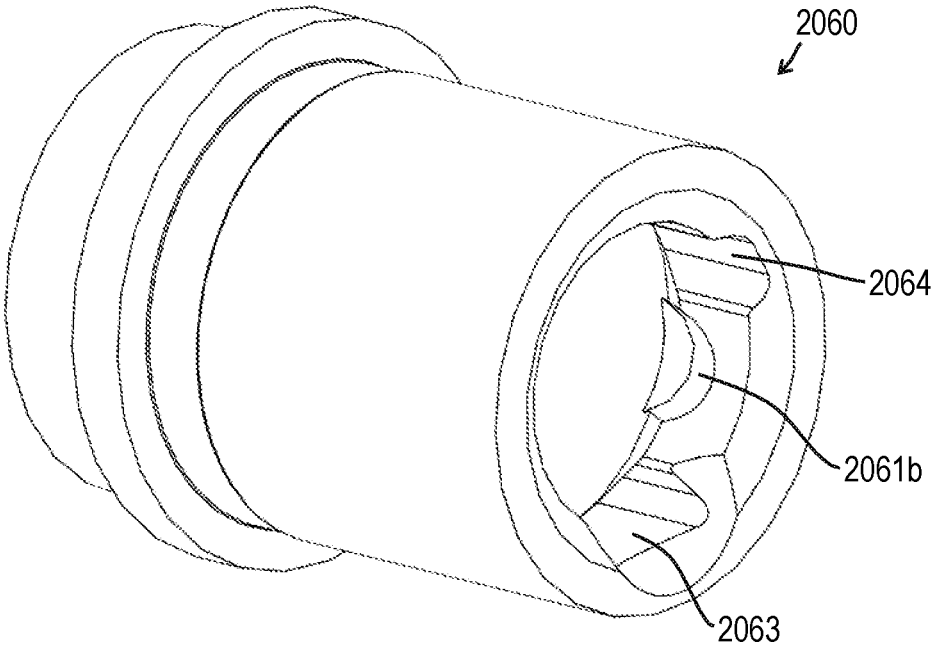
FIG. 16A is a left rear perspective view of a barrel extension of the firearm operating system of FIG. 1.
Figure 16B:
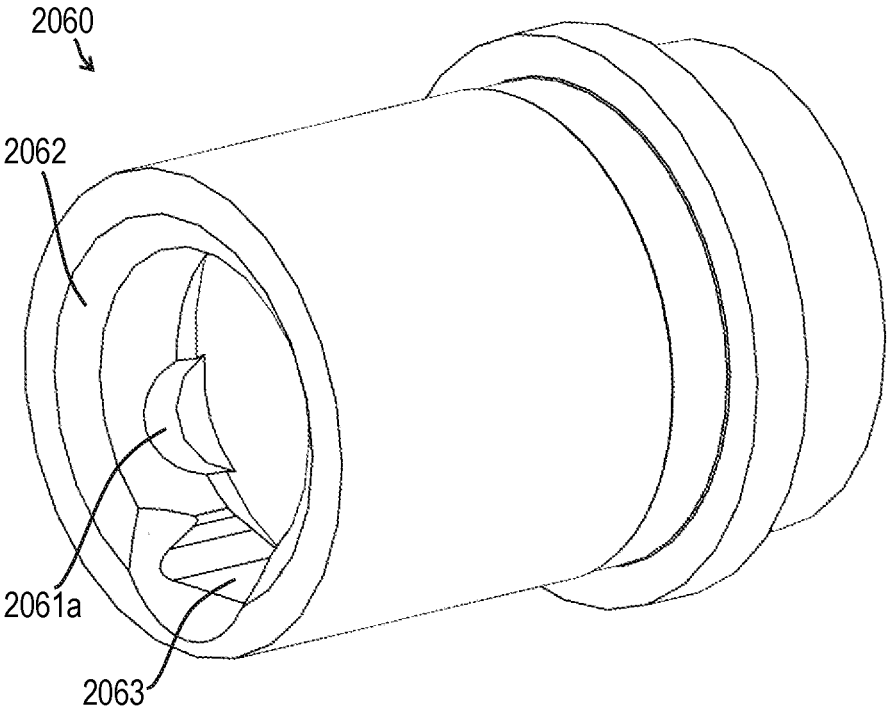
FIG. 16B is a right rear perspective view of the barrel extension of FIG. 16A.
Figure 16C:
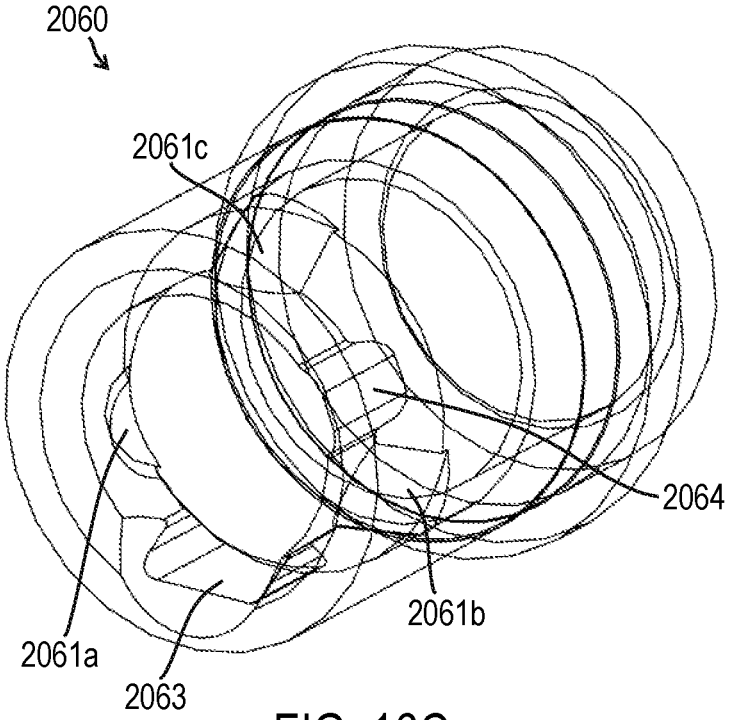
FIG. 16C is a right rear perspective transparent view of the barrel extension of FIG. 16A.
Figure 16D:
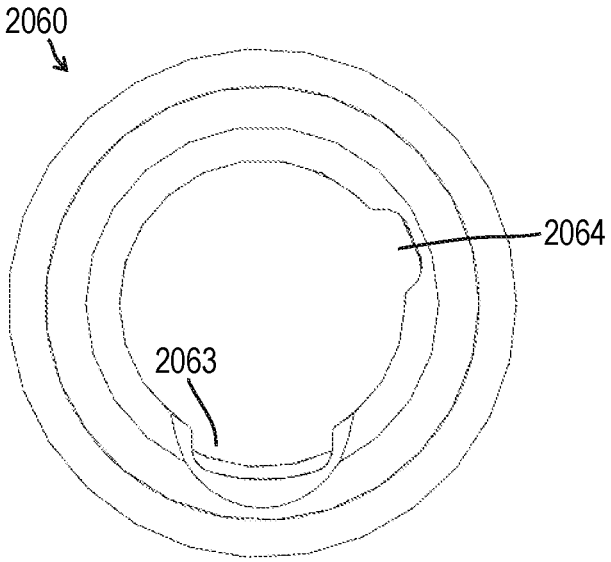
FIG. 16D is a rear view of the barrel extension of FIG. 16A.

Similarly, as shown in FIGS. 16A-16C, the recesses 2061*a*, 2061*b*, and 2061*c* of the barrel extension 2060 may include concave surfaces. To promote continuous contact with the surface of the bearings 2023, each of the recesses 2061 may include a curved surface that approximately matches the shape of the bearing 2023. For example, if one of the bearings 2023 is spherical, the corresponding recess 2061 may be concave with a partially cylindrical shape (i.e., a partially circular cross section) to interface with the bearing 2023. In some cases, the corresponding recess 2061 may be concave with a partially conical shape (i.e., a partially circular cross section) to interface with the bearing 2023. In other embodiments, the corresponding recess 2061 may have other shapes including, for example, a planar shape, a curved surface with a partially elliptical shape, or any other appropriate shape. The dimensions of the corresponding recess 2061 may be similar to the bearing 2023 (e.g., similar diameter) or, in some cases, may be larger than the bearing 2023 to ensure the bearing 2023 remains in contact with the recess 2061.

In some embodiments, in addition to the movement and subsequent operations due to the bearing(s) 2023 (as described above), cycling of the firearm operating system 2000 may also include function of the vertical cam pin 2271. The bolt assembly (the forward bolt 2020, the carrier 2050 and other related components) move rearward away from the barrel extension 2060 in the retracted configuration with gap g between the forward bolt 2020 and the carrier 2050. As described above, there is minimal movement between the short cam pin 2030 and the carrier 2050 due to rear retaining pin 2262. Movement of the vertical cam pin 2271 is dependent on the inner surface of the upper receiver 30. For example, in some embodiments, the inner surface of the upper receiver 30 includes a recessed area surrounding the head 2272 that corresponds to the location of the vertical cam pin 2271 when the firearm operating system 2000 is in the forwardmost configuration relative to the firearm 1 (in both the retracted configuration and the deployed configuration). The vertical cam pin 2271, which also passes through both the forward bolt 2020 and the carrier 2050, is free to move within the contoured hole 2055 of the carrier 2050 and/or the contoured hole 2032 of the short cam pin 2030 such that the vertical cam pin 2271 can rotate about hole 2274 (i.e., about the firing pin 2080). Based on the contoured shape of hole 2055 and/or the hole 2032, any movement of the vertical cam pin 2271 would be rearward and toward the left side of the firearm 1 (i.e., away from the ejection port 31 of the upper receiver 30). However, when the bolt assembly moves rearward, the head 2272 of the vertical cam pin 2271 interacts with other portions of the inner surface of the upper receiver 30 such that the head 2272 is pushed laterally inward toward a center of the firearm 1. Based on the contoured shape of the hole 2055 and/or the hole 2032, any inward movement would move the vertical cam pin 2271 forward toward the front of the firearm 1.

Figure 17:
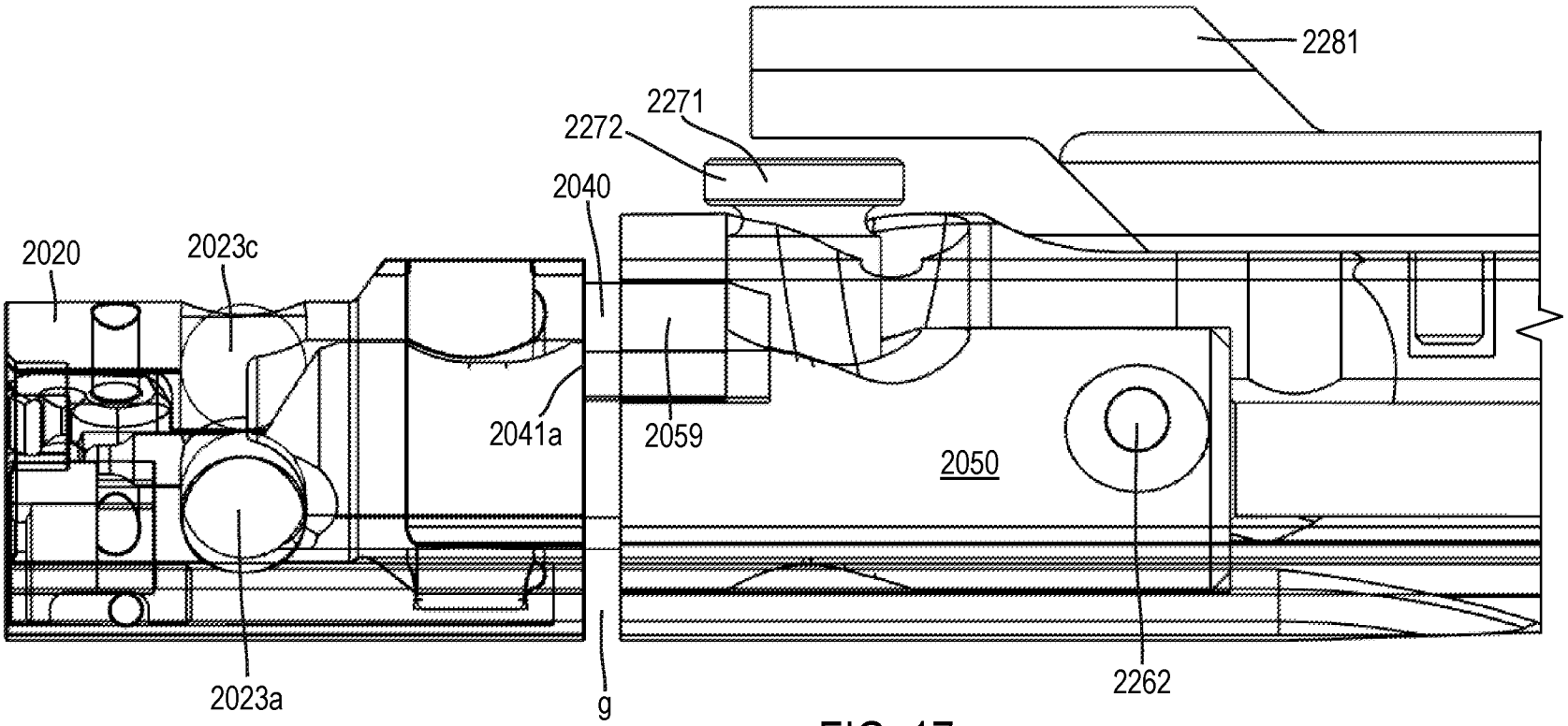
FIG. 17 is a partial left side view of the firearm operating system of FIG. 1.

FIG. 17 shows an example of the firearm operating system 2000 located in a rearward position (i.e., offset toward the rear of the firearm 1 away from the barrel extension 2060) where the head 2272 of the vertical cam pin 2271 is pushed inward (and thus forward) due to interaction with the inner surface of the upper receiver 30. In this condition, the vertical cam pin 2271 is located at or near a forward edge of the hole 2055 and/or the hole 2032 such that the vertical cam pin 2271 presses against the bearing spacer 2040. As shown in FIG. 17, forward pressure from the vertical cam pin 2271 pushes the rear surface 2041*b* which causes the bearing spacer 2040 to move forward at least partially into gap g such that the forward surface 2041*a* presses against the rear face 2107 of the forward bolt 2020. In other words, forward movement/pressure from the vertical cam pin 2271 pushes the bearing spacer 2040 against the forward bolt 2020, which maintains gap g between the forward bolt 2020 and the carrier 2050. Maintaining the gap g ensures that there is nothing pushing the bearings 2023 outward because there is no forward pressure on the short cam pin 2030 (i.e., the forward surfaces 2036 are not pushing the bearings 2023 outward).

As the firearm operating system 2000 moves back forward (toward the barrel extension 2060), the head 2272 of the vertical cam pin 2271 interacts with a portion the inner surface of the upper receiver 30 that no longer applies pressure inward (i.e., a recess) and allows the vertical cam pin 2271 to move rearward and to the left side of the firearm 1 within the hole 2055 and/or the hole 2032. Rearward movement of the vertical cam pin 2271 removes pressure on rear surface 2041*b* and allows the bearing spacer 2040 to move toward the carrier 2050. In such a condition, forward momentum of the bolt assembly and/or pressure from a buffer spring (not shown), which presses forward on rear face 2053 of the carrier 2050, causes the short cam pin 2030 and the carrier 2050 to begin moving forward relative to the forward bolt 2020. The bearing spacer 2040 will move into the cavity 2059 due to the movement of the vertical cam pin 2271 and/or due to pressure from the forward bolt 2020 on the forward surface 2041*a*. In some embodiments, when the bearing spacer 2040 is seated in the cavity 2059, the forward surface 2041*a* is approximately flush or coplanar with the forward face 2052 of the carrier 2050. In some cases, the firearm operating system 2000 is configured such that as the bolt assembly moves forward, the head 2272 reaches the recessed area of the inner surface of the upper receiver 30 concurrent with the bearings 2023 reaching the rear ramp surface 2062 of the barrel extension 2060.

According to certain embodiments of the present invention, as shown in FIGS. 19-35B, a firearm operating system 3000 may include a forward bolt 3020, a short cam pin 3030, a carrier 3050, and a barrel extension 3060. The firearm operating system 3000 may be incorporated into a firearm 1 that includes an upper receiver 30 and a barrel 50. Other components (e.g., lower receiver, magazine, charging handle, handguard, etc.) are not illustrated for simplicity. In some cases, the firearm operating system 3000 is located within the upper receiver 30. The firearm operating system 3000 may be designed as an assembly of components to fit within a standard upper receiver (e.g., upper receiver 30 shown transparent in FIG. 19) for a known modular firearm such that the upper receiver 30 (including the firearm operating system 3000) can interface with a standard lower receiver. For example, the firearm operating system 3000 may be designed to function and engage with (i) components of AR-15 variant (civilian) or M16/M4 (military) firearms; (ii) components of AR-10 variant firearms; or (iii) components of any other relevant firearm.

FIGS. 20A-22 show many of the relevant components of the firearm operating system 3000 in situ. As described in greater detail below, in some embodiments, at least a portion of a forward section 3038 of the short cam pin 3030 is disposed within an internal cavity of the forward bolt 3020 (e.g., rear cavity 3029) and at least a portion of a rear section 3039 of the short cam pin 3030 is disposed within an internal cavity of the carrier 3050 (e.g., cavity 3051) wherein the forward bolt 3020 is located on a forward side of the carrier 3050. The forward section 3038 of the short cam pin 3030 may include a lower portion 3035 to match the internal shape of the rear cavity 3029 of the forward bolt 3020. In some embodiments, the lower portion 3035 (see FIG. 24B) is contoured (i.e., not planar or flat) to match the surface of the rear cavity 3029 of the forward bolt 3020. In some cases, the rear cavity 3029 includes a contour of the lower surface thereof to accommodate a large ejector 3021 (i.e., hole 3111 is configured to accommodate rear protrusion 3403 and the ejector spring located within cavity 3402). In addition to not showing the magazine, the upper receiver 30, and the handguard 40 (as described above), in FIG. 22, the forward bolt 3020 and the carrier 3050 are transparent to better illustrate components of the firearm operating system 3000. Cycling of the firearm operating system 3000 is based on linear motion of various components in the forward/aft direction X including, for example, the forward bolt 3020, the short cam pin 3030, the carrier 3050, and the firing pin 3080.

Figure 21A:
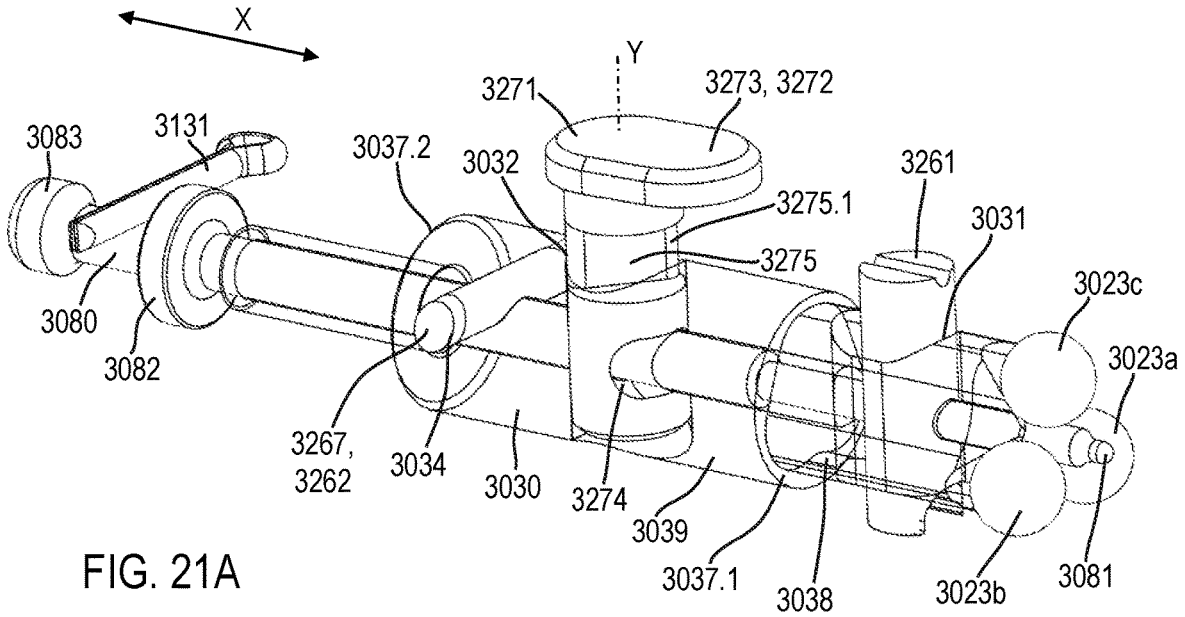
FIGS. 21A and 21B are right side partial perspective views of the firearm operating system of FIG. 19.
Figure 21B:
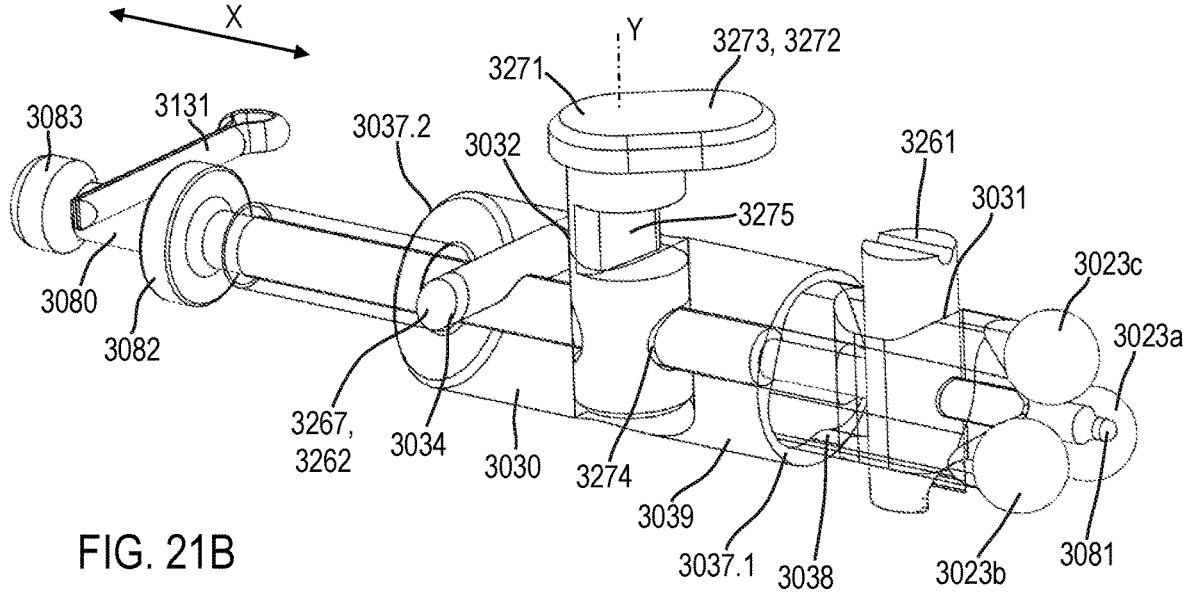
Figure 22:
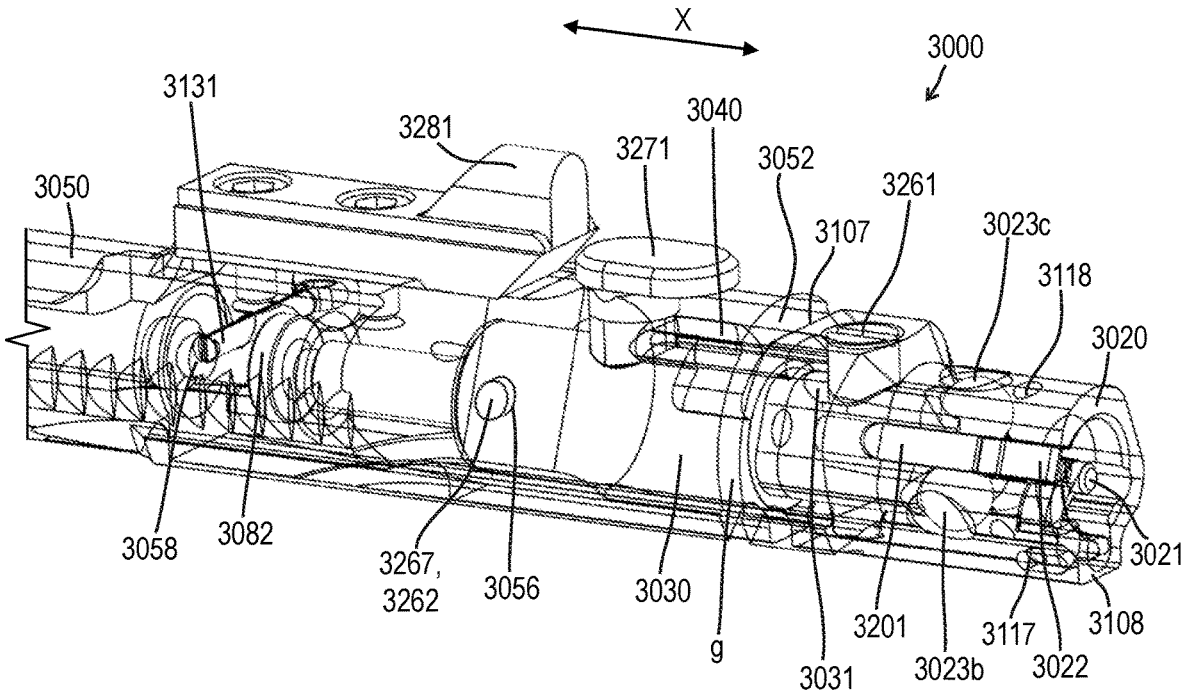
FIG. 22 is a right side perspective view of the firearm operating system of FIG. 19.
Figure 23A:
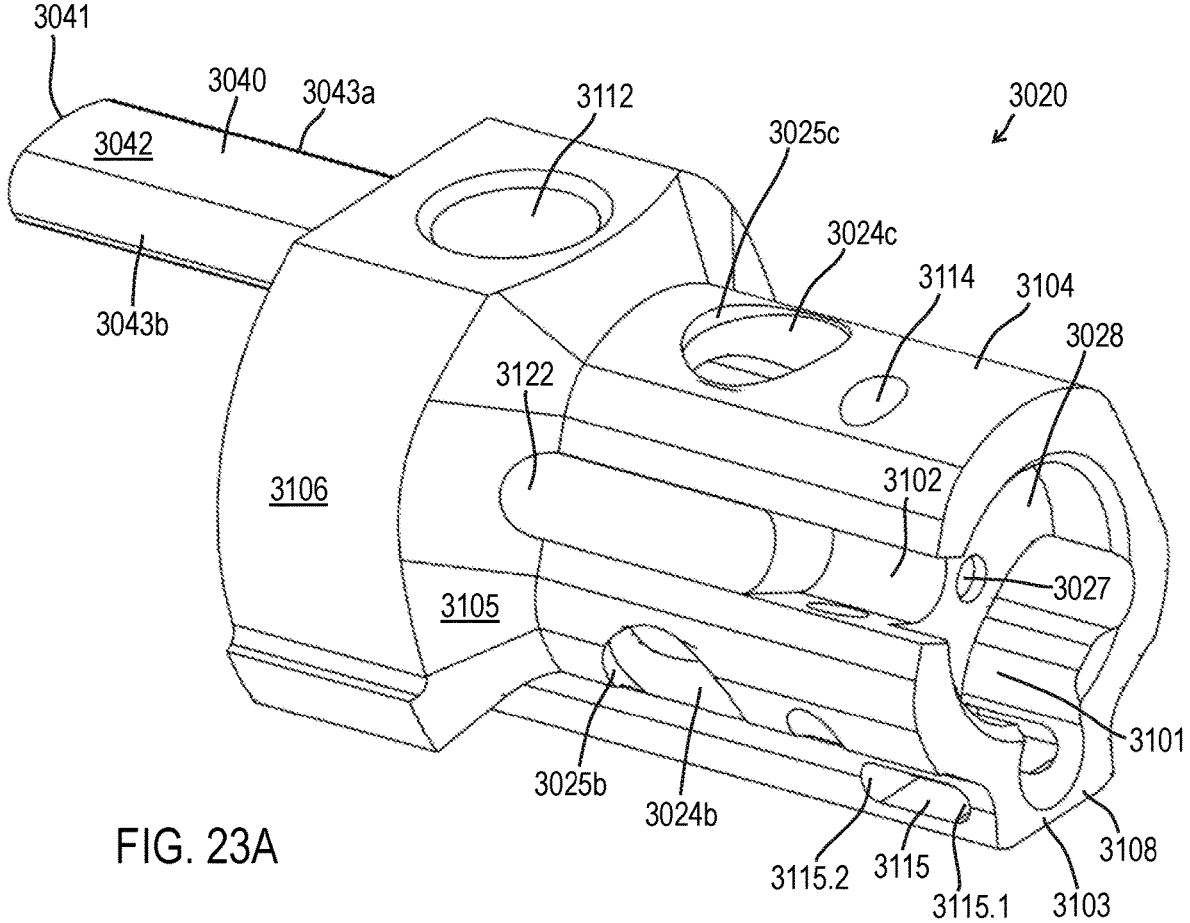
FIG. 23A is a front right side perspective view of a forward bolt of the firearm operating system of FIG. 19.
Figure 23B:
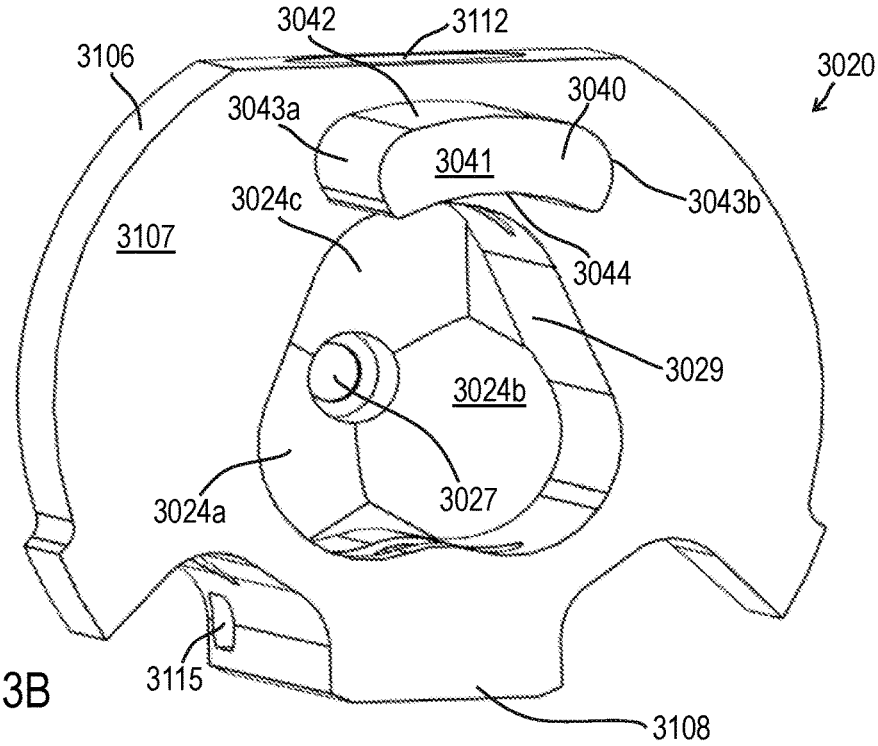
FIG. 23B is a rear left side perspective view of the forward bolt of FIG. 23A.
Figure 23C:
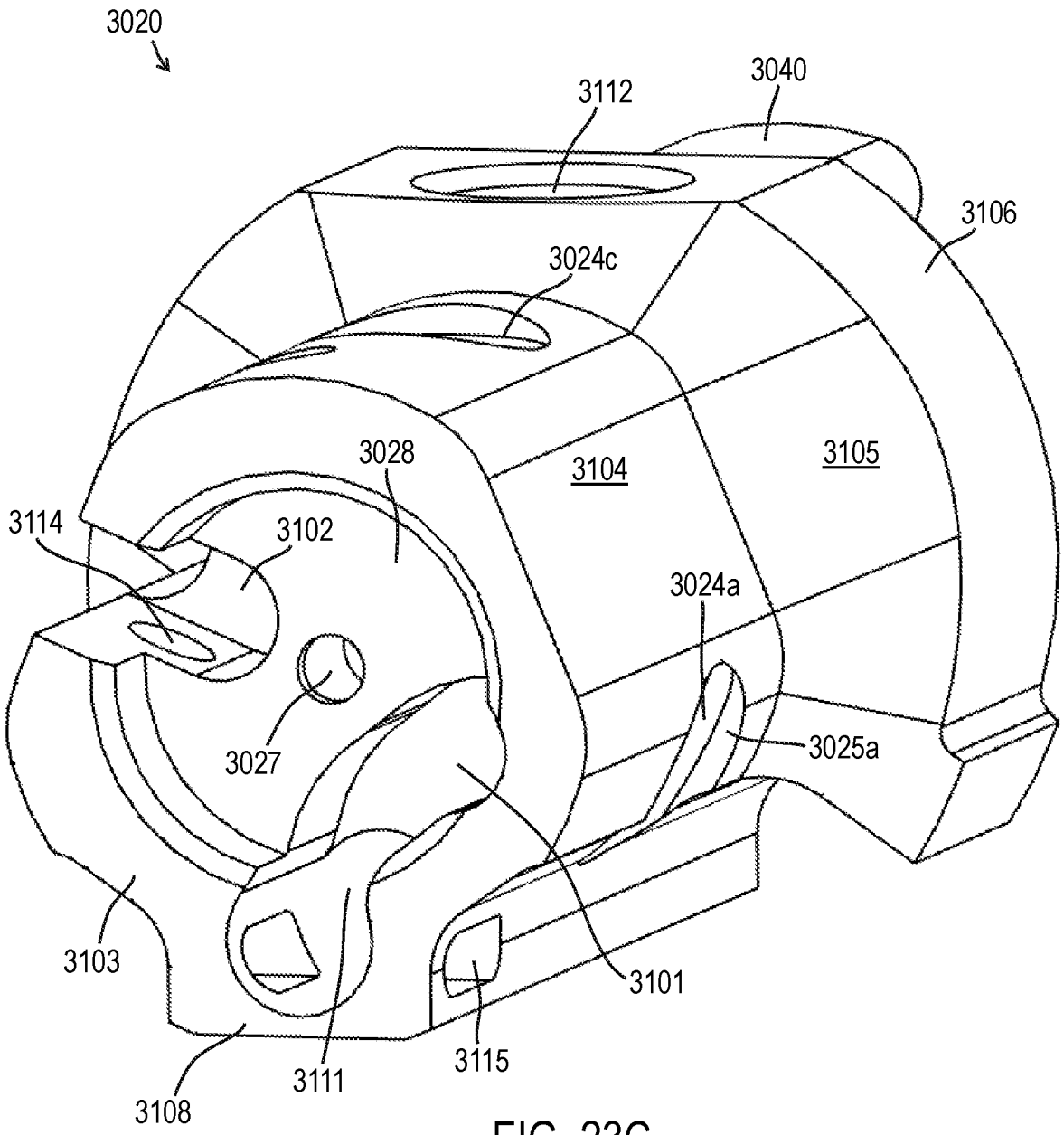
FIG. 23C is a front left side perspective view of the forward bolt of FIG. 23A.
Figure 23D:
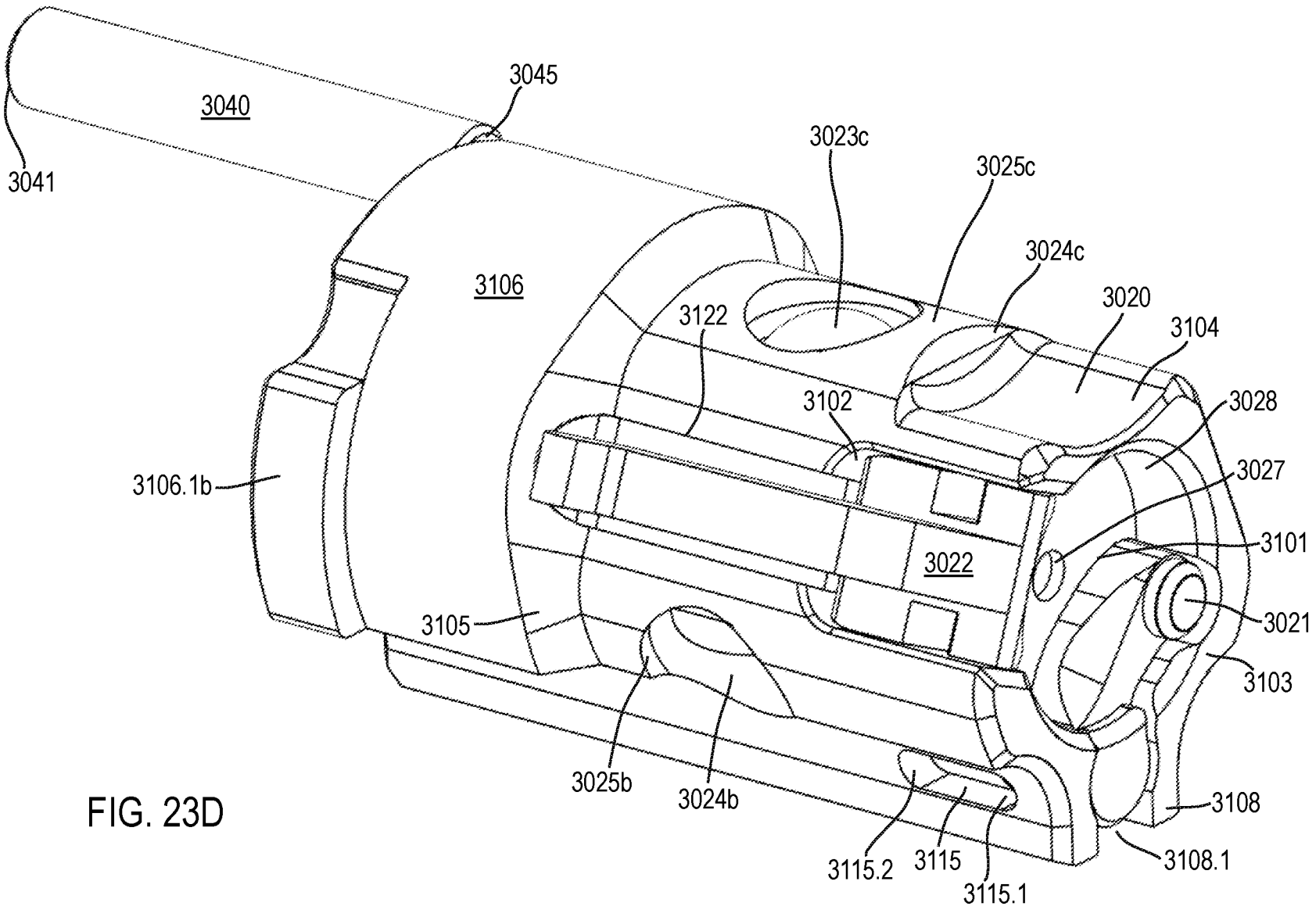
FIG. 23D is a front right side perspective view of a forward bolt of the firearm operating system of FIG. 19.

In some embodiments, the forward bolt 3020, short cam pin 3030, the carrier 3050, and the firing pin 3080 combine together as one unit within the firearm operating system 3000. As shown in FIG. 22, the forward bolt 3020 may be disposed on a forward side of the carrier 3050 such that, in some conditions, there is a gap g between a rear face 3107 of the forward bolt 3020 and a forward face 3052 of the carrier 3050. The short cam pin 3030 and the firing pin 3080 may each extend internally into and/or through a rear cavity 3029 of the forward bolt 3020 (see FIGS. 23A-23D) and into/through the cavity 3051 of the carrier 3050 (see FIGS. 25A-25C). In some cases, the firing pin 3080 extends through central hole 3027 of the forward bolt 3020 such that the firing pin 3080 may protrude into forward cavity 3028 of the forward bolt 3020 where the firing pin may interface with a cartridge. Although illustrated as a separate component, in some embodiments, the short cam pin 3030 may be an integral component of the carrier 3050. The firing pin 3080 may extend through a cavity 3033 of the short cam pin 3030 (see FIGS. 21A, 21B, 24A, and 24B). The firearm operating system 3000 may include at least one forward retaining pin 3261 (see FIG. 29) to constrain movement of the short cam pin 3030 relative to the forward bolt 3020. The firearm operating system 3000 may also include a rotating cam pin 3271 that extends through the carrier 3050 and the short cam pin 3030 (see FIGS. 30A and 30B). In addition, the firearm operating system 3000 may include a bearing spacer 3040 that is disposed at least partially within a cavity 3059 of the carrier 3050. As shown in FIGS. 23A-23C, the bearing spacer 3040 may be an integral component of the forward bolt 3020. In other embodiments, as shown in FIG. 23D, the bearing spacer 3040 may be a separate component from the forward bolt 3020. The bearing spacer 3040 may include a rear surface 3041 that interfaces with an internal recess 3275 of the rotating cam pin 3271 (as described below) and/or a forward surface 3045 that interfaces with the rear face 3107 of the forward bolt 3020. In some embodiments, the bearing spacer 3040 is a cylindrical rod (see FIG. 23D) while in other cases, the bearing spacer 3040 has an arched shape, crescent shape, a polygonal cross section (e.g., rectangular, square, pentagonal, hexagonal, etc.), and/or any other appropriate shape.

As shown in FIG. 22, the forward bolt 3020 and the short cam pin 3030 may be movable relative to one another in the X-direction such that the firearm operating system 3000 has a deployed configuration and a retracted configuration. In some embodiments, in the retracted configuration, the short cam pin 3030 is in a rear position relative to the forward bolt 3020, which creates the gap g between a rear face 3107 of the forward bolt 3020 and a forward face 3052 of the carrier 3050 (see FIG. 22). When the firearm operating system 3000 moves to the deployed configuration, the short cam pin 3030 moves to a forward position relative to the forward bolt 3020, which reduces or eliminates the gap g between the rear face 3107 of the forward bolt 3020 and the forward face 3052 of the carrier 3050.

Figure 25A:
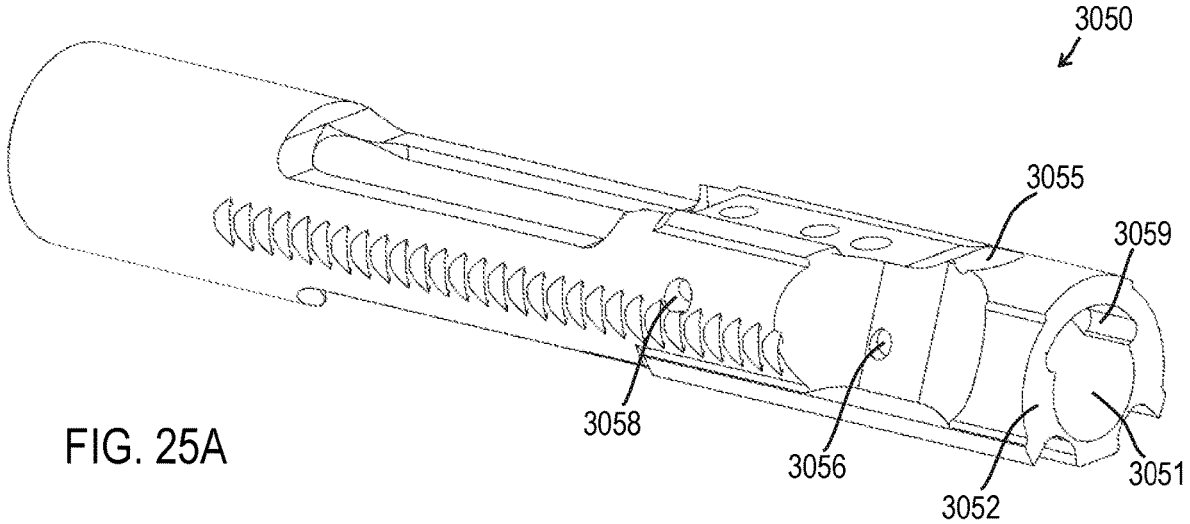
FIG. 25A is a front right side perspective view of a carrier of the firearm operating system of FIG. 19.
Figure 25B:
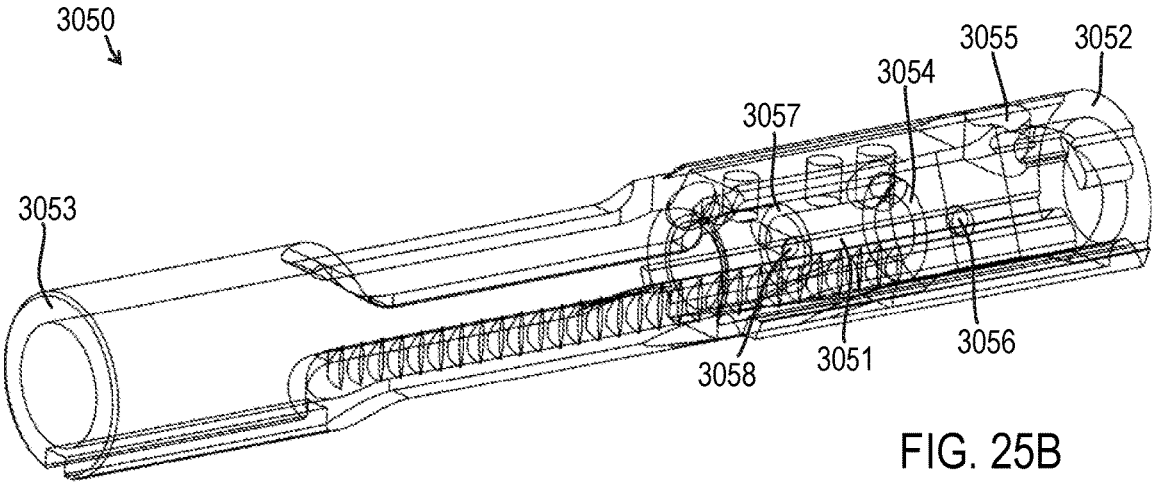
FIG. 25B is a rear right perspective view of the carrier of FIG. 25A.
Figure 25C:
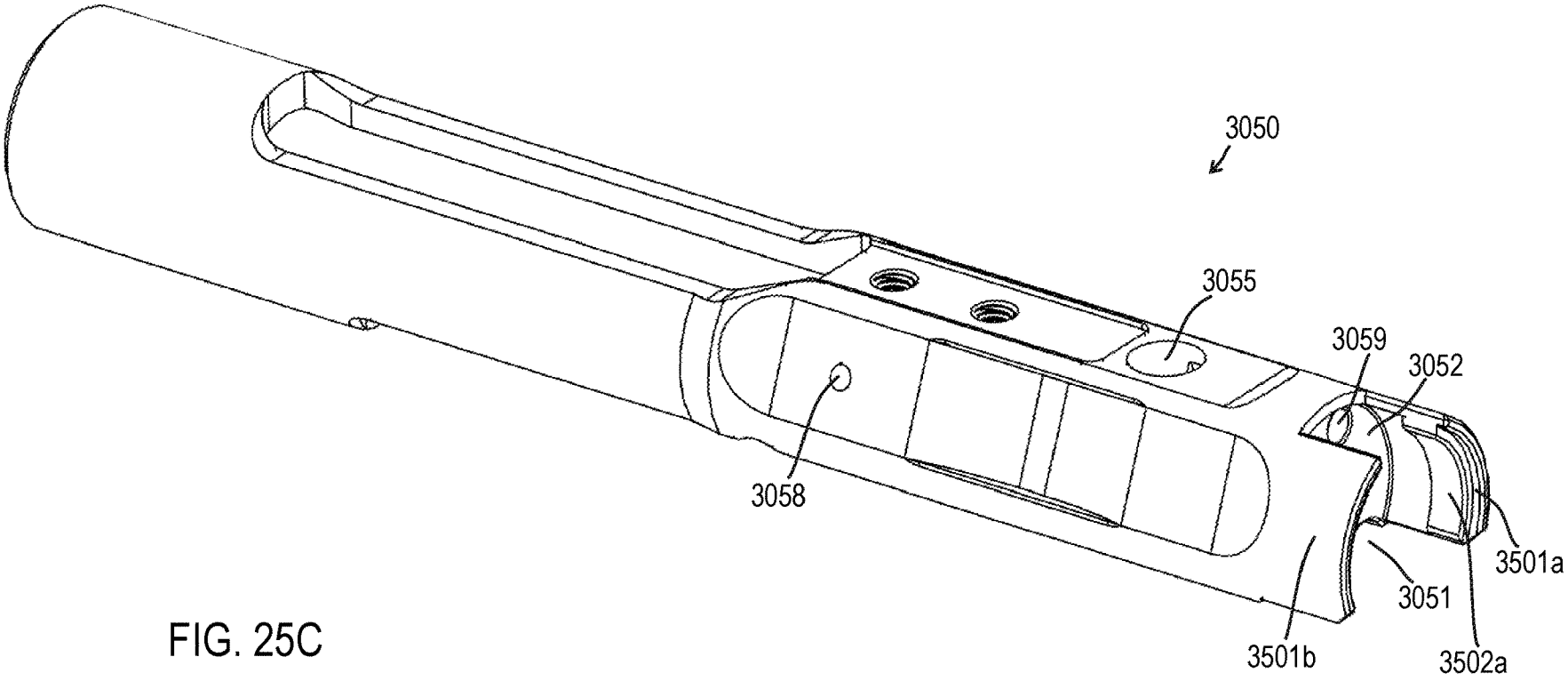
FIG. 25C is a front right side perspective view of a carrier of the firearm operating system of FIG. 19.
Figure 29:
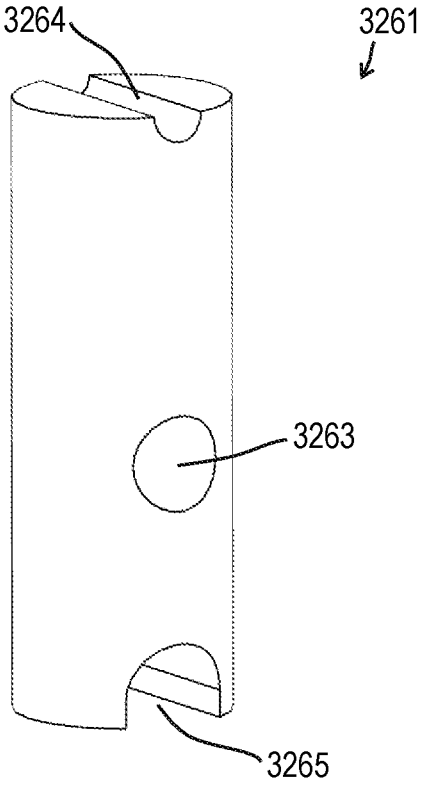
FIG. 29 is a top perspective view of a forward retaining pin of the firearm operating system of FIG. 19.

The distance or magnitude of gap g may be determined by the geometry of the interface between the forward bolt 3020 and the short cam pin 3030. In some embodiments, the interface between the forward bolt 3020 and the short cam pin 3030 is based on forward retaining pin 3261. An exemplary forward retaining pin 3261, which includes at least one hole 3263, is illustrated in FIG. 29. The forward retaining pin 3261 may interface with hole 3112 of the forward bolt 3020, and hole 3112 may be a tight tolerance hole that approximately matches the dimension of the forward retaining pin 3261. The forward retaining pin 3261 may also interface with hole 3031 of the short cam pin 3030 (located in the forward section 3038 of the short cam pin 3030). In some embodiments, the hole 3031 of the short cam pin 3030 is a slotted hole such that the forward retaining pin 3261 can slide in the X-direction to allow the short cam pin 3030 and the forward bolt 3020 to move in the X-direction relative to one another (i.e., to define the deployed configuration and the retracted configuration). In some embodiments, the geometry of the slotted hole 3031 defines the maximum relative motion between the forward bolt 3020 and the short cam pin 3030 and thus the carrier 3050 (i.e., the total distance of gap g). In other embodiments, the firearm operating system 3000 is configured without the forward retaining pin 3261. For example, the forward bolt 3020 may be configured without hole 3112 (see FIG. 23D) and/or the short cam pin 3030 may be configured without hole 3031 (see FIG. 24C). As shown in FIG. 23D, in some embodiments, the forward bolt 3020 does not include a hole for a forward retaining pin but does include at least one protrusion 3106.1 (e.g., left protrusion 3106.1*a* and right protrusion 3106.1*b*) that engages a corresponding feature of the carrier 3050. In particular, as shown in FIG. 25C, the carrier 3050 may include at least one side member 3501*a*, 3501*b* that extends forward such that each side member 3501*a*, 3501*b* includes a protrusion 3502 (e.g., left side member 3501*a* includes left protrusion 3502*a* and right side member 3501*b* includes right protrusion 3502*b*).

In some embodiments, to assemble components of the firearm operating system 3000, the forward bolt 3020 along with the short cam pin 3030 are rotated approximately 90° relative to the carrier 3050. For example, as shown in FIG. 34B, the forward bolt 3020 and the short cam pin 3030 may be rotated approximately 90° such that the lower portion 3108 of the forward bolt 3020 is aligned with the left side of the carrier 3050. This configuration shown in FIG. 34B aligns the left protrusion 3106.1*a* (of the forward bolt 3020) with the top of the carrier 3050 such that the left protrusion 3106.1*a* can pass between the upper edges of the left side member 3501*a* and the right side member 3501*b*. In addition, in the configuration shown in FIG. 34B, the right protrusion 3106.1*b* (of the forward bolt 3020) is aligned with the bottom of the carrier 3050 such that the right protrusion 3106.1*b* can pass between the lower edges of the left side member 3501*a* and the right side member 3501*b*. Once the protrusions 3106.1 are located rearward of the protrusions 3502 (of the carrier 3050), the forward bolt 3020 along with the short cam pin 3030 may be rotated approximately 90° such that hole 3032 of the short cam pin 3030 is aligned with hole 3055 of the carrier 3050 and the rotating cam pin 3271 can be inserted through these aligned holes. It should be noted that the forward bolt 3020 can be rotated 90° in either direction for assembly/disassembly relative to the carrier 3050 (when the rotating cam pin 3271 is uninstalled). The interface between the protrusions 3106.1 (of the forward bolt 3020) and the protrusions 3502 (of the carrier 3050) may dictate the forwardmost position of the forward bolt 3020 relative to the carrier 3050. FIG. 34B illustrates an assembly that includes the forward bolt 3020 shown in FIG. 23D, the short cam pin 3030 shown in FIG. 24C, and the carrier 3050 shown in FIG. 25C.

In FIG. 22, the forward retaining pin 3261 is biased toward the front end of the slotted hole 3031, which dictates that the short cam pin 3030 and the carrier 3050 are located in a rear position relative to the forward bolt 3020 (i.e., increasing the gap g). Rearward movement of the short cam pin 3030 causes the forward surfaces 3036*a*, 3036*b*, and 3036*c* of the short cam pin 3030 to move away from and thus allow the bearings 3023*a*, 3023*b*, and 3023*c* (respectively) to retract and move inward toward the interior of the forward bolt 3020 (as shown in FIG. 22). In some cases, the forward retaining pin 3261 is biased toward the rear end of the slotted hole 3031 (e.g., see the configuration for firearm operating system 2000 in FIG. 4A), which dictates that the short cam pin 3030 and the carrier 3050 are located in a forward position relative to the forward bolt 3020 (i.e., reducing or eliminating the gap g). As discussed in greater detail below, forward movement of the short cam pin 3030 causes the forward surfaces 3036*a*, 3036*b*, and 3036*c* of the short cam pin 3030 to contact and push the bearings 3023*a*, 3023*b*, and 3023*c* (respectively) outward toward the exterior of the forward bolt 3020.

In some embodiments, the forward retaining pin 3261 is cylindrical (e.g., see FIG. 29) such that rotation may occur within hole 3112 and/or hole 3031. In other embodiments, the forward retaining pin 3261 (and/or one or both of the corresponding holes) includes features, such as one or more flat sides to prevent rotation. As shown in FIG. 29, the forward retaining pin 3261 may include an upper slot 3264 and a lower slot 3265 to ensure that the hole 3263 remains aligned with the X-direction such that the firing pin 3080 passes through hole 3263. In particular, the lower slot 3265 may be aligned with hole 3111 of the forward bolt 3020 such that the lower slot 3265 engages the rear protrusion 3403 of the ejector 3021. In other words, if the forward retaining pin 3261 was not properly aligned, the ejector 3021 and the related spring (within cavity 3402 and hole 3111) would not be capable of being installed properly (i.e., the forward retaining pin 3261 would block the rear protrusion 3403 and the spring from seating properly). The upper slot 3264 may act as a visual indicator for proper alignment and/or may be an interface for a flat-head screwdriver for rotating the forward retaining pin 3261.

As shown in FIGS. 20A-22, 31, and 34A, the firearm operating system 3000 may include a rear retaining pin 3262 that engages hole 3056 of the carrier 3050 and hole 3034 of the short cam pin 3030 (in the rear section 3039 of the short cam pin 3030). In some embodiments, the hole 3034 and the hole 3056 are both tight tolerance holes such that relative motion of the short cam pin 3030 and the carrier 3050 is constrained (and/or eliminated) to prevent movement between the short cam pin 3030 and the carrier 3050. The rear retaining pin 3262 may include a first end 3267, a second end 3268, and a notch 3266 that engages the firing pin 3080 (see FIG. 31). The first end 3267 may include a contoured or angled surface to match an outer surface of the carrier 3050 (see FIGS. 20A, 21, and 22). As shown in FIG. 20B, the second end 3268 may be a flat surface that (when the rear retaining pin 3262 is installed) is disposed within a recess or counterbored area of the carrier 3050. In some embodiments, in addition to the rear retaining pin 3262, a location between the short cam pin 3030 and the carrier 3050 may also be defined by an interaction between an internal step 3054 of the carrier 3050 (see FIG. 25B) and a rear face 3037.2 of the short cam pin 3030 (see FIGS. 21A, 21B, 24A, and 24B). The internal step 3054 of the carrier 3050 is optional and may not be included in some embodiments. The carrier 3050 is shown transparent in FIG. 25B for illustrative purposes.

Figure 30A:
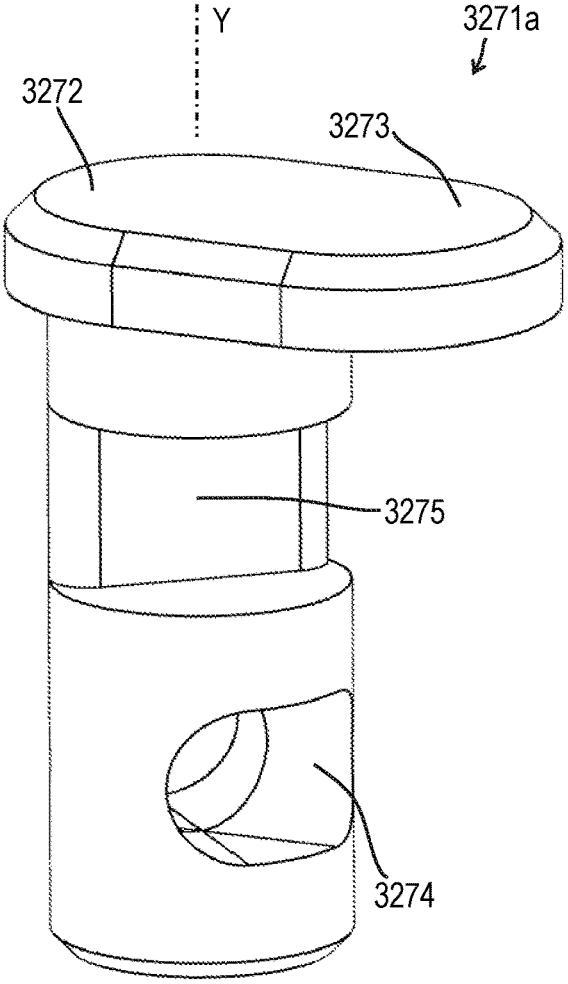
FIG. 30A is a top perspective view of a rotating cam pin of the firearm operating system of FIG. 19.
Figure 30B:
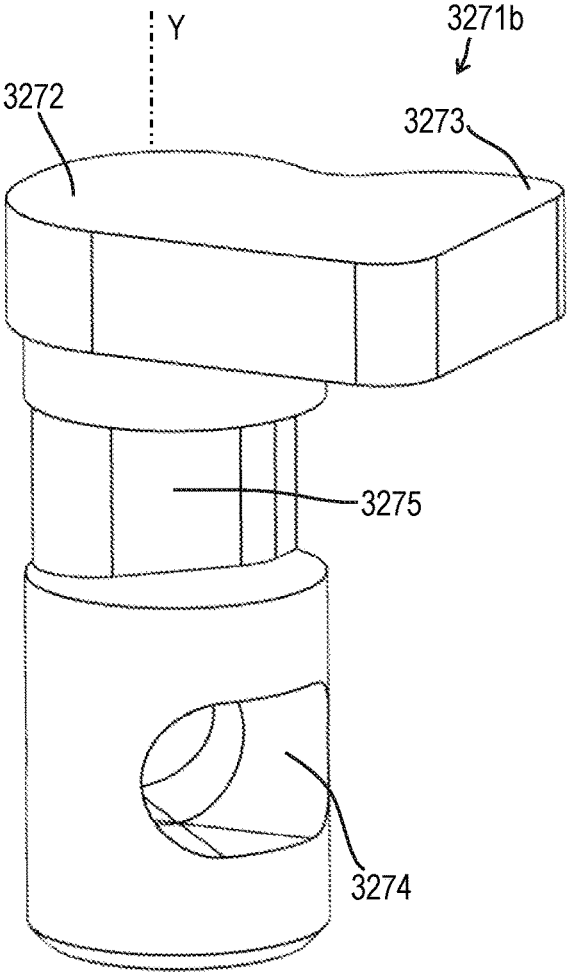
FIG. 30B is a top perspective view of a rotating cam pin of the firearm operating system of FIG. 19.
Figure 36:
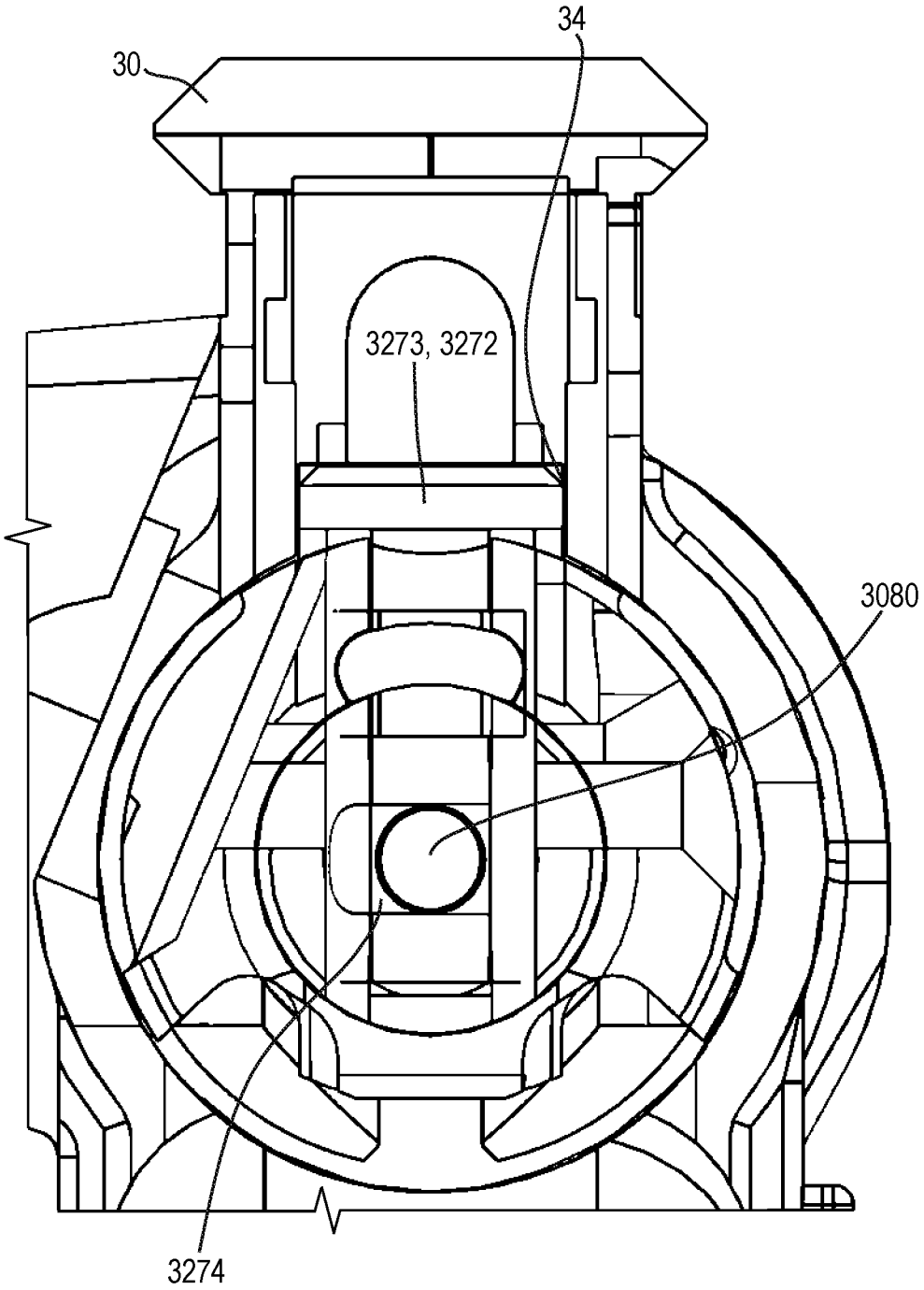
FIG. 36 is a partial cross-sectional view of the firearm operating system of FIG. 19.

The firearm operating system 3000 may also include a rotating cam pin 3271 that engages hole 3055 of the carrier 3050 and hole 3032 of the short cam pin 3030 (in the rear section 3039 of the short cam pin 3030). As shown in FIGS. 30A and 30B, the rotating cam pin 3271 may include a head 3272, at least one hole 3274, an internal recess 3275, and a protrusion 3273 extending from the head 3272. In some embodiments, the rotating cam pin 3271 may be configured to rotate about axis Y, and the configuration of the rotating cam pin 3271 may depend on the location of the firearm operating system 3000 in the X-direction. In some cases, axis Y is concentric with the centers of the hole 3055 and of the hole 3032. As described above, there is minimal movement between the short cam pin 3030 and the carrier 3050 due to rear retaining pin 3262. Movement of the rotating cam pin 3271 is dependent on the inner surface of the upper receiver 30. For example, in some embodiments, the inner surface of the upper receiver 30 includes a recessed area surrounding the head 3272 that corresponds to the location of the rotating cam pin 3271 when the firearm operating system 3000 is in the forwardmost configuration relative to the firearm 1 (in both the retracted configuration and the deployed configuration). To limit rotation of the rotating cam pin 3271, the hole 3274 may include a profile that accommodates the firing pin 3080 (approximately aligned with the X-direction) such that the rotating cam pin 3271 can be positioned in multiple configurations. For example, the rotating cam pin 3271 can be configured as shown in FIG. 21A where the protrusion 3273 is oriented in the forward direction (i.e., parallel to the X-direction). FIG. 21B shows a second configuration where the protrusion 3273 is oriented toward the left side of the firearm 1 due to rotation of the rotating cam pin 3271. The hole 3274 may be formed by: (i) forming an axial hole based on providing clearance for the firing pin 3080 when the rotating cam pin 3271 is in the configuration shown in FIG. 21A, (ii) forming an axial hole based on providing clearance for the firing pin 3080 when the rotating cam pin 3271 is in the configuration shown in FIG. 21B, and (iii) removing the material between the two aforementioned holes to allow the rotating cam pin 3271 to move between these two configurations. In some embodiments, the total rotation of the rotating cam pin 3271 (between the two configurations shown in FIGS. 21A and 21B) is between 30° and 60°. In some embodiments, this total rotation is approximately 45°. As described above in the context of firearm operating system 2000, in some embodiments, the inner surface of the upper receiver 30 includes a recessed area surrounding the head 3272 that corresponds to the location of the rotating cam pin 3271 when the firearm operating system 3000 is in the forwardmost configuration relative to the firearm 1 (in both the retracted configuration and the deployed configuration). During movement of the firearm operating system 3000 within the upper receiver 30, the head 3272 is constrained within a channel 34. In particular, when the firearm operating system 3000 is located rearward of the forwardmost configuration, the rotating cam pin 3271 is prevented from rotating based on an interaction with the upper receiver 30. For example, FIG. 36 shows a cross-section view where the head 3272 is disposed within channel 34 with the protrusion 3273 is oriented in the forward direction (i.e., parallel to the X-direction and similar to FIG. 21A).

Limiting the rotation of the rotating cam pin 3271 such that the protrusion 3273 is oriented in the forward direction (i.e., parallel to the X-direction) causes the internal recess 3275 to be oriented as shown in FIG. 21A. In some embodiments, the internal recess 3275 includes an approximately planar surface and a lateral edge 3275.1 that is moved to a forward position when the protrusion 3273 is oriented in the forward direction. For the configuration shown in FIG. 21A, the lateral edge 3275.1 presses against the rear surface 3041 of the bearing spacer 3040, which causes the forward bolt 3020 to be located in a forward position relative to the short cam pin 3030 and the carrier 3050 (i.e., creating gap g). When the firearm operating system 3000 moves sufficiently far forward (e.g., when the bearing(s) 3023 are located within the barrel extension 3060), the protrusion 3273 is approximately aligned with the recessed area of the upper receiver 30 such that the rotating cam pin 3271 can rotate to the configuration shown in FIG. 21B. The configuration shown in FIG. 21B includes rotation of the rotating cam pin 3271 such that the approximately planar surface of the internal recess 3275 is approximately aligned with (perpendicular to) the X-direction. In other words, the internal recess 3275 acts as a cam surface that interfaces with the rear surface 3041 of the bearing spacer 3040, and the configuration of the rotating cam pin 3271 shown in FIG. 21B allows the forward bolt 3020 to move to a rearward position relative to the short cam pin 3030 and the carrier 3050 (which minimizes gap g and the pushes the bearing(s) 3023 outward). In some embodiments, pressure from a buffer spring (not shown) presses forward on the rear face 3053 of the carrier 3050 and causes the bearing spacer 3040 to press against the internal recess 3275. The force/pressure between the bearing spacer 3040 and the internal recess 3275 causes the rotating cam pin 3271 to rotate toward the configuration shown in FIG. 21B whenever possible (i.e., when the protrusion 3273 is approximately aligned with the recessed area of the upper receiver 30).

Figure 30C:
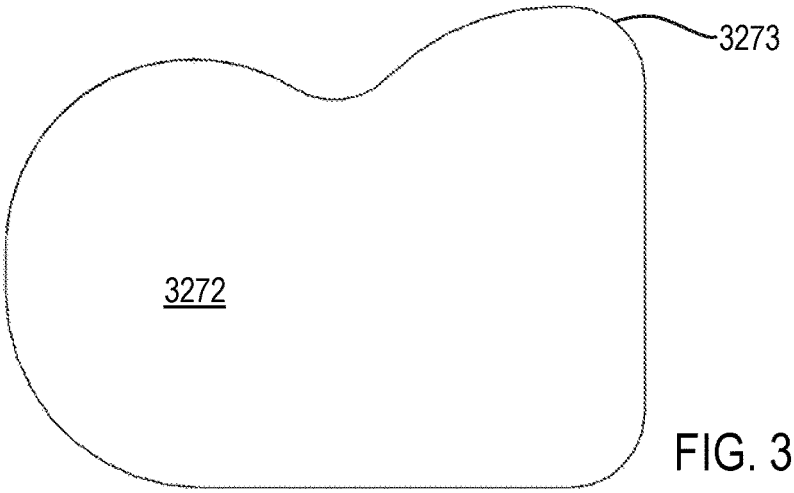
FIG. 30C is a top view of a rotating cam pin of the firearm operating system of FIG. 19.
Figure 31:
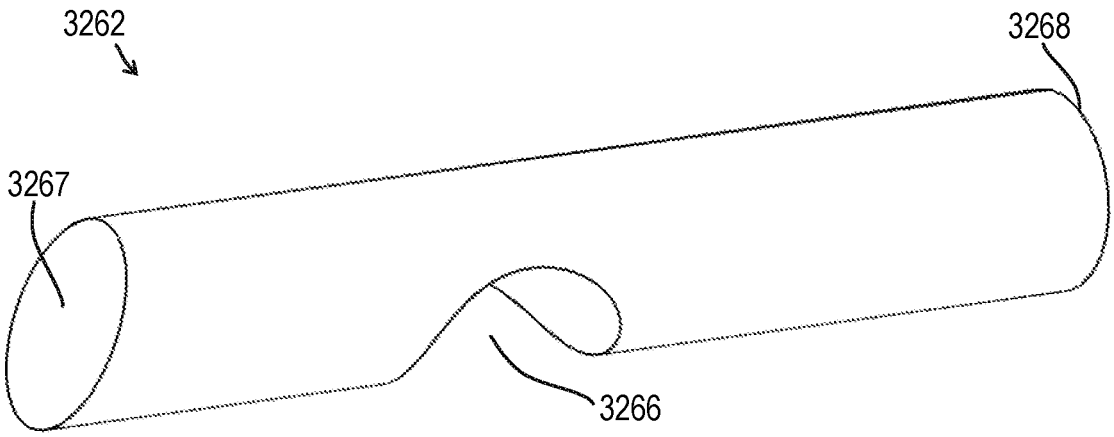
FIG. 31 is a perspective view of a rear retaining pin of the firearm operating system of FIG. 19.
Figure 32:
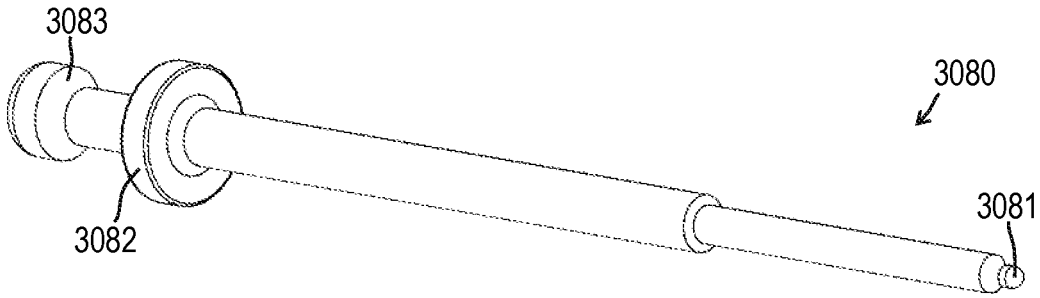
FIG. 32 is a front perspective view of a firing pin of the firearm operating system of FIG. 19.

The rotating cam pin 3271 and the head 3272 may have any appropriate geometric configuration. FIGS. 30A-30C illustrate examples. The rotating cam pin 3271*a* shown in FIG. 30A includes a head 3272 with an oval shape and a rounded protrusion 3273. The rotating cam pin 3271*b* shown in FIGS. 30B and 30C includes a head 3272 with a lateral protrusion 3273. In some cases, the lateral protrusion 3273 of the rotating cam pin 3271*b* interfaces with an internal surface (not an edge) of the recessed area of the upper receiver 30.

When the forward bolt 3020 moves rearward due to either (i) manual operation/movement (e.g., operating the charging handle) or (ii) cycling of the firearm 1 after firing a cartridge, the bearing(s) 3023 are pushed inward due to the interface with the recess(es) 3061 (as discussed below). In addition, the head 3272 exits the recessed area of the upper receiver 30 such that the rotating cam pin 3271 is forced to rotate such that the head 3272 is aligned with the channel 34 and to the configuration shown in FIG. 21A. Accordingly, when the head 3272 is aligned with the channel 34, the forward bolt 3020 is pushed forward and the bearing(s) 3023 can float within the cavities 3024 but cannot be pushed outward.

As described above, the rotating cam pin 3271 interacts with the bearing spacer 3040. As shown in FIGS. 23A and 23B, the bearing spacer 3040 may be a partially annular shape that includes a rear surface 3041, an outer surface 3042, an inner surface 3044, a left end 3043*a*, and a right end 3043*b*. The bearing spacer 3040 may be at least partially disposed within the cavity 3059 of the carrier 3050. In some embodiments, the shape of the cavity 3059 corresponds to the bearing spacer 3040 such that the left end 3043*a* and the right end 3043*b* engage with the outer edges of the cavity 3059 while at least part of the outer surface 3042 slides against the underside of the cavity 3059. In some embodiments, the cavity 3059 is a cylindrical hole (e.g., see FIG. 25C), which corresponds to a cylindrical rod shaped bearing spacer 3040 (e.g., see FIG. 23D).

For the firing pin 3080 to function (i.e., for the forward end 3081 of the firing pin 3080 to contact and cause the cartridge to discharge), the firearm operating system 3000 must be in the deployed configuration (i.e., the short cam pin 3030 must be located in a forward position relative to the forward bolt 3020 and the rotating cam pin 3271 must be rotated to the configuration shown in FIG. 21B). In other words, the forward surfaces 3036*a*, 3036*b*, and 3036*c* of the short cam pin 3030 must be in a forward position, which affects the position of the bearings 3023*a*, 3023*b*, and 3023*c* thus causing these bearings to interface with recesses 3061*a*,

3061*b*, and 3061*c*, respectively, of the barrel extension 3060. In some cases, forward movement of the short cam pin 3030 relative to the forward bolt 3020 is constrained by (i) the bearing spacer 3040 pressing against the internal recess 3275, (ii) the front face 3037.1 of the short cam pin 3030 pressing against the rear face 3107 of the forward bolt 3020, and/or (iii) any other appropriate way. These constraints affect the firing pin 3080 because the flange 3082 of the firing pin 3080 engages at least one of (in some cases both) the rear portion 3302 of the short cam pin 3030 and internal step 3057 of the carrier 3050. Accordingly, a cartridge can only be fired when the firearm operating system 3000 is in the deployed configuration. As described in more detail below, the deployed configuration includes a condition where bearings 3023*a*, 3023*b*, and 3023*c* are engaged within recesses 3061*a*, 3061*b*, and 3061*c*, respectively.

The forward retaining pin 3261, the rear retaining pin 3262, and the rotating cam pin 3271 may be retained within their respective holes because the firing pin 3080 passes through hole 3263 of forward retaining pin 3261, through notch 3266 of rear retaining pin 3262, and through hole 3274 of rotating cam pin 3271 (as described above). Based on this configuration, to remove the forward retaining pin 3261, the rear retaining pin 3262, and/or the vertical cam pin 3271, the firing pin 3080 must first be removed. In addition, the hole 3112 of the forward bolt 3020 may be a blind hole such that the hole is only accessible from above (as shown in the drawings).

In addition, the firearm operating system 3000 allows the firearm 1 to include a barrel 50 without a hole for venting/redirecting gas pressure to the operating system. In other words, another advantage compared to conventional systems is that the barrel 50 of the firearm operating system 3000 is simpler and less likely to corrode or otherwise fail due to additional holes thus increasing longevity.

In some embodiments, the firearm operating system 3000 includes an assembly pin 3131 that is inserted into hole 3058 of the carrier 3050 (see FIGS. 20A-22 and 34A). When the assembly pin 3131 is inserted into hole 3058, the assembly pin 3131 may be at least partially disposed within cavity 3051 of the carrier 3050 such that the assembly pin 3131 interacts with the firing pin 3080. In particular, the assembly pin 3131 is disposed between the rear end 3083 and the flange 3082 of the firing pin 3080 such that the firing pin 3080 cannot be removed from the cavity 3033 of the short cam pin 3030 while the assembly pin 3131 is installed.

Figure 20A:
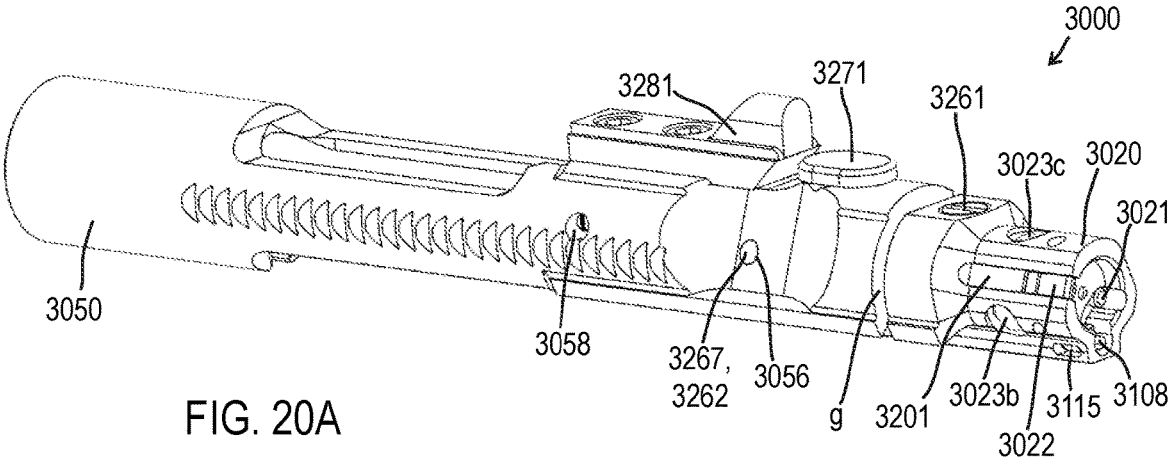
FIG. 20A is a right side perspective view of the firearm operating system of FIG. 19.
Figure 20B:
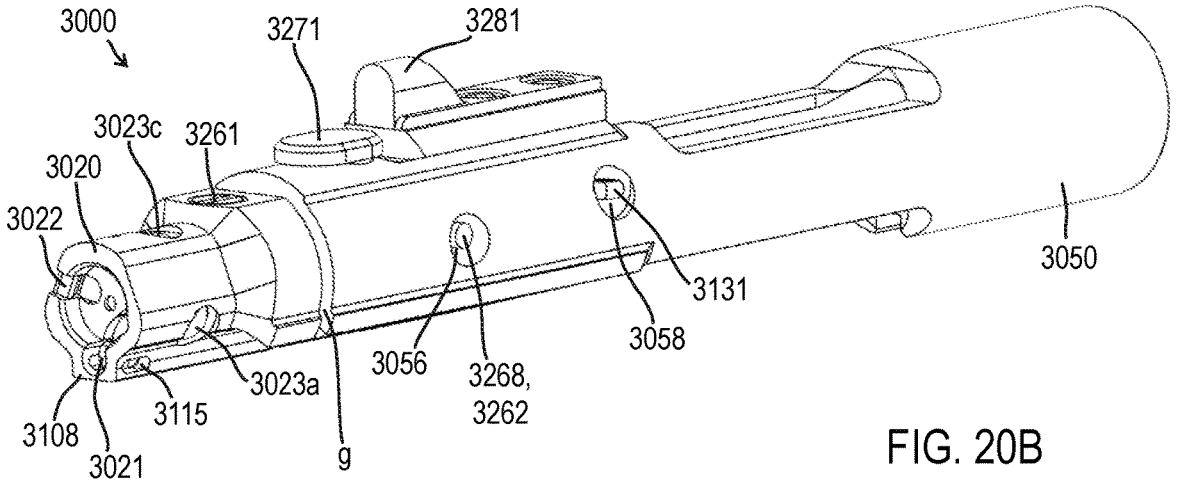
FIG. 20B is a left side perspective view of the firearm operating system of FIG. 19.

The forward bolt 3020 includes a forward face 3103, a rear face 3107, a lower portion 3108, a rear cavity 3029, an ejector hole 3101, an extractor cavity 3102, at least one bearing cavity 3024, and a forward cavity 3028, (see FIGS. 23A-23C). In some embodiments, the at least one bearing cavity 3024 includes a first bearing cavity 3024*a*, a second bearing cavity 3024*b*, and a third bearing cavity 3024*c*. As shown in FIGS. 20A, 20B, and 22, the forward bolt 3020 may interface with an ejector 3021, an extractor 3022, and at least one bearing 3023. In some embodiments, the at least one bearing 3023 includes a first bearing 3023*a*, a second bearing 3023*b*, and a third bearing 3023*c*. Although the bearings 3023 are illustrated as spherical (ball) bearings, the bearings 3023 may have any configuration, including, for example, cylindrical, tapered, needle, toroidal, annular, etc. In some cases, the first bearing 3023*a* is disposed in the first bearing cavity 3024*a*, the second bearing 3023*b* is disposed in the second bearing cavity 3024*b*, and the third bearing 3023*c* is disposed in the third bearing cavity 3024*c*. The bearings may be retained within their respective cavities. For example, each cavity 3024 may include a retaining portion 3025 that prevents the bearing 3023 from passing entirely through the cavity 3024 (i.e., where the bearing 3023 can partially protrude but cannot move entirely through the cavity 3024). The first bearing cavity 3024*a* may include a first retaining portion 3025*a*, the second bearing cavity 3024*b* may include a second retaining portion 3025*b*, and the third bearing cavity 3024*c* may include a third retaining portion 3025*c*. As one example, each retaining portion 3025 may include a machined profile near the outer edge where the dimension (e.g., diameter) of the cavity 3024 decreases when nearing the outer portion of the cavity 3024. The retaining portion 3025 may be an integral feature (e.g., a machined feature as described above, a welded feature, etc.) or may be an additional component added to the forward bolt 3020.

Figure 35A:
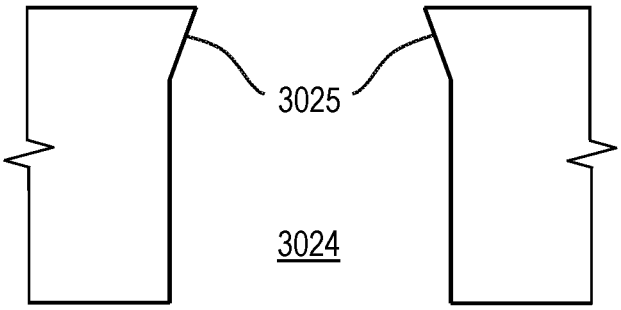
FIG. 35A is a schematic section view of a bearing cavity of the firearm operating system of FIG. 19.
Figure 35B:
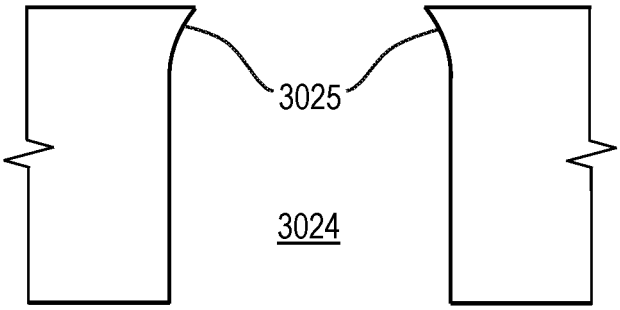
FIG. 35B is a schematic section view of a bearing cavity of the firearm operating system of FIG. 19.

FIGS. 35A and 35B each show schematic cross-section examples of a cavity 3024 that includes a retaining portion 3025. As shown in FIG. 35A, in some embodiments, the retaining portion 3025 is a tapered surface that reduces the size of the cavity 3024 linearly. For examples where the cavity 3024 has a circular cross-section, retaining portion 3025 is a tapered surface that reduces the diameter of the cavity 3024 and results in a conical profile. If the bearing 3023 is a spherical bearing (i.e., the illustrated embodiment for bearings 3023), the engagement between the retaining portion 3025 and the bearing 3023 may be formed as a curve (e.g., a circle). FIG. 35B shows embodiments where the retaining portion 3025 is a tapered surface that reduces the size of the cavity 3024 non-linearly. For examples where the cavity 3024 has a circular cross-section, retaining portion 3025 is a curved surface that reduces the diameter of the cavity 3024. In some examples, the interior of the retaining portion 3025 results in a spherical profile. If the bearing 3023 is a spherical bearing (i.e., the illustrated embodiment for bearings 3023), the engagement between the retaining portion 3025 and the bearing 3023 may be formed as a surface and/or a series of curves/circles.

Based on the configuration of the cavities 3024 and the retaining portions 3025, the bearings 3023 cannot exit outward through the cavities 3024. In some embodiments, the only option for removing the bearings 3023 is to disassemble the forward bolt 3020 and the short cam pin 3030 (which would require removing the firing pin 3080 and the forward retaining pin 3261). The bearings 3023 could then be removed through rear cavity 3029.

In some embodiments, the three bearings 3023 are evenly distributed around the surface of the forward bolt 3020 (i.e., approximately 120° apart from one another). In other cases, the bearings 3023 are not equally distributed in order to avoid features of the forward bolt 3020 (e.g., the ejector 3021, the extractor 3022, etc.). As one example, the first bearing 3023*a* is located at the 4 o'clock position when viewing the forward face 3103 of the forward bolt 3020 while the second bearing 3023*b* is located at the 8 o'clock position and the third bearing 3023*c* is located at the 12 o'clock position. Such an arrangement avoids the lower portion 3108 and the extractor cavity 3102 of the forward bolt 3020. In some cases, the overall shape of the forward bolt 3020 includes a forward portion 3104 and a rear portion 3106. The forward portion 3104 includes non-circular profile with at least one flat lateral portion connected by a curved upper portion and an approximately rectangular lower portion 3108. The rear portion 3106 may be approximately cylindrical with a horizontal planar top portion.

When the forward bolt 3020 moves forward over the top of a magazine, the lower portion 3108 pushes the uppermost cartridge out of the magazine and toward the chamber of the firearm 1. In some embodiments, as shown in FIG. 23D, the forward bolt 3020 may include a gap 3108.1 in the lower portion 3108, which allows excess gas and carbon to escape from the forward cavity 3028. When the cartridge is in the chamber in a firing position, the cartridge is approximately aligned with a center of the forward face 3103 of the forward bolt 3020 such that the central hole 3027 of the forward bolt 3020 is aligned with the primer of the cartridge (to align the firing pin 3080 with the cartridge). When the cartridge is in the firing position, forward motion of a forward end 3081 of the firing pin 3080 (e.g., caused by a hammer interacting with the rear end 3083 of the firing pin 3080) causes the cartridge to discharge.

Figure 26A:
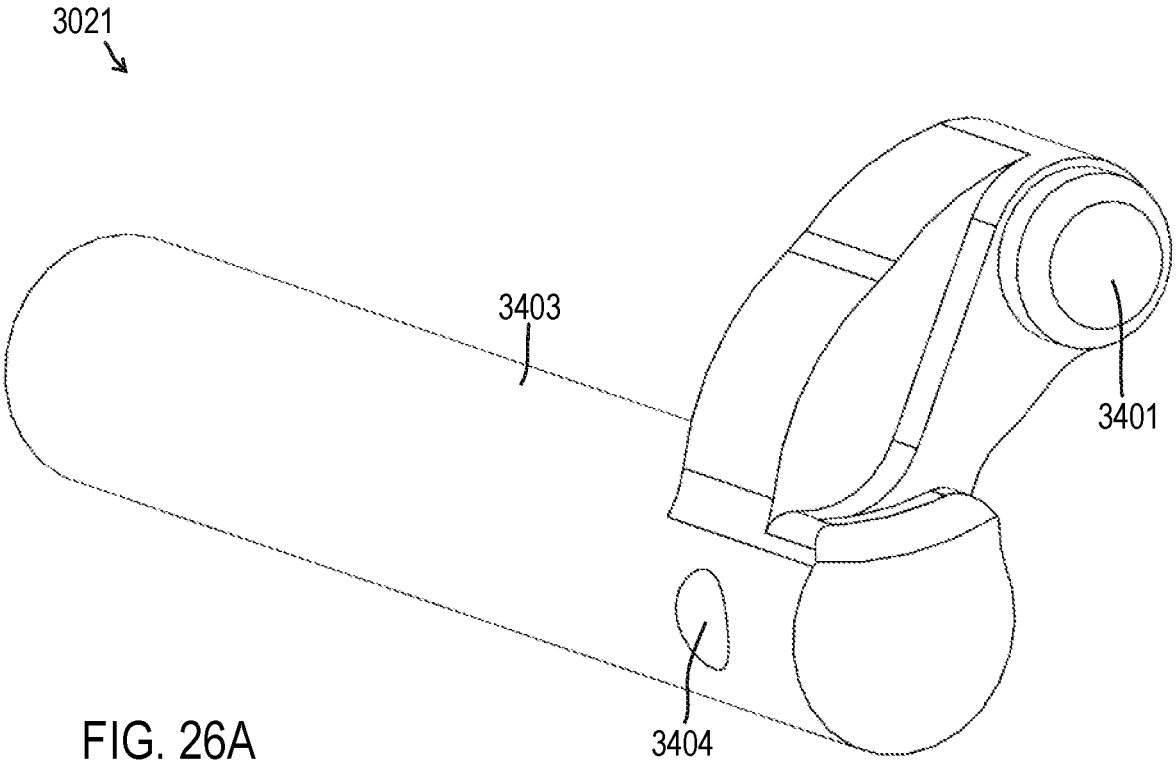
FIG. 26A is a front top perspective view of an ejector of the firearm operating system of FIG. 19.
Figure 26B:
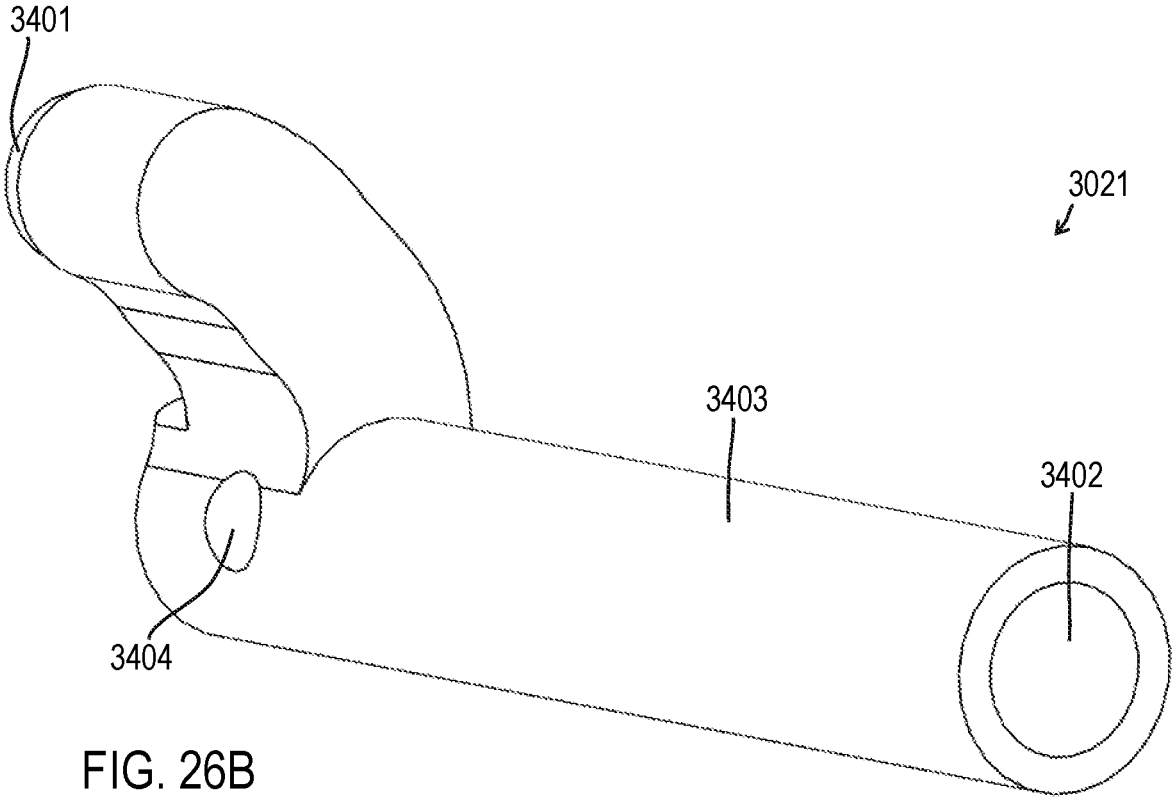
FIG. 26B is a rear top perspective view of the ejector of FIG. 26A.
Figure 55A:
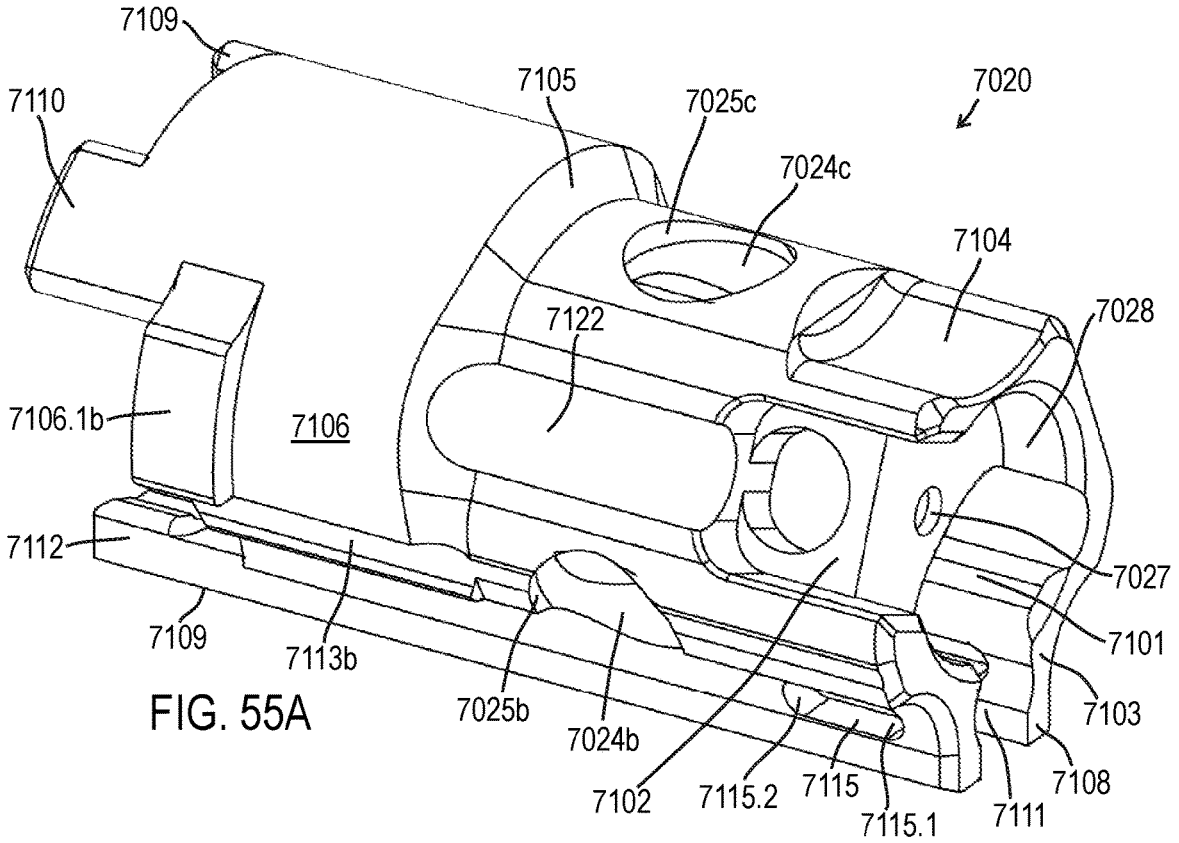
FIG. 55A is a front right side perspective view of a forward bolt of the firearm operating system of FIG. 51.
Figure 55B:
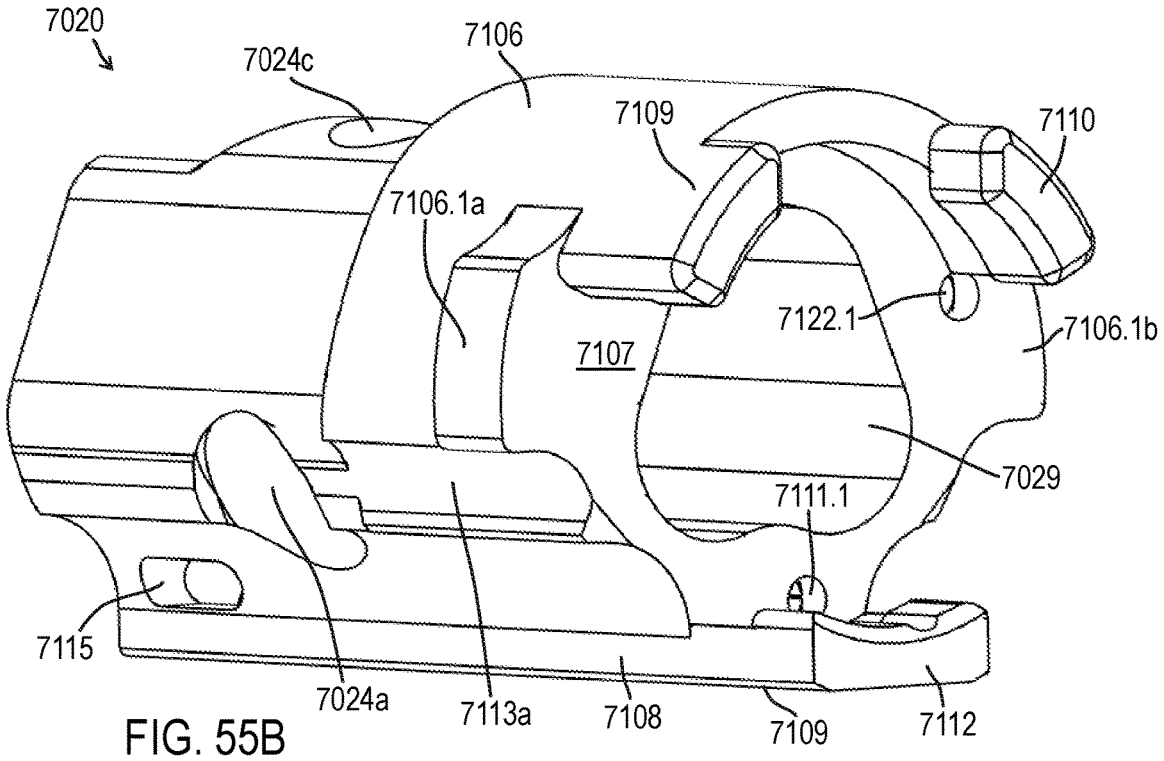
FIG. 55B is a rear left side perspective view of the forward bolt of FIG. 55A.
Figure 56A:
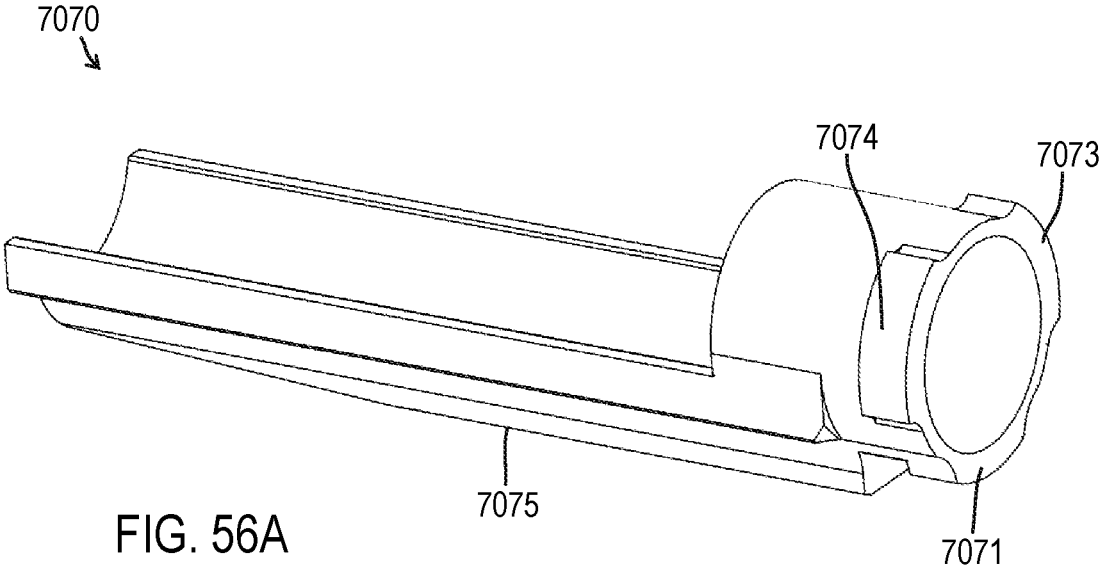
FIG. 56A is a front right side perspective view of a bolt extension of the firearm operating system of FIG. 51.
Figure 56B:
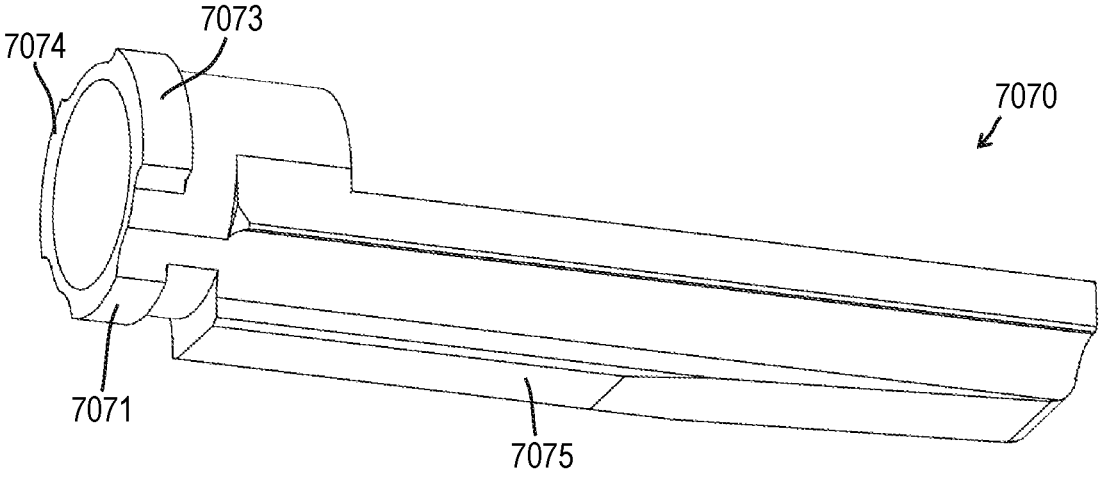
FIG. 56B is a bottom left side perspective view of the bolt extension of FIG. 56A.

The ejector 3021 interfaces with the ejector hole 3101 of the forward bolt 3020. As shown in FIGS. 26A and 26B, in some embodiments, the ejector 3021 includes a forward interface 3401, a rear protrusion 3403, and a hole 3404. The forward interface 3401 may protrude forward relative to the other portions of the ejector 3021 such that the forward interface 3401 is the only portion of the ejector 3021 that contacts a cartridge disposed adjacent to a forward side of the forward bolt 3020. In some embodiments, the forward interface 3401 is disposed approximately 180° from the extractor 3022. However, based on the arrangement of the bearings 3023 described above, extending the ejector 3021 directly rearward from the forward interface 3401 would interfere with first bearing cavity 3024*a*. Accordingly, the ejector 3021 may be designed such that the rear protrusion 3403 extends rearward at the 6 o'clock position when viewing the forward face 3103 of the forward bolt 3020. To install the ejector 3021 into the forward bolt 3020, a spring is inserted into cavity 3402 such that the opposite end of the spring will bottom out in hole 3111, which will compress when the ejector 3021 is pushed rearward (see FIG. 23C). After inserting the ejector 3021 into the ejector hole 3101, the ejector 3021 is adjusted such that the hole 3404 is aligned with a portion of hole 3115 (between forward end 3115.1 and rear end 3115.2) of the forward bolt 3020 and a pin 3117 is then inserted into hole 3115 and hole 3404 (see FIG. 22). The pin 3117 may be a roll pin, a solid pin, or any other appropriate configuration used to retain the ejector 3021. The ejector spring is compressed within hole 3111 when the ejector 3021 is pushed rearward. For example, when a rim of a cartridge is retained by extractor 3022, the rear surface of the cartridge presses the ejector 3021 rearward such that the forward interface 3401 is approximately flush with a rear wall or floor of the forward cavity 3028. In some embodiments, when the forward interface 3401 is approximately flush with the rear wall of the forward cavity 3028, the rear end 3115.2 of hole 3115 is adjacent to or in contact with pin 3117. When the forward bolt 3020 moves rearward due to either (i) manual operation/movement (e.g., operating the charging handle) or (ii) cycling of the firearm 1 after firing a cartridge, the spring in hole 3111 pushes the ejector 3021 forward such that once the forward face 3103 reaches the ejection port 31 of the upper receiver 30, the ejector 3021 pushes the rear surface of a cartridge (or an empty shell of a cartridge if a round was fired) causing the cartridge/shell to pivot about the extractor 3022 and exit the firearm 1. The forward bolt 3020 may be configured with a smaller hole that extends through hole 3111 to the rear face 3107 of the forward bolt 3020 which allows the operator to push the ejector spring out of the hole 3111 from the rear (e.g., see hole 7111.1 in FIG. 55B).

Figure 27A:
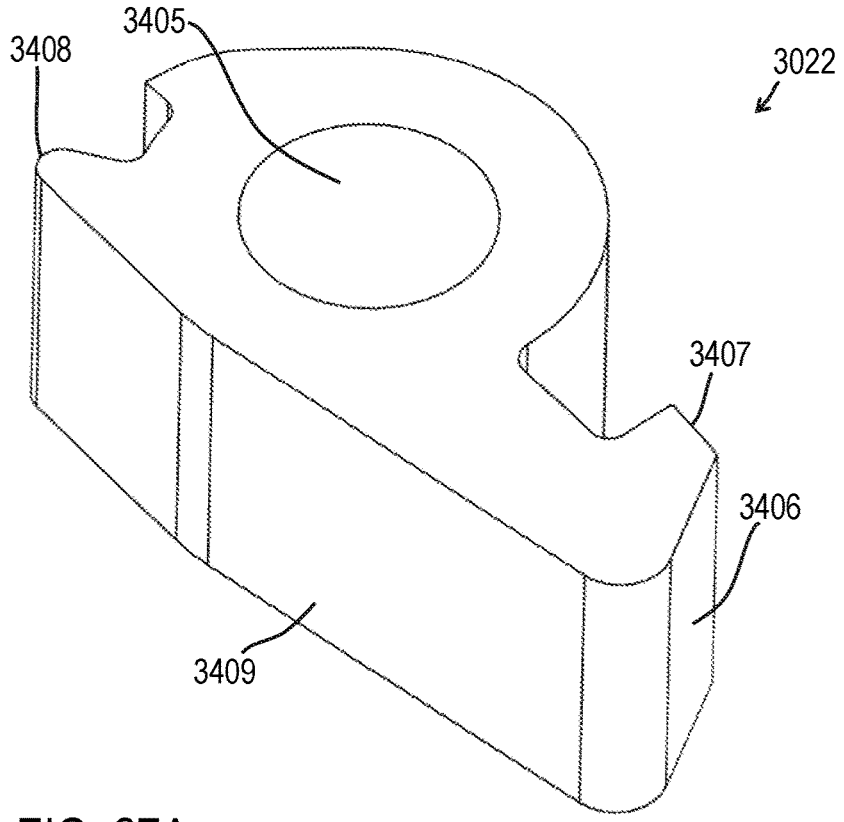
FIG. 27A is a perspective view of an extractor of the firearm operating system of FIG. 19.
Figure 27B:
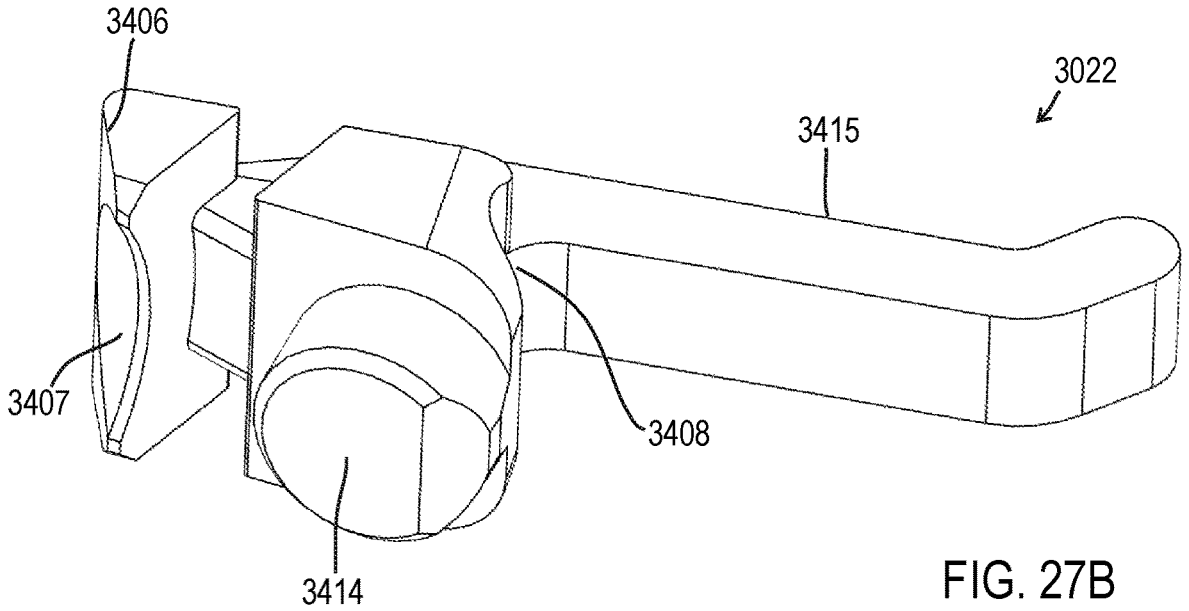
FIG. 27B is a perspective view of an extractor of the firearm operating system of FIG. 19.

The extractor 3022 may be located within the extractor cavity 3102 of the forward bolt 3020 such that the extractor 3022 can move based on the geometry of the cavity 3102 and an interface with an extractor plunger 3201 inserted into extractor spring cavity 3122. As shown in FIG. 27A, the extractor 3022 may include a hole 3405, a front surface 3406, a hook member 3407, and a rear member 3408. In some embodiments, the extractor 3022 rotates about hole 3405 and lip 3407 engages the rim of a cartridge or empty shell. The extractor 3022 may be arranged such that the hole 3405 is aligned and/or coaxial with hole 3114 of the forward bolt 3020 (see FIGS. 23A, 23C, and 23D). After inserting the extractor 3022 into the extractor cavity 3102, the extractor 3022 is adjusted such that hole 3405 is aligned with hole 3114 of the forward bolt 3020 and a pin 3118 is then inserted through hole 3114 and into hole 3405 (see FIG. 22). The pin 3118 may be a roll pin, a solid pin, or any other appropriate configuration used to retain the extractor 3022. In some embodiments, as shown in FIG. 27B, the extractor 3022 includes a protrusion 3414 that locates and defines movement of the extractor 3022 relative to the forward bolt 3020 (in coordination with the extractor plunger 3201 as described below). The protrusion 3414 may engage a corresponding recess within the extractor cavity 3102 (e.g., see cylindrical recess within extractor cavity 7102 in FIGS. 54 and 55A). In other words, as shown in FIGS. 23D and 27B, the extractor 3022 may be designed without hole 3405 (eliminating the need for pin 3118 and hole 3114 of the forward bolt 3020). The hook member 3407 of extractor 3022 may be configured to engage a cannelure and/or a rim of the cartridge such that the extractor 3022 guides the cartridge (or the empty shell of a cartridge if a round was fired) in the direction of the ejection port 31 of the upper receiver 30 using the force provided by the ejector 3021. The extractor 3022 may include an outer protrusion 3415 (see FIG. 27B) and/or a continuous or flat outer surface 3409 (see FIG. 27A).

Figure 28:
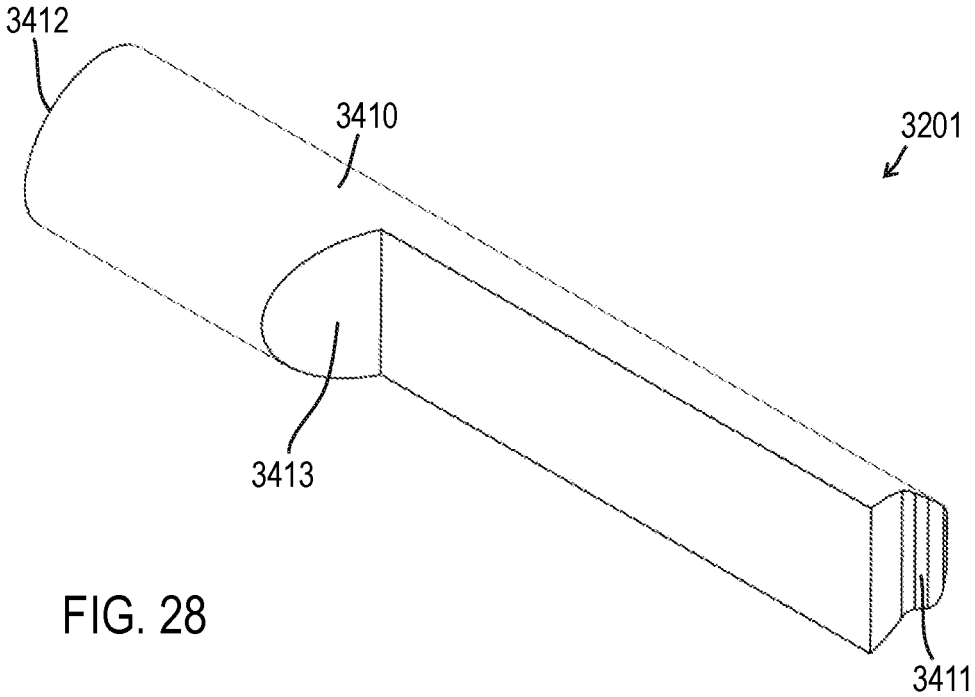
FIG. 28 is a front perspective view of an extractor plunger of the firearm operating system of FIG. 19.

In some embodiments, rotation of the extractor 3022 depends on an interface with the extractor plunger 3201 (see FIG. 28). The extractor plunger 3201 may include a rear portion 3410, a front portion 3411, a rear surface 3412, and a surface 3413. In some cases, the rear portion 3410 may be cylindrical and the front portion 3411 may include a blade shape having a flat portion and/or a rectangular cross section. A coil spring may be inserted into hole 3122. The extractor plunger 3201 is then inserted into hole 3122 of the forward bolt 3020 and the spring is compressed against the rear surface 3412 such that the surface 3413 is approximately aligned and/or continuous with profile surface 3105 of the forward bolt 3020. In some embodiments, the front portion 3411 presses against the rear member 3408 of the extractor 3022 to bias the extractor 3022 toward engagement with a cartridge. The forward bolt 3020 may be configured with a smaller hole that extends through hole 3122 to the rear face 3107 of the forward bolt 3020 which allows the operator to push the extractor spring out of the hole 3122 from the rear (e.g., see hole 7122.1 in FIG. 55B).

Manual operation/cycling of the firearm operating system 3000 may include rearward movement of the charging handle where the charging handle engages a portion of the firearm operating system 3000. For example, in some embodiments, the charging handle engages the forward face 3052 of the carrier 3050. In other embodiments, the charging handle engages a gas key 3281. The gas key 3281 may include a cylindrical protrusion with an open cavity (e.g., see FIG. 4A). In other cases, the gas key 3281 has a shorter overall length without any cylindrical protrusion, as shown in FIGS. 20A and 20B.

As described above, the firearm operating system 3000 may include at least one bearing 3023. In some embodiments, each bearing 3023 has a diameter of approximately 0.1" (0.25 cm) to approximately 0.4" (1.02 cm). In other cases, each bearing 3023 has a diameter of approximately 0.2" (0.51 cm) to approximately 0.3" (0.76 cm). In other cases, each bearing has a diameter of approximately 0.25" (0.635 cm).

The bearings 3023 may interface with other components of the firearm operating system 3000. For example, the bearings 3023*a*, 3023*b*, and 3023*c* may each have an internal configuration (see FIG. 22) where a surface of each bearing 3023 is approximately flush with a respective surface of the forward bolt 3020. For example, in the internal configuration, a portion of the surface of the first bearing 3023*a* is approximately flush with the left side surface of the forward bolt 3020. Similarly, a portion of the outer surface of the second bearing 3023*b* is approximately flush with the right side surface of the forward bolt 3020 and a portion of the outer surface of the third bearing 3023*c* is approximately flush with the upper surface of the forward bolt 3020. The bearings 3023*a*, 3023*b*, and 3023*c* may be capable of moving outward to an extended configuration where the bearings 3023*a*, 3023*b*, and 3023*c* move outward relative to their respective cavity 3024 such that at least a portion of each of the bearings 3023*a*, 3023*b*, and 3023*c* extend beyond the respective surfaces of the forward bolt 3020. For example, in the extended configuration, a portion of the surface of the first bearing 3023*a* protrudes beyond the left side surface of the forward bolt 3020, a portion of the surface of the second bearing 3023*b* protrudes beyond the right side surface of the forward bolt 3020, and a portion of the surface of the third bearing 3023*c* protrudes beyond the upper surface of the forward bolt 3020. In some embodiments, the bearings 3023*a*, 3023*b*, and 3023*c* may interface with (i) the short cam pin 3030 (internal to the forward bolt 3020) and/or (ii) the barrel extension 3060 (external to the forward bolt 3020).

When the firearm operating system 3000 is in the forwardmost configuration relative to the firearm 1, the bearings 3023 interface with both the short cam pin 3030 and the barrel extension 3060. There is forward pressure on the rear portion 3053 of the carrier 3050 (e.g., due to forward momentum of the components of firearm operating system 3000 and/or pressure from a buffer spring, which is not shown), which consequently pushes the short cam pin 3030 in the forward direction. The forward end 3301 of the short cam pin 3030 may include a tapered or narrowed portion. In some embodiments, the forward end 3301 includes a shape that is symmetric (about a plane perpendicular to the lateral direction) and/or includes portions with a conical profile that narrows toward the front. Forward pressure on the short cam pin 3030 causes the forward surfaces 3036*a*, 3036*b*, and 3036*c* to push the bearings 3023*a*, 3023*b*, and 3023*c* outward (respectively). Outward pressure on the bearings 3023*a*, 3023*b*, and 3023*c* causes each bearing to engage the relevant recess 3061 of the barrel extension 3060. Specifically, outward pressure from forward surface 3036*a* pushes bearing 3023*a* into recess 3061*a*, outward pressure from forward surface 3036*b* pushes bearing 3023*b* into recess 3061*b*, and outward pressure from forward surface 3036*c* pushes bearing 3023*c* into recess 3061*c*. Accordingly, when the firearm operating system 3000 is in the deployed configuration and located in a forward position, the bearing(s) 3023 engage the barrel extension 3060 to lock the firearm operating system 3000 in a condition ready to fire (i.e., in battery). In some embodiments, when the firearm operating system 3000 is in battery, the profile surface 3105 of the forward bolt 3020 is approximately in contact with the rear ramp surface 3062 of the barrel extension 3060. In other words, when the bearings 3023 engage the recesses 3061, these two surfaces (profile surface 3105 and rear ramp surface 3062) may be approximately line to line. The two surfaces (profile surface 3105 and rear ramp surface 3062) may be parallel to one another. When the firearm operating system 3000 is in battery, the lower portion 3108 of the forward bolt 3020 may be disposed in the corresponding recess 3063 of the barrel extension.

After a cartridge is fired, the mechanisms described above cause a delay before the bolt assembly (the forward bolt 3020, the carrier 3050 and other related components) can move rearward away from the chamber. In particular, the bearings 3023*a*, 3023*b*, and 3023*c* press against the curved/tapered surface on the rear side of the recesses 3061*a*, 3061*b*, and 3061*c*, respectively, of the barrel extension 3060. In other words, bearing 3023*a* presses against the surface of recess 3061*a*, bearing 3023*b* presses against the surface of recess 3061*b*, and bearing 3023*c* presses against the surface of recess 3061*c* (see FIGS. 33A-33C). Each of the recesses 3061 tapers to a smaller diameter when moving rearward. The rearward taper of these surfaces of the recesses 3061 may be linear and/or may be curved. The interaction between these recesses 3061 of the barrel extension 3060 and the bearings 3023 presses the bearings 3023 inward (toward the interior of the forward bolt 3020) while other portions of the bearings 3023 press against the forward surfaces 3036 of the short cam pin 3030 (see FIGS. 21A, 21B, 24A, and 24B). In some cases, the surface geometry of (i) the recesses 3061, (ii) the bearings 3023, and/or (iii) the forward surfaces 3036 may be designed to determine the distance, time, rate, force, etc. of the movement of the bearings 3023 after the cartridge has been fired. For example, the geometry of the recesses 3061 and/or the forward surfaces 3036 may be changed to increase/decrease cycling rate, adapt for different ammunition (e.g., caliber, bullet weight, powder charge, etc.), optimize for suppressed/unsuppressed, or any other appropriate purpose. Although the recesses 3061 are illustrated as being oriented in the radial direction (perpendicular to the outer surface of the forward bolt 3020 and intersecting a center), the recesses 3061 may be oriented in any other appropriate direction.

In some embodiments, the firearm operating system 3000 can be tuned by replacing the short cam pin 3030. Each short cam pin 3030 includes a geometric relationship between the forward surfaces 3036 and the axial direction (i.e., the axis through the center of the firing pin 3080 that is aligned with cavity 3033 and hole 3027). To tune the firearm operating system 3000, an operator may replace the short cam pin 3030 to change the geometric relationship between the bearings 3023 and the short cam pin 3030. Different short cam pins 3030 can be used to account for changes in caliber, bullet weight, powder charge, barrel length, etc. or may be designed to optimize for suppressed/unsuppressed, to increase/decrease cycling rate, or any other appropriate purpose. In some cases, different short cam pins 3030 have a different angle between the centerline of each forward surface 3036 and the axial direction (e.g., where the line segment 3036*c*.1 is linear as shown in FIG. 24D). In other cases, different short cam pins 3030 have a more complex geometric relationship with the axial direction which may include a circular arc, a non-circular arc, a polynomial relationship, an average angle, and/or any other appropriate relationship (e.g., including, but not limited to, the curved line segment 3036*c*.1 shown in FIG. 24E). The operator may also replace the barrel extension 3060 to vary the geometric relationship between the recesses 3061 and the bearings 3023.

Accordingly, after sufficient force is applied to the forward surfaces 3036*a*, 3036*b*, and 3036*c*, the short cam pin 3030 moves rearward relative to the forward bolt 3020 due to the force applied between the recesses 3061 of the barrel extension 3060 and the bearings 3023, which causes the firearm operating system 3000 to move from the deployed configuration (where gap g is small or minimal and the bearings 3023 at least partially protrude from the forward bolt 3020) to the retracted configuration (where gap g is larger and the bearings 3023 are retracted relative to the forward bolt 3020). Once the bearings 3023 have moved inward a sufficient distance to allow clearance through the barrel extension 3060, the delay is over and the bolt assembly moves rearward into the upper receiver 30. As described above, the subsequent cycling includes extracting/ejecting a cartridge or empty shell, compressing a buffer spring (not shown), pushing the upper-most cartridge out of the magazine and toward the chamber of the firearm 1, etc.

In some embodiments, the barrel extension 3060 includes a plurality of flat portions on an outer surface thereof to facilitate an interface with a tool, such as a wrench. The barrel extension 3060 may be removably attached to the barrel 50 while in other embodiments, the barrel extension 3060 is integral or permanently attached to the barrel 50. For embodiments where the barrel extension 3060 is removably attached to the barrel 50, the barrel extension 3060 may be threaded onto the barrel 50, press-fit on the barrel 50, pinned to the barrel 50, and/or attached in any other appropriate way. Removable attachment of the barrel extension 3060 allows a barrel extension 3060 to be replaced if/when wear occurs to one or more of the recesses 3061.

Figure 24A:
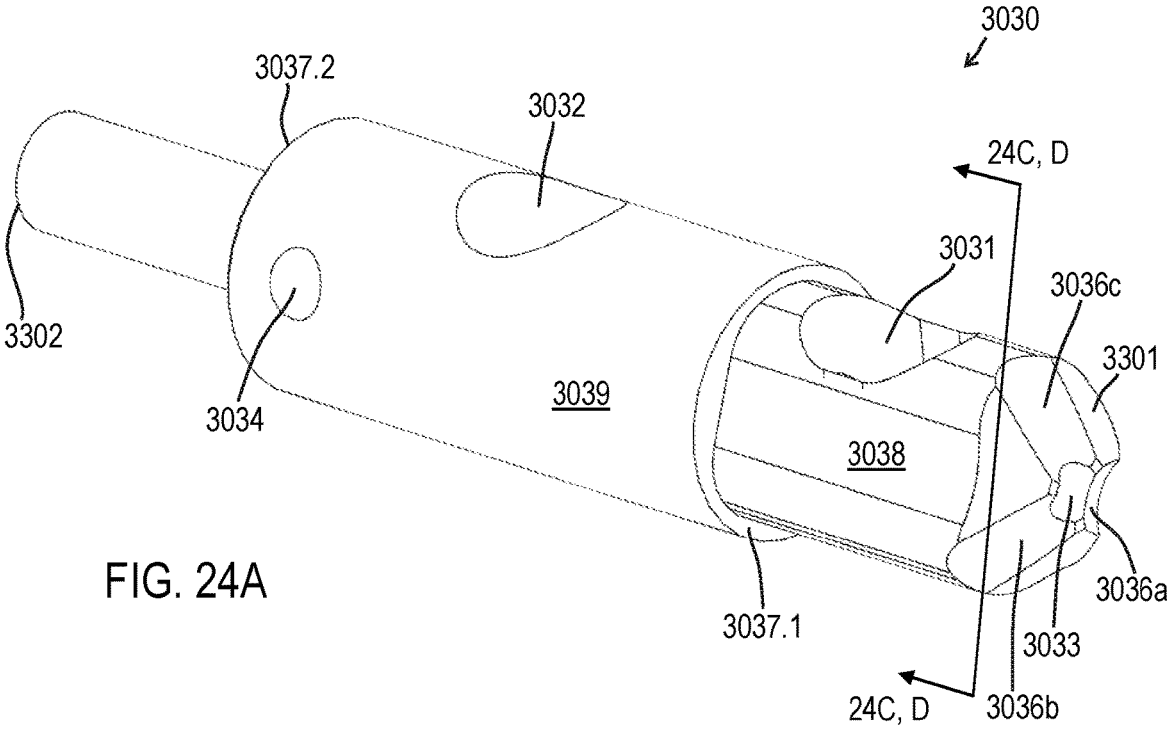
FIG. 24A is a front right side perspective view of a short cam pin of the firearm operating system of FIG. 19.
Figure 24B:
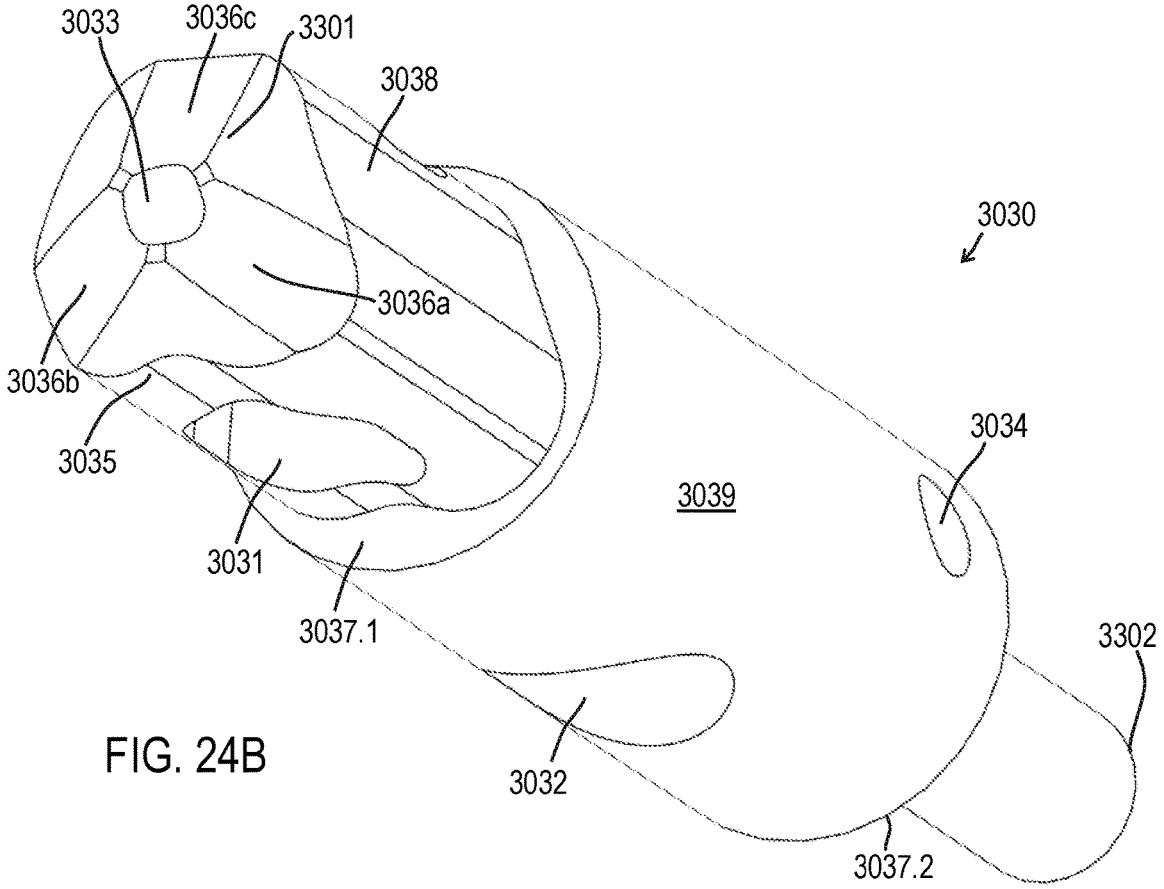
FIG. 24B is a bottom left side perspective view of the short cam pin of FIG. 24A.
Figure 24C:
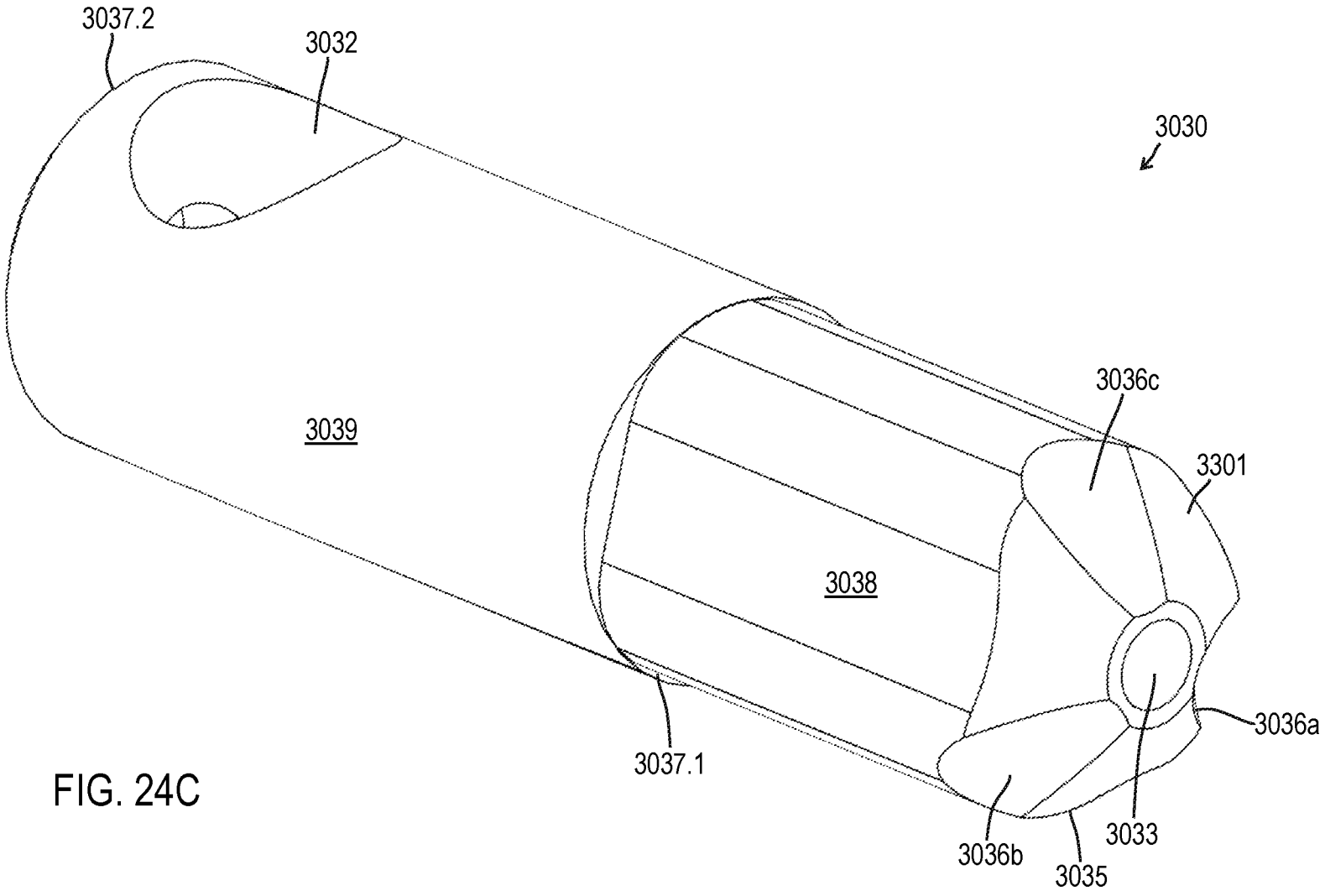
FIG. 24C is a front right side perspective view of a short cam pin of the firearm operating system of FIG. 19.
Figure 24D:
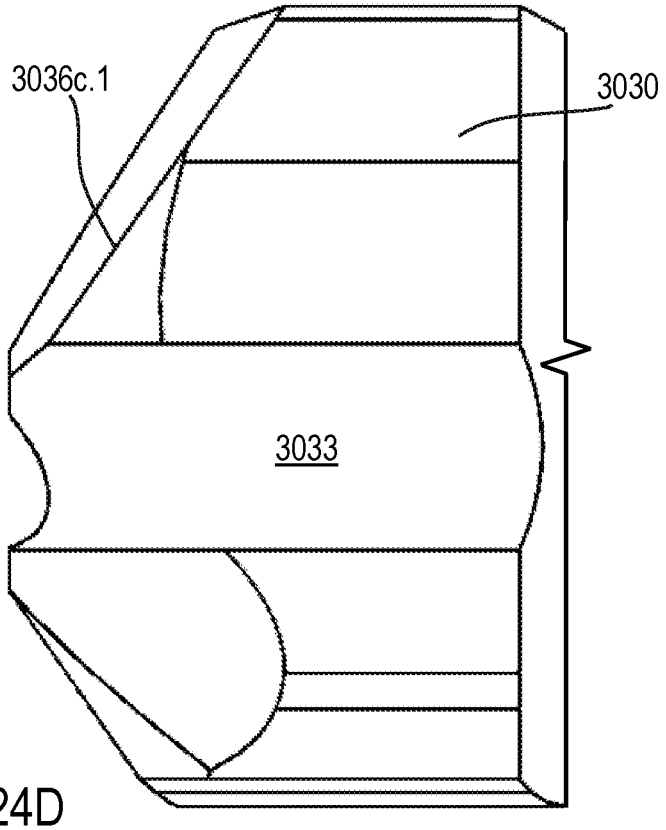
FIG. 24D is a partial cross-sectional view of the short cam pin of FIG. 24A or FIG. 24C.
Figure 24E:
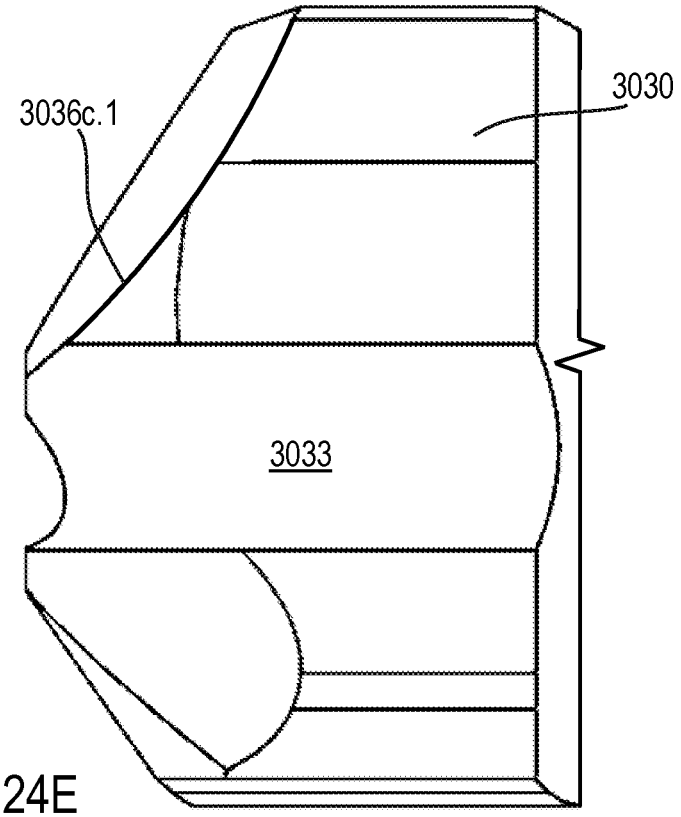
FIG. 24E is a partial cross-sectional view of the short cam pin of FIG. 24A or FIG. 24C.

As shown in FIGS. 24A and 24B, the forward surfaces 3036*a*, 3036*b*, and 3036*c* of the short cam pin 3030 may include concave surfaces. To promote continuous contact with the surface of the bearings 3023, each of the forward surfaces 3036 may include a curved surface that approximately matches the shape of the bearing 3023. For example, if one of the bearings 3023 is spherical, the corresponding forward surface 3036 may be concave with a partially cylindrical shape (i.e., a partially circular cross section) to interface with the bearing 3023. In some cases, the corresponding forward surface 3036 may be concave with a partially conical shape (i.e., a partially circular cross section) to interface with the bearing 3023. In other embodiments, the corresponding forward surface 3036 may have other shapes including, for example, a planar shape, a curved surface with a partially elliptical shape, a partially oval shape, or any other appropriate shape. The dimensions of the corresponding forward surface 3036 may be similar to the bearing 3023 (e.g., similar diameter) or, in some cases, may be larger than the bearing 3023 to ensure the bearing 3023 remains in contact with the forward surface 3036. The forward surfaces 3036 may extend linearly from the forward end 3301 of the short cam pin 3030 (at the interface with the cavity 3033) to the outer surface of the forward section 3038 as shown by line segment 3036*c*.1 through the center of forward surfaces 3036*c* in FIG. 24D. In other embodiments, at least a portion of the line segment 3036*c*.1 through the center of forward surfaces 3036*c* is non-linear (e.g., see FIG. 24E). For example, the line segment 3036*c*.1 may be parabolic, hyperbolic, a portion of a circular arc, and/or any other appropriate shape. In some embodiments, at least one of the forward surfaces 3036 twists around the surface of the short cam pin 3030 in a corkscrew pattern between the forward end 3301 and the outer surface of the forward section 3038.

Figure 33A:
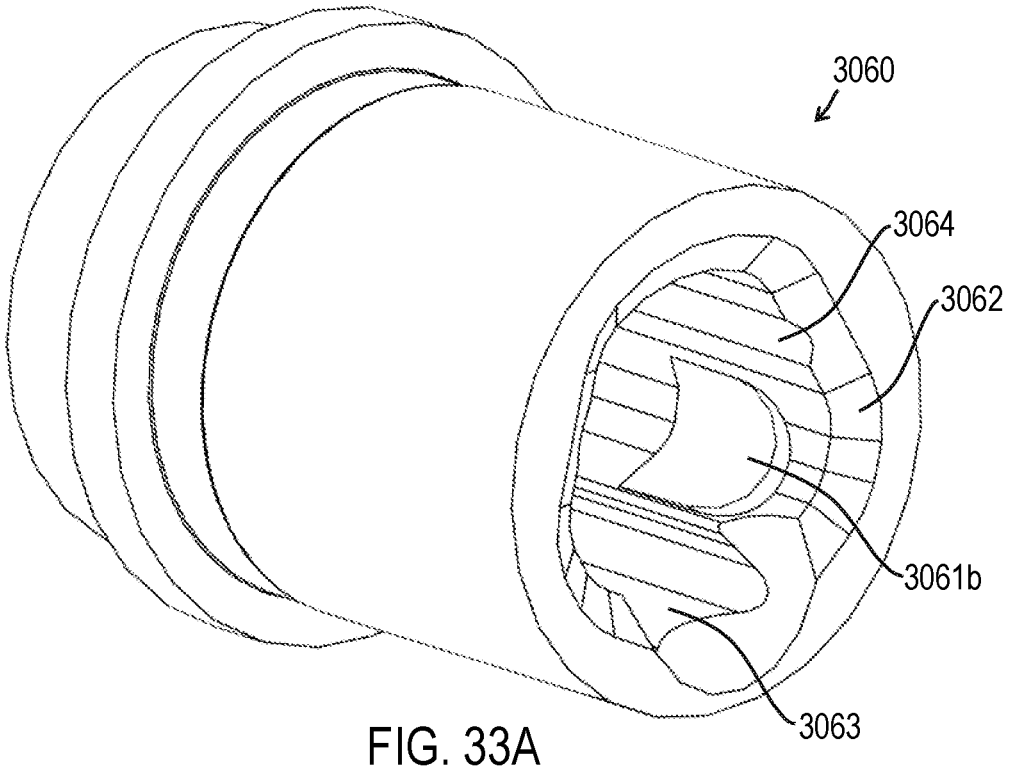
FIG. 33A is a left rear perspective view of a barrel extension of the firearm operating system of FIG. 19.
Figure 33B:
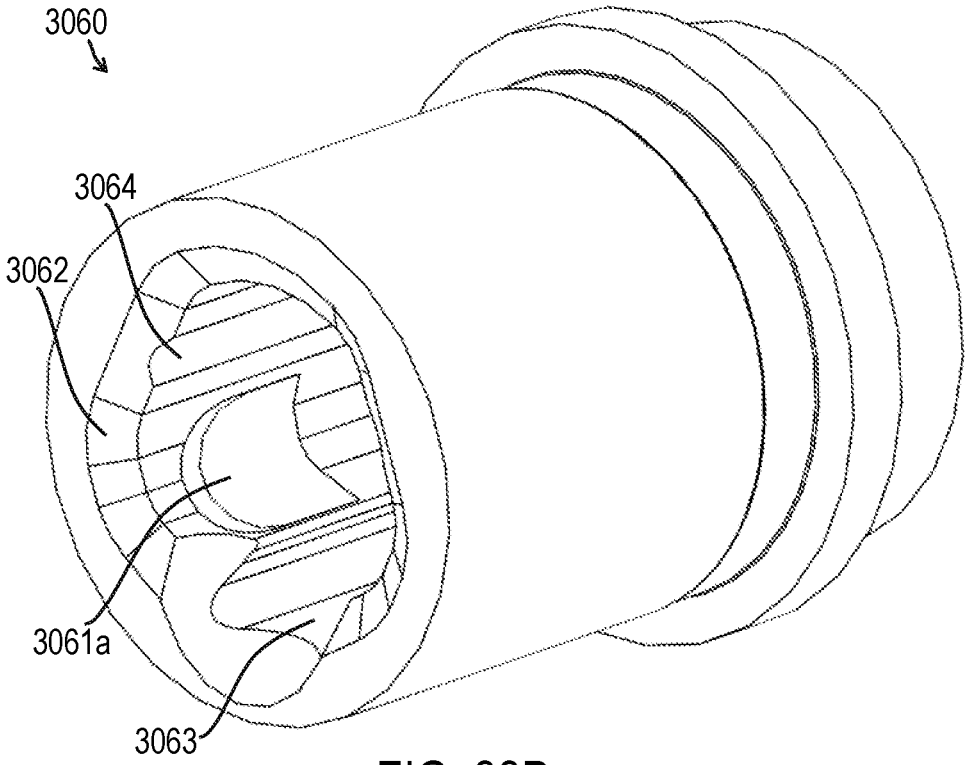
FIG. 33B is a right rear perspective view of the barrel extension of FIG. 33A.
Figure 33C:
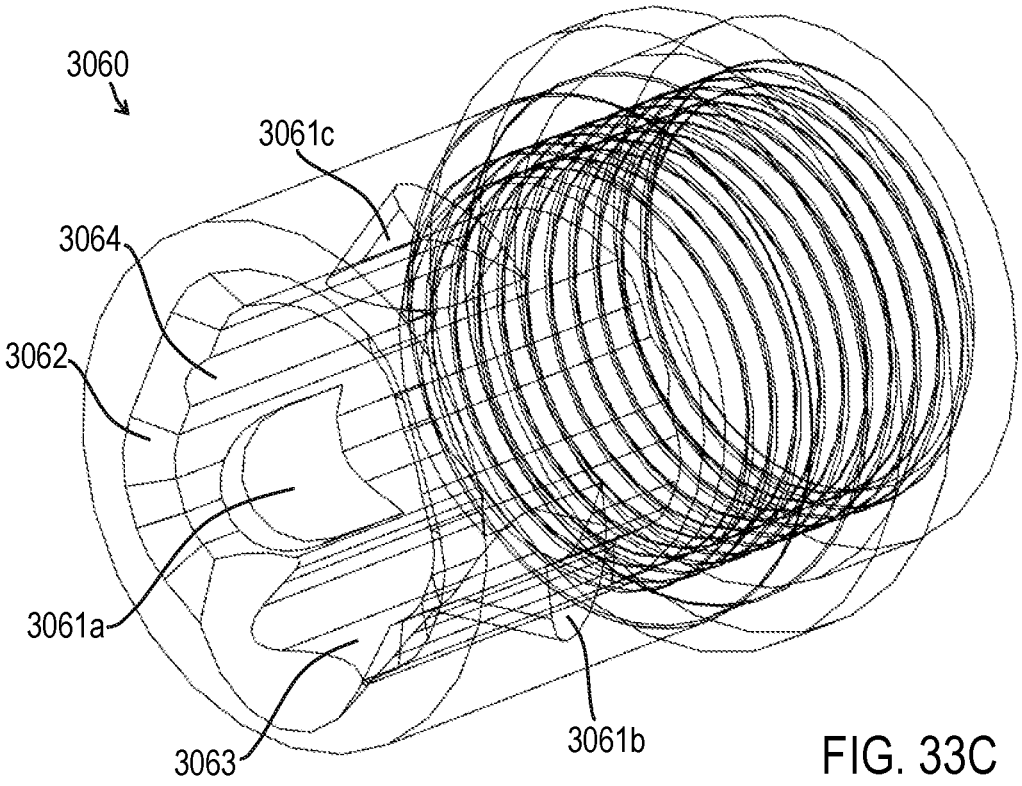
FIG. 33C is a right rear perspective transparent view of the barrel extension of FIG. 33A.
Figure 33D:
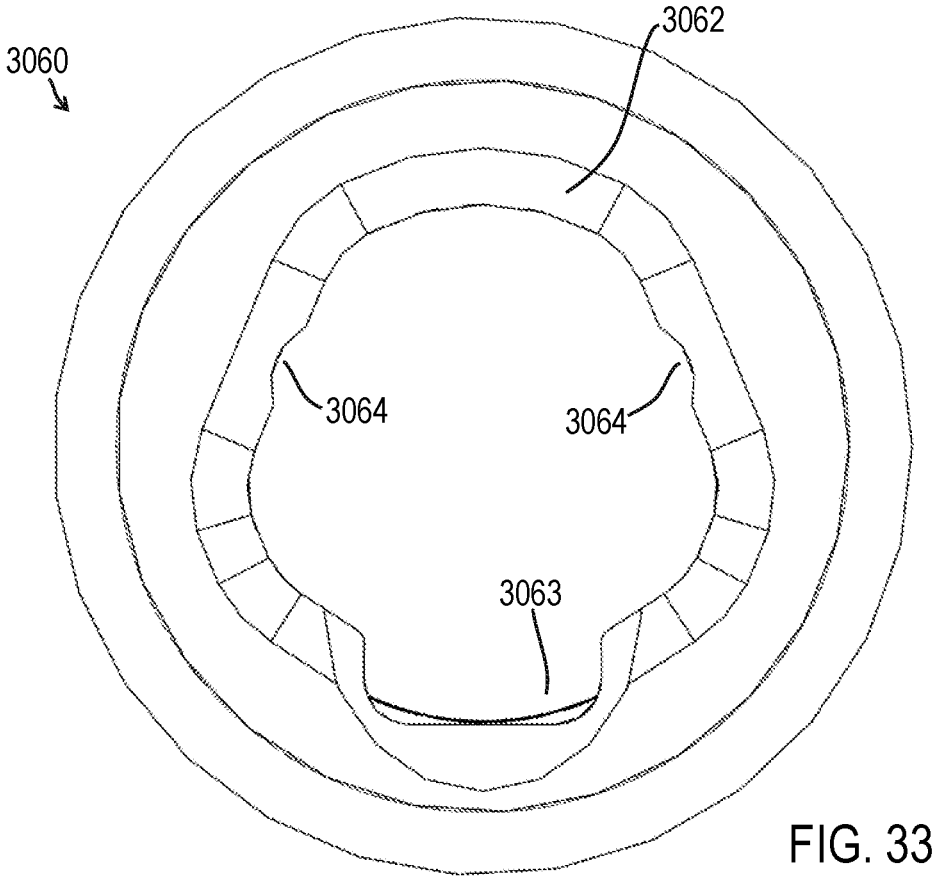
FIG. 33D is a rear view of the barrel extension of FIG. 33A.

Similarly, as shown in FIGS. 33A-33C, the recesses 3061*a*, 3061*b*, and 3061*c* of the barrel extension 3060 may include concave surfaces. To promote continuous contact with the surface of the bearings 3023, each of the recesses 3061 may include a curved surface that approximately matches the shape of the bearing 3023. For example, if one of the bearings 3023 is spherical, the corresponding recess 3061 may be concave with a partially cylindrical shape (i.e., a partially circular cross section) to interface with the bearing 3023. In some cases, the corresponding recess 3061 may be concave with a partially conical shape (i.e., a partially circular cross section) to interface with the bearing 3023. In other embodiments, the corresponding recess 3061 may have other shapes including, for example, a planar shape, a curved surface with a partially elliptical shape, a partially oval shape, or any other appropriate shape. The dimensions of the corresponding recess 3061 may be similar to the bearing 3023 (e.g., similar diameter) or, in some cases, may be larger than the bearing 3023 to ensure the bearing 3023 remains in contact with the recess 3061.

Figure 34A:
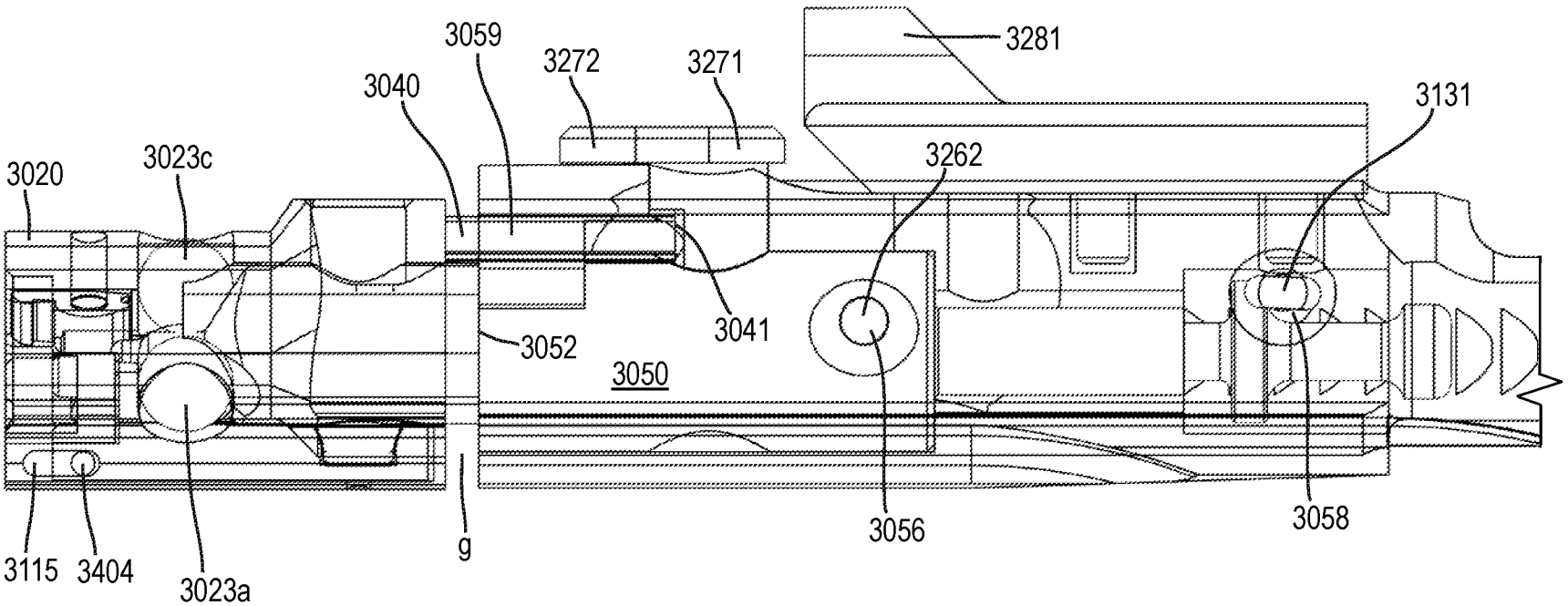
FIG. 34A is a partial left side view of the firearm operating system of FIG. 19.
Figure 34B:
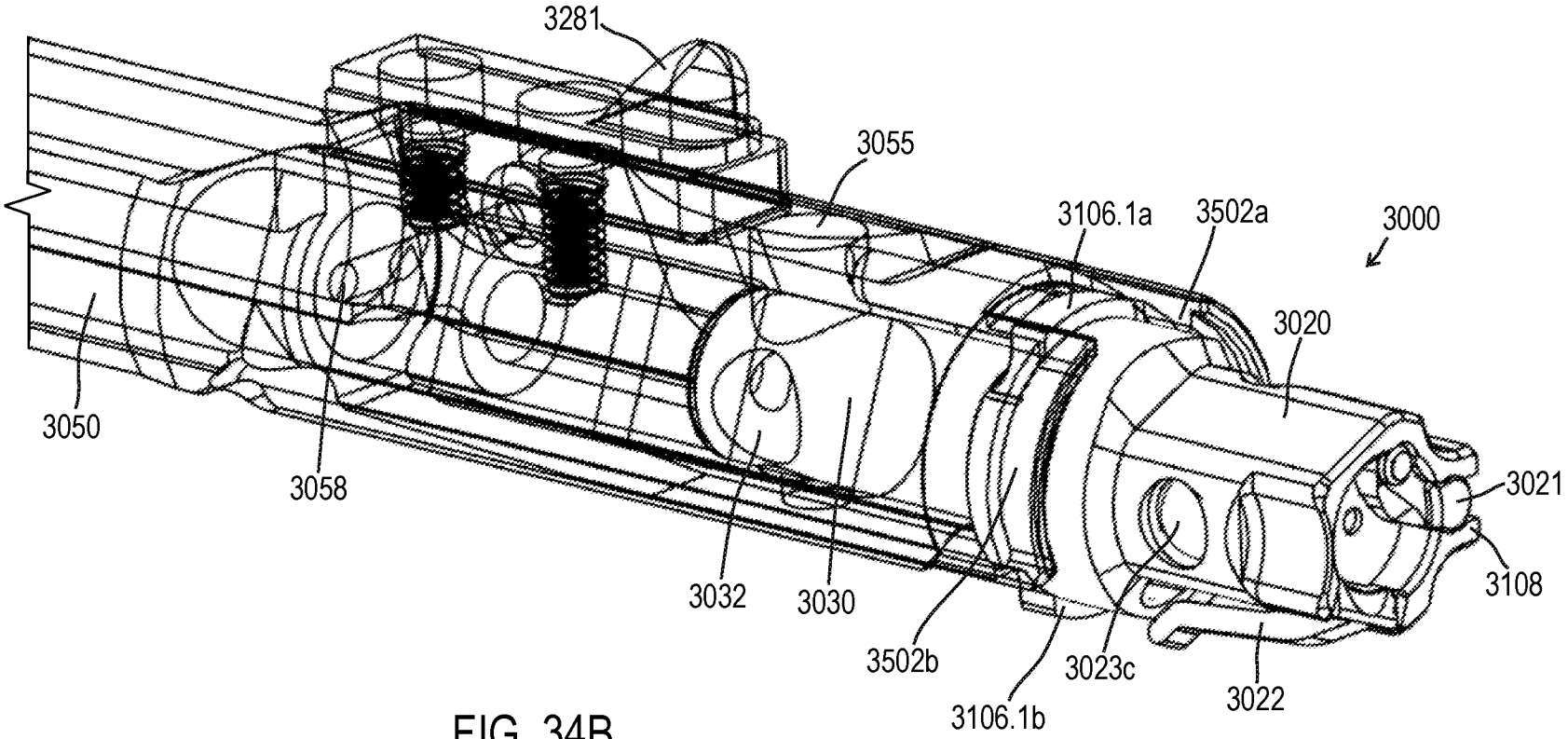
FIG. 34B is a partial right front perspective view of the firearm operating system of FIG. 19.

FIG. 34A shows an example of the firearm operating system 3000 located in a rearward position (i.e., offset toward the rear of the firearm 1 away from the barrel extension 3060) where the protrusion 3273 is pushed inward such that the head 3272 of the rotating cam pin 3271 is aligned with the X-direction due to interaction with the inner surface of the upper receiver 30 (i.e., see FIG. 21A). In this condition, the rotating cam pin 3271 is rotated such that the lateral edge 3275.1 is located in forward position such that the rotating cam pin 3271 presses against the rear surface 3041 of the bearing spacer 3040. As shown in FIG. 34A, forward pressure from the rotating cam pin 3271 pushes the rear surface 3041 which causes the bearing spacer 3040 to move forward increasing gap g between the carrier 3050 and the forward bolt 3020. In other words, forward movement/pressure from the rotating cam pin 3271 pushes the bearing spacer 3040 and the forward bolt 3020, which maintains gap g between the forward bolt 3020 and the carrier 3050. Maintaining the gap g ensures that there is nothing pushing the bearings 3023 outward because there is no forward pressure on the short cam pin 3030 (i.e., the forward surfaces 3036 are not pushing the bearings 3023 outward).

As the firearm operating system 3000 moves back forward (toward the barrel extension 3060), the head 3272 of the rotating cam pin 3271 interacts with a portion the inner surface of the upper receiver 30 that no longer applies pressure inward (i.e., a recess) and allows the head 3272 of the rotating cam pin 3271 to rotate toward the left side of the firearm 1 within the hole 3055 and/or the hole 3032. This rotation of the rotating cam pin 3271 removes pressure on rear surface 3041 and allows the bearing spacer 3040 to move rearward toward the carrier 3050. In such a condition, forward momentum of the bolt assembly and/or pressure from a buffer spring (not shown), which presses forward on rear face 3053 of the carrier 3050, causes the short cam pin 3030 and the carrier 3050 to begin moving forward relative to the forward bolt 3020. The bearing spacer 3040 will move into the cavity 3059 due to the movement of the rotating cam pin 3271 and/or due to pressure from the forward bolt 3020. In some cases, the firearm operating system 3000 is configured such that as the bolt assembly moves forward, the head 3272 reaches the recessed area of the inner surface of the upper receiver 30 concurrent with the bearings 3023 reaching the rear ramp surface 3062 of the barrel extension 3060.

As shown in FIGS. 37A-38C, in some embodiments, the firearm operating system 2000, 3000 may include a forward bolt 4020 configured for symmetric operation. The forward bolt 4020 may include a first ejector 4021*a*, a second ejector 4021*b*, and an extractor 4022. Although some features of the forward bolt 4020 are not described in detail herein, numerous features of the forward bolt 4020 are similar to the corresponding features of the forward bolt 2020 and/or the forward bolt 3020. For example, the bearing cavities 4024 may function similar to bearing cavities 2024 and/or bearing cavities 3024.

Figure 38A:
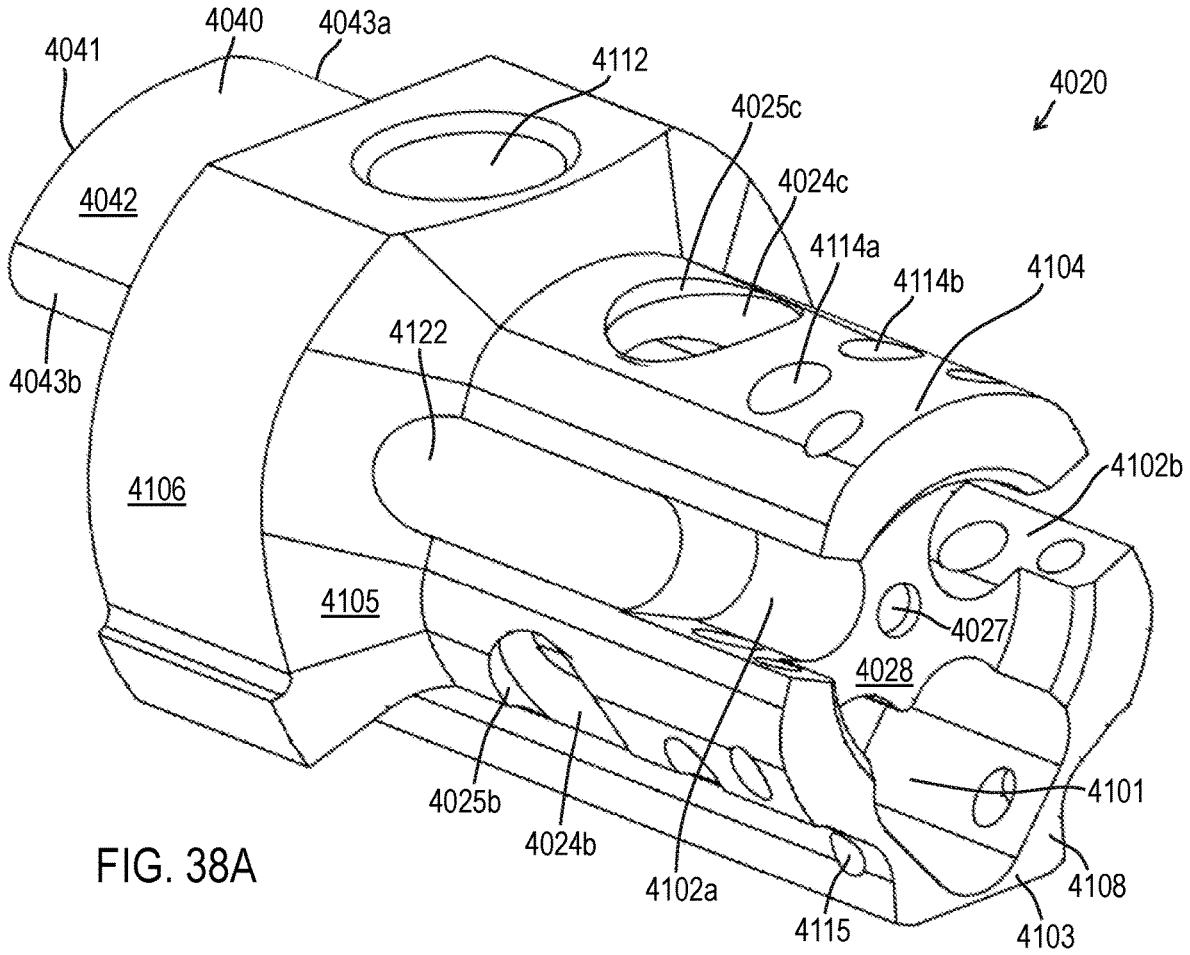
FIG. 38A is a front right side perspective view of a forward bolt of FIG. 37A.
Figure 38B:
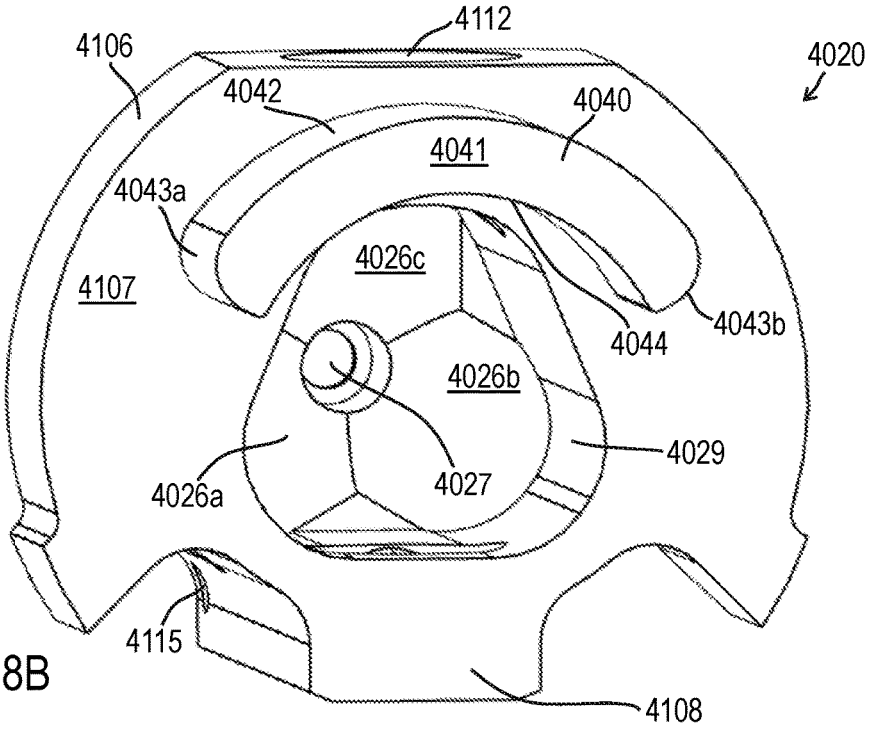
FIG. 38B is a rear left side perspective view of the forward bolt of FIG. 37A.
Figure 38C:
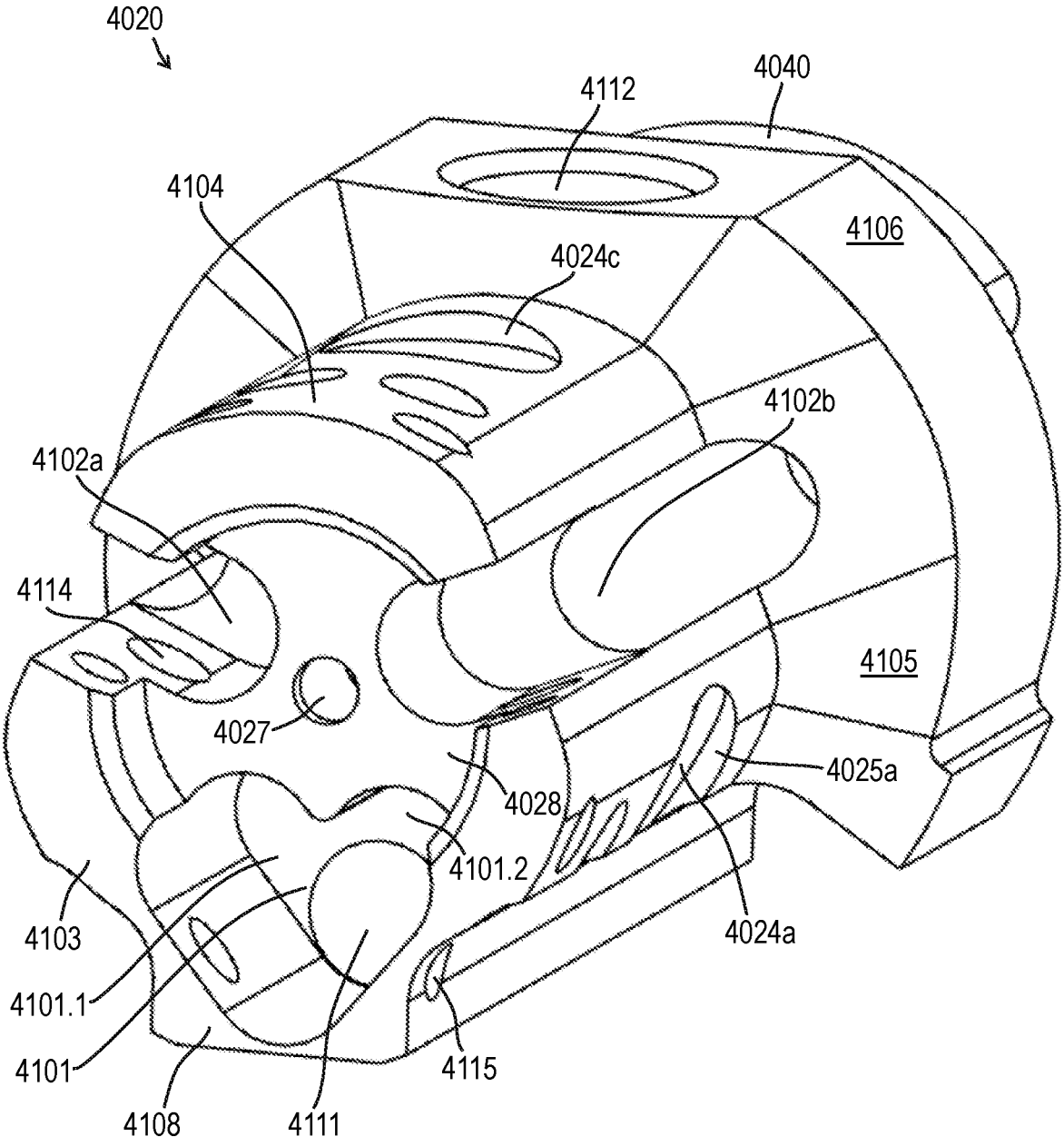
FIG. 38C is a front left side perspective view of the forward bolt of FIG. 37A.
Figure 39:
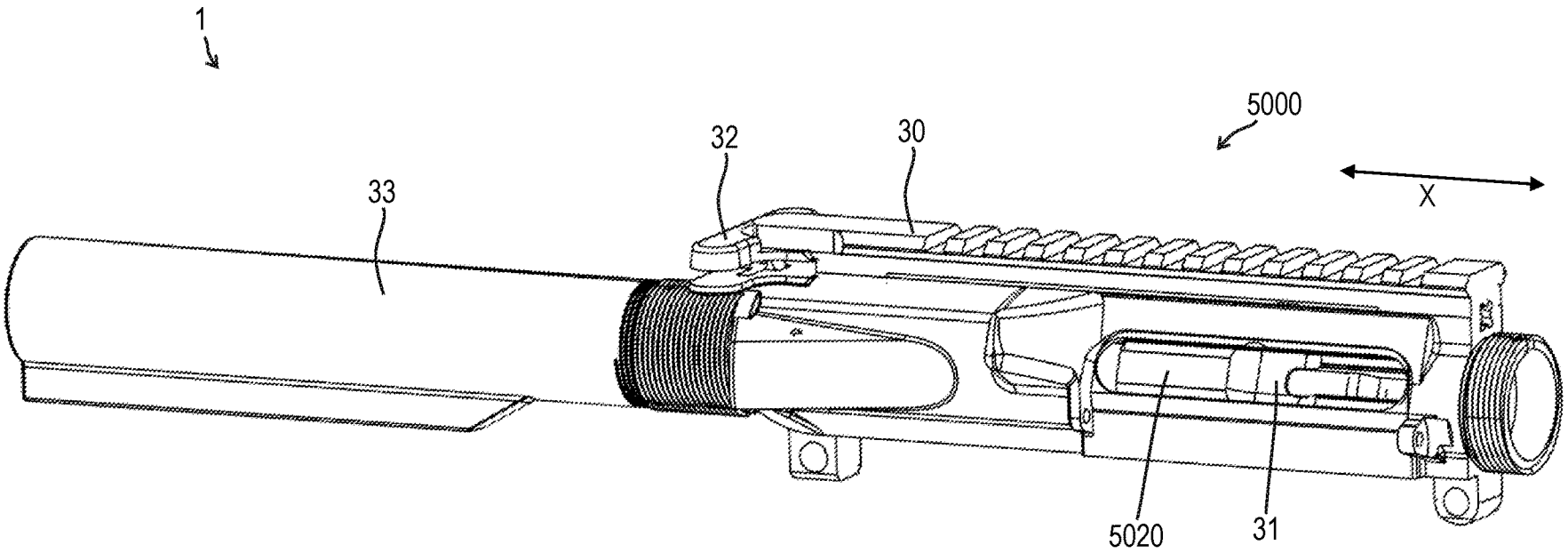
FIG. 39 is a perspective view of a firearm operating system for a firearm according to certain embodiments of the present invention.
Figure 40:
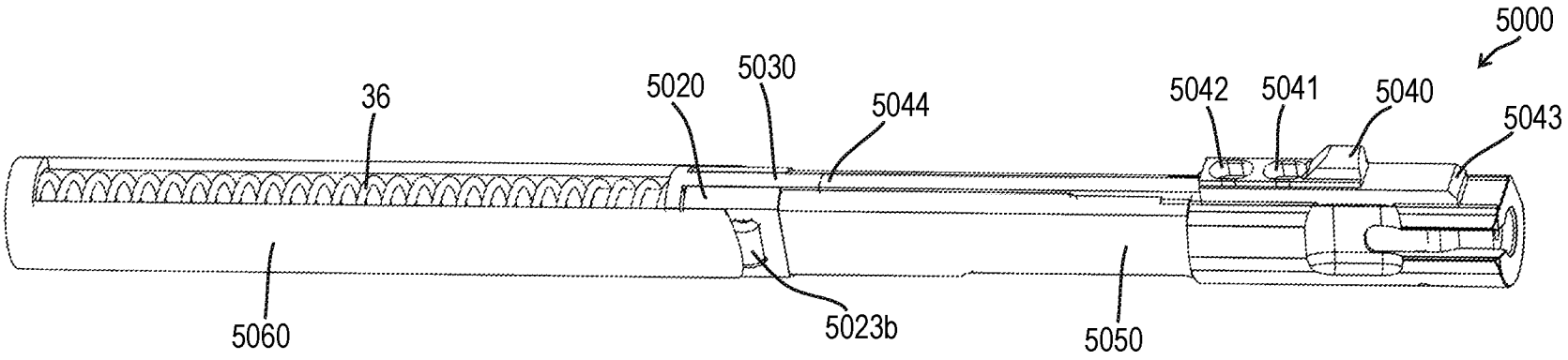
FIG. 40 is a right side perspective view of the firearm operating system of FIG. 39.
Figure 41:
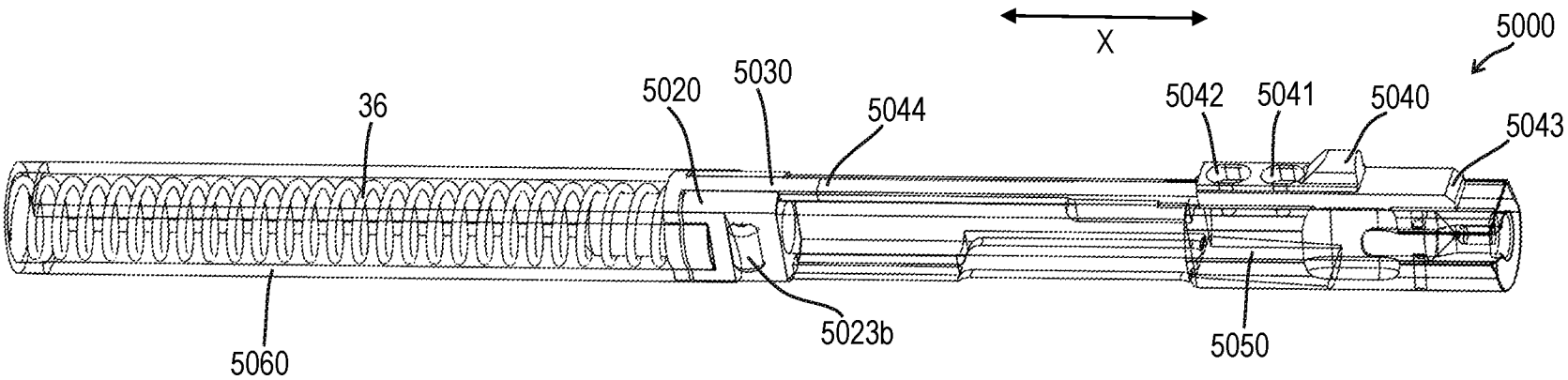
FIG. 41 is a right side perspective view of the firearm operating system of FIG. 39.
Figure 42:
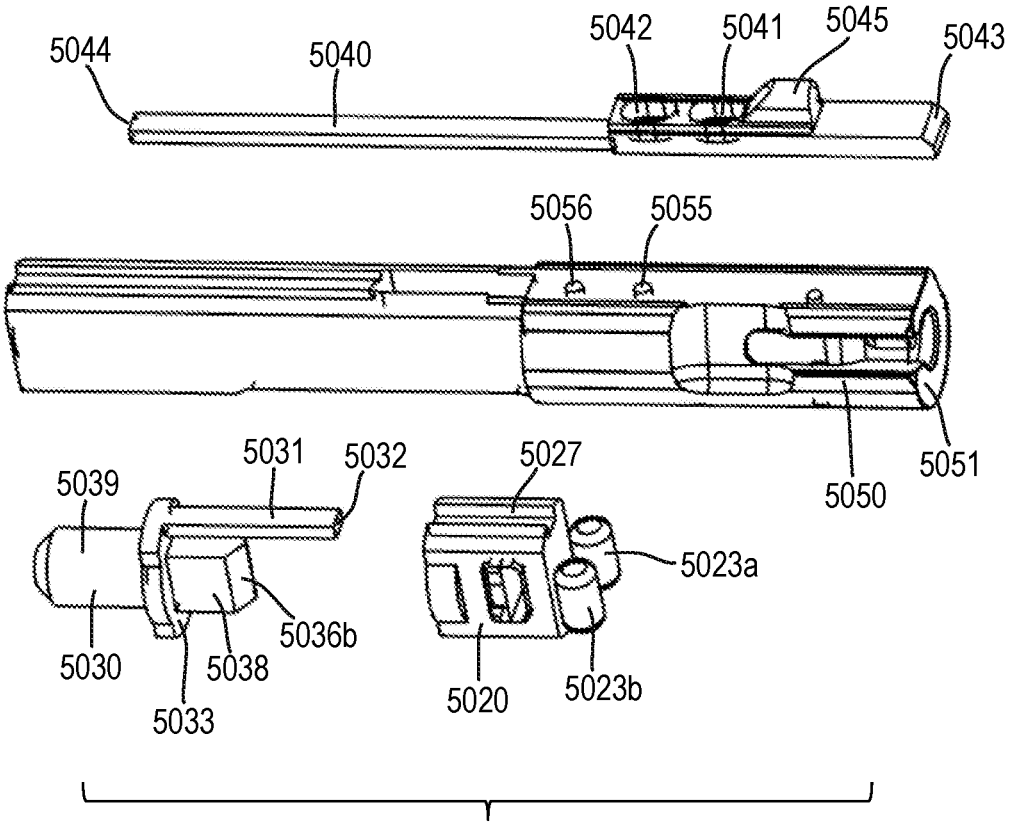
FIG. 42 is an exploded side perspective view of the firearm operating system of FIG. 39.

The forward bolt 4020 may include an upper left cavity 4102*b* and an upper right cavity 4102*a* that are each similar to the extractor cavity 3102 of the forward bolt 3020 (see FIGS. 38A and 38C). In some embodiments, as described below, the upper cavities 4102 may accommodate the extractor 4022 and the second ejector 4021*b* in one or more configurations. As shown in FIGS. 38A and 38C, the forward bolt 4020 may also include a lower ejector hole 4101 to accommodate the first ejector 4021*a*. In some embodiments, as shown in FIG. 38C, a forward portion of the lower ejector hole 4101 includes a right side chamber 4101.1 and a left side chamber 4101.2 that may accommodate the first ejector 4021*a* in one or more configurations. The first ejector 4021*a* is installed and functions similar to ejector 3021. The second ejector 4021*b* is installed with a spring (e.g., a coil spring) into either of the upper cavities 4102 and is retained with a pin similar to pin 3117. The extractor 4022 is installed into either of the upper cavities 4102 and functions similar to ejector 3022.

Figure 19:
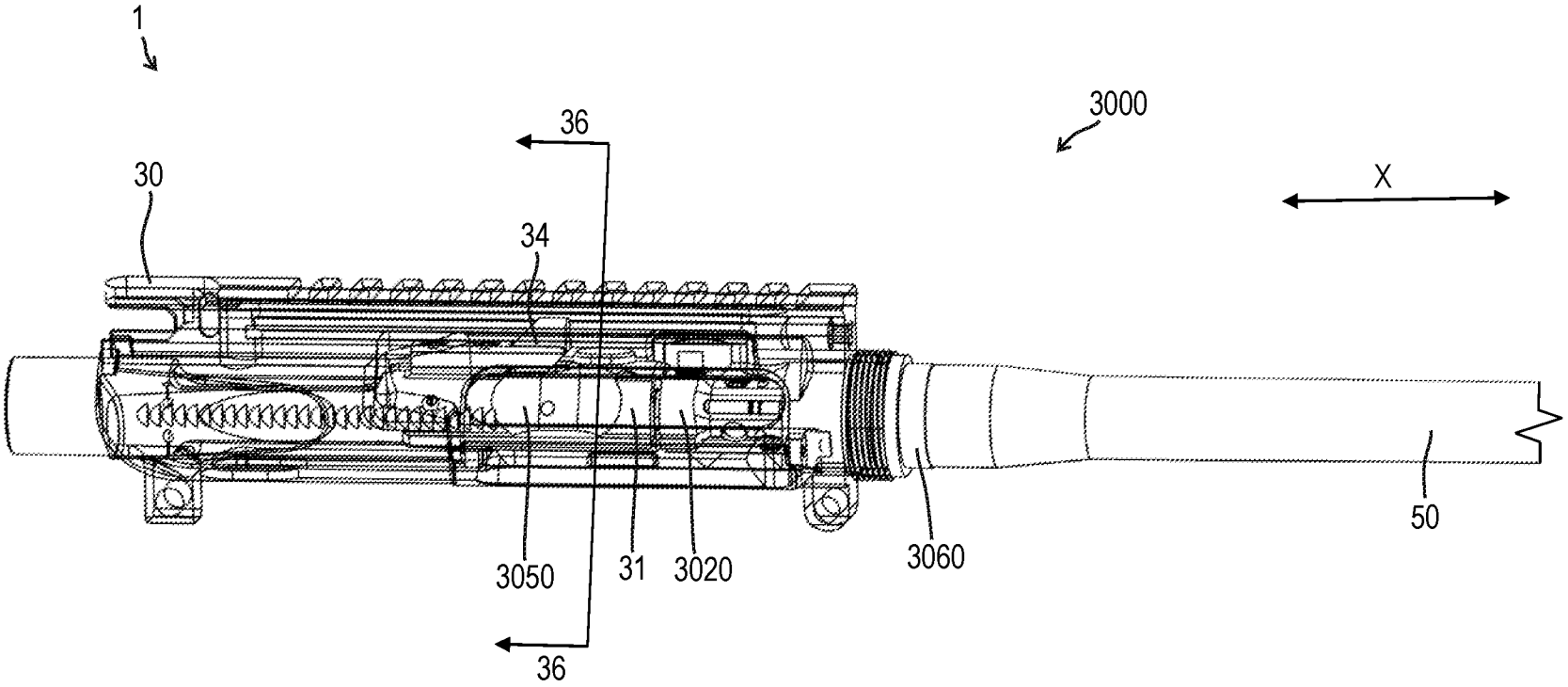
FIG. 19 is a perspective view of a firearm operating system for a firearm according to certain embodiments of the present invention.
Figure 37A:
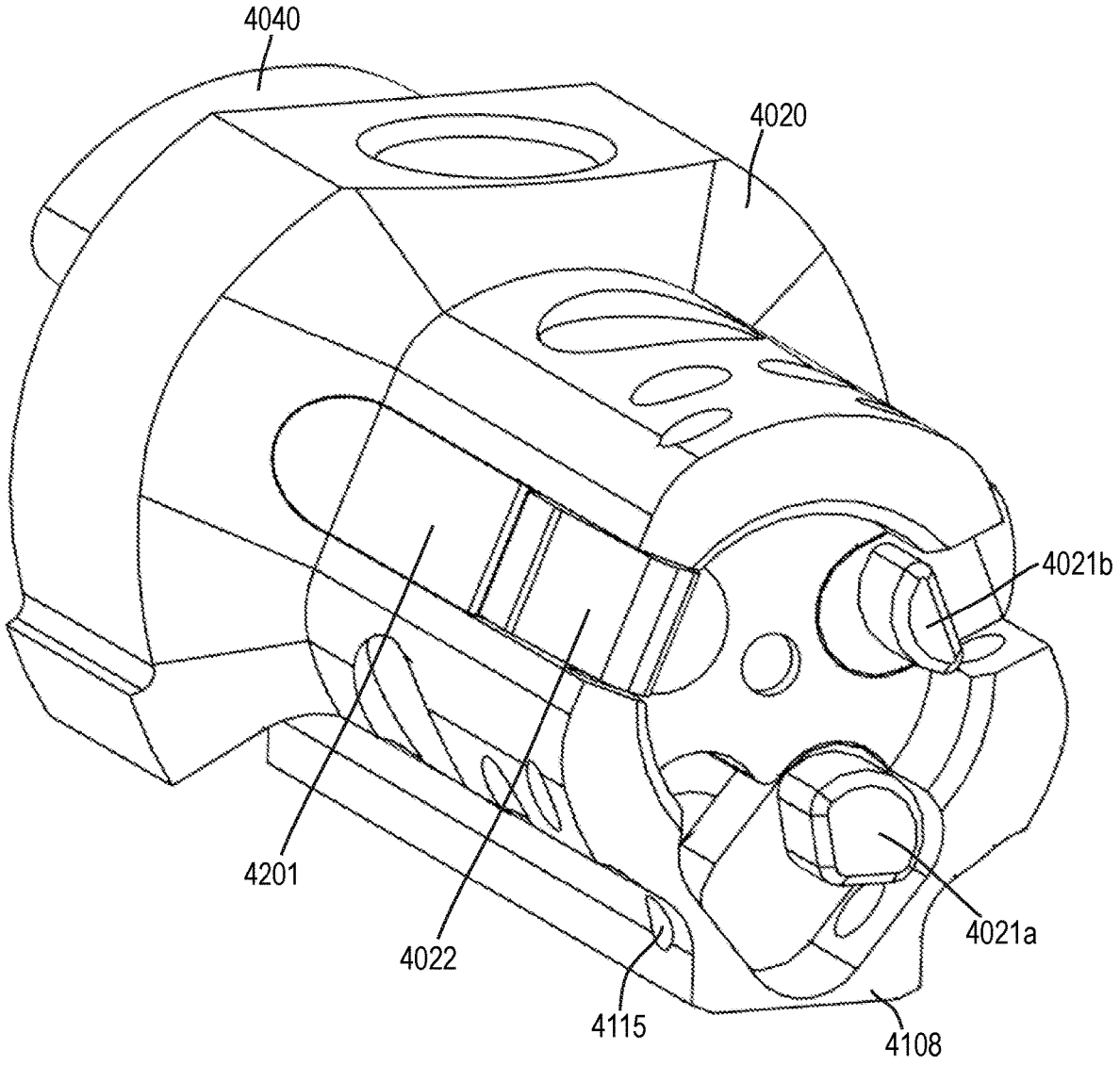
FIG. 37A is a front right side perspective view of a forward bolt assembly of an firearm operating system according to certain embodiments of the present invention.
Figure 37B:
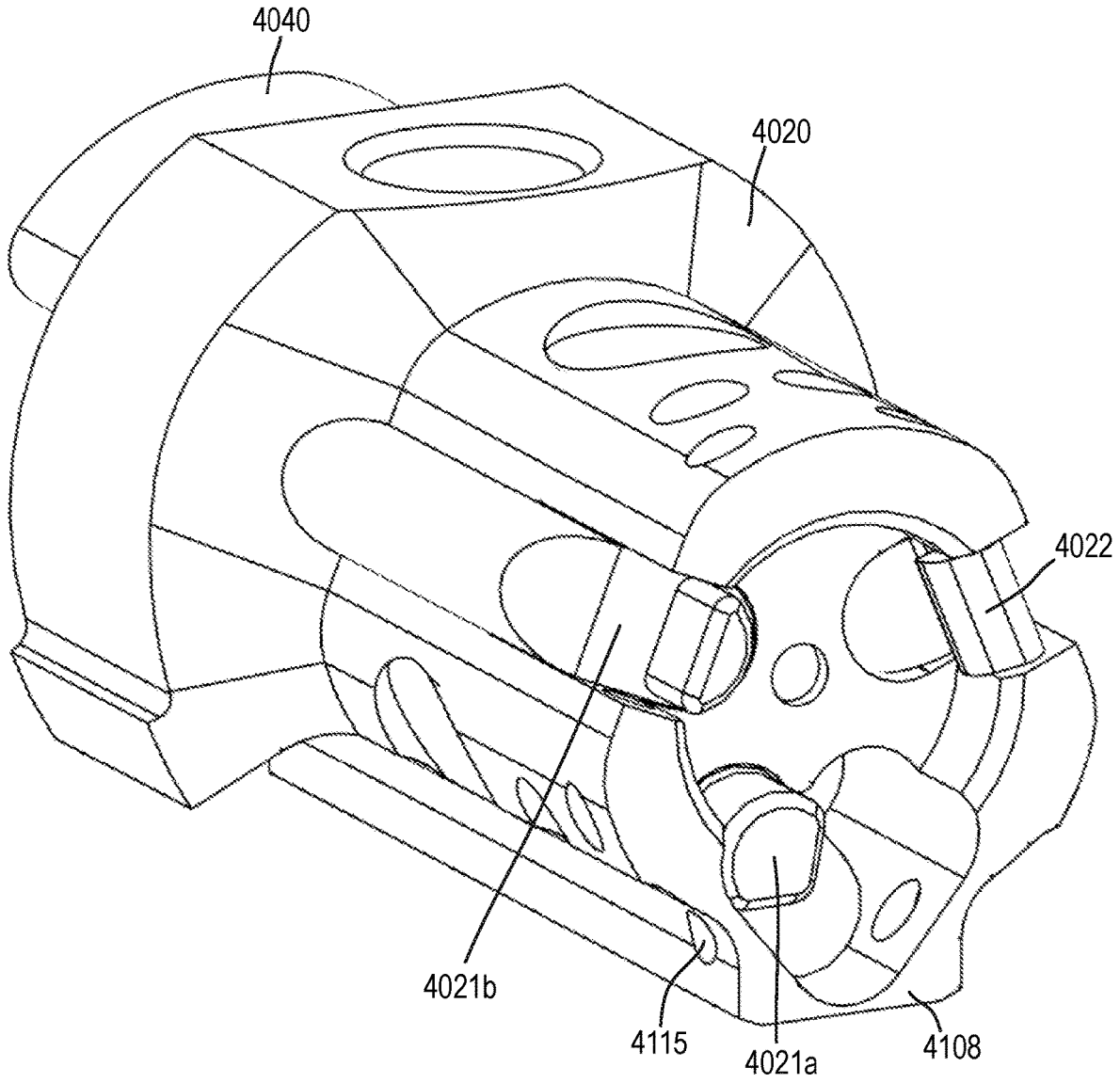
FIG. 37B is a front right side perspective view of the forward bolt assembly of FIG. 37A.

The first ejector 4021*a* interfaces with the lower ejector hole 4101 of the forward bolt 4020. As shown in FIGS. 37A, 37B, 38A, and 38C, the lower ejector hole 4101 may be designed to accommodate the first ejector 4021*a* in multiple positions or configurations. In addition, in some embodiments, the second ejector 4021*b* and the extractor 4022 may each be moveable between multiple positions or configurations. For example, as shown in FIG. 37A, (i) the first ejector 4021*a* may be disposed within the lower ejector hole 4101 in the left side chamber 4101.2, (ii) the second ejector 4021*b* may be located in the upper left cavity 4102*b*, and (iii) the extractor 4022 (along with an extractor plunger 4201) may be located in the upper right cavity 4102*a*. The configuration shown in FIG. 37A may be designed to eject a cartridge (or an empty shell of a cartridge if a round was fired) out the right side of the firearm 1 (e.g., an arrangement for right handed operators where the ejection port 31 is on the right side of the upper receiver 30 as shown in FIGS. 1 and 19). In some embodiments, the first ejector 4021*a* and the second ejector 4021*b* both simultaneously push on the rear of the cartridge (or an empty shell of a cartridge if a round was fired) during ejection. As described above, the cartridge/shell may pivot about the extractor 4022 and exit the firearm 1. In other embodiments, as shown in FIG. 37B, (i) the first ejector 4021*a* may be disposed within lower ejector hole 4101 in the right side chamber 4101.1, (ii) the second ejector 4021*b* may be located in the upper right cavity 4102*a*, and (iii) the extractor 4022 (along with an extractor plunger 4201) may be located in upper left cavity 4102*b*. The configuration shown in FIG. 37B may be designed to eject a cartridge (or an empty shell of a cartridge if a round was fired) out the left side of the firearm 1 (e.g., an arrangement for left handed operators where the ejection port 31 is on the left side of the upper receiver 30). In some embodiments, the first ejector 4021*a* and the second ejector 4021*b* both simultaneously push on the rear of the cartridge (or an empty shell of a cartridge if a round was fired) during ejection. As described above, the cartridge/shell may pivot about the extractor 4022 and exit the firearm 1. Based on the foregoing, an operating system that includes the forward bolt 4020 can be quickly changed from a right handed operating configuration (FIG. 37A) to a right handed operating configuration (FIG. 37B).

According to certain embodiments of the present invention, as shown in FIGS. 39-48B, a firearm operating system 5000 may include a rear bolt 5020, a cam member 5030, an upper member 5040, a carrier 5050, at least one bearing 5023, and a buffer tube insert 5060. The firearm operating system 5000 may be incorporated into a firearm 1 that includes an upper receiver 30, a charging handle 32, a buffer tube 33 and a buffer spring 36. Other components (e.g., lower receiver, magazine, barrel, handguard, etc.) are not illustrated for simplicity. In some cases, the firearm operating system 5000 is located within the upper receiver 30. The firearm operating system 5000 may be designed as an assembly of components to fit within a standard upper receiver (e.g., upper receiver 30 shown in FIG. 39) for a known modular firearm such that the upper receiver 30 (including the firearm operating system 5000) can interface with a standard lower receiver. For example, the firearm operating system 5000 may be designed to function and engage with (i) components of AR-15 variant (civilian) or M16/M4 (military) firearms; (ii) components of AR-10 variant firearms: or (iii) components of any other relevant firearm.

FIGS. 40-48B show many of the relevant components of the firearm operating system 5000 in situ. As described in greater detail below, in some embodiments, at least a portion of a forward section 5038 of the cam member 5030 is disposed within an internal cavity of the rear bolt 5020 (e.g., rear cavity 5029) and at least a portion of a rear section 5039 of the cam member 5030 is disposed within the buffer tube insert 5060 wherein the rear section 5039 may engage the buffer spring 36. The rear bolt 5020 may be located on a rear side of the carrier 5050. The forward section 5038 of the cam member 5030 may include an upper protrusion 5031 to match the groove 5027 of the rear bolt 5020. In addition to not showing the magazine, the upper receiver 30, the buffer tube 33, and the handguard 40 (as described above), in FIG. 41, the buffer tube insert 5060 is transparent to better illustrate components of the firearm operating system 5000. Cycling of the firearm operating system 5000 is based on linear motion of various components in the forward/aft direction X including, for example, the rear bolt 5020, the cam member 5030, and the carrier 5050.

In some embodiments, the rear bolt 5020, cam member 5030, the carrier 5050, and the upper member 5040 combine together as one unit within the firearm operating system 5000. As shown in FIGS. 40, 41, 43A, and 43B, the rear bolt 5020 and the cam member 5030 may be disposed on a rear side of the carrier 5050 such that, in some conditions, there is a gap g between a rear face 5107 of the rear bolt 5020 and a forward face 5033 of the cam member 5030. The cam member 5030 may extend internally into and/or through a rear cavity 5029 of the rear bolt 5020 (see FIGS. 43A, 43B, and 45B). The firearm operating system 5000 may include at least one retaining pin to constrain movement of the upper member 5040 relative to the carrier 5050. In some cases, the firearm operating system 5000 includes two retaining pins where the first retaining pin engages hole 5041 of the upper member 5040 and hole 5055 of the carrier 5050. Similarly, the second retaining pin may engage hole 5042 of the upper member 5040 and hole 5056 of the carrier 5050. As shown in FIGS. 40-43B, the holes 5041, 5042 of the upper member

5040 may be slotted holes to allow the upper member 5040 to move in the X-direction relative to the carrier 5050.

Figure 43A:
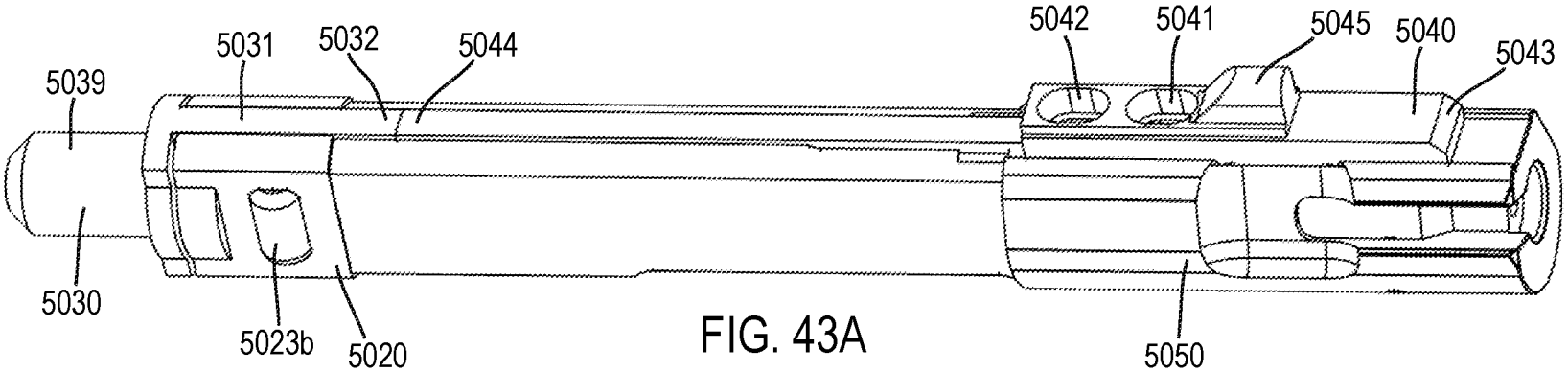
FIG. 43A is a right side perspective view of the firearm operating system of FIG. 39.
Figure 43B:
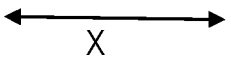
FIG. 43B is a right side perspective view of the firearm operating system of FIG. 39.
Figure 43B:
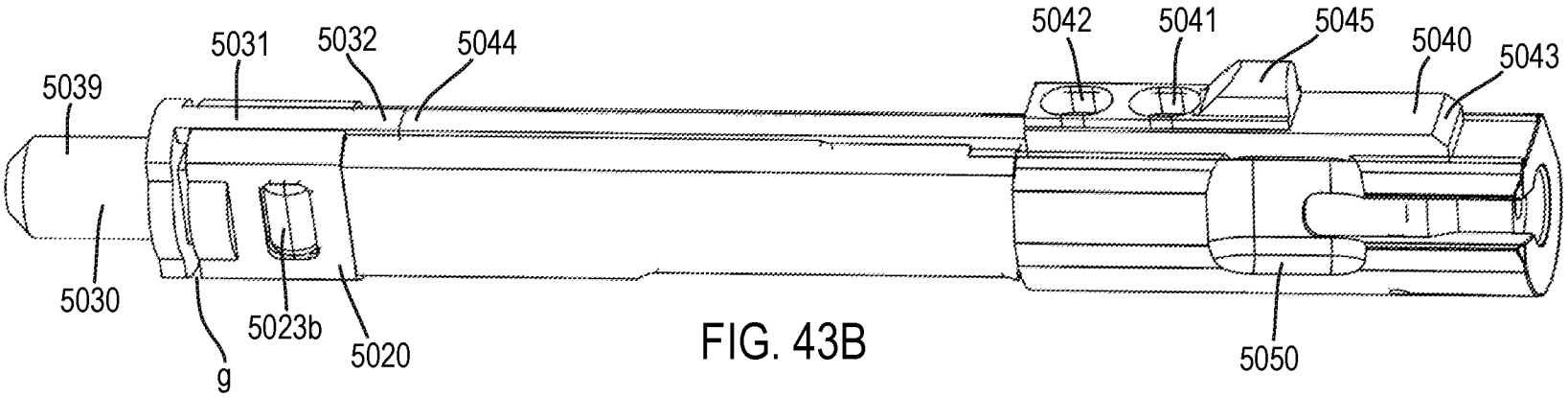
Figure 44A:
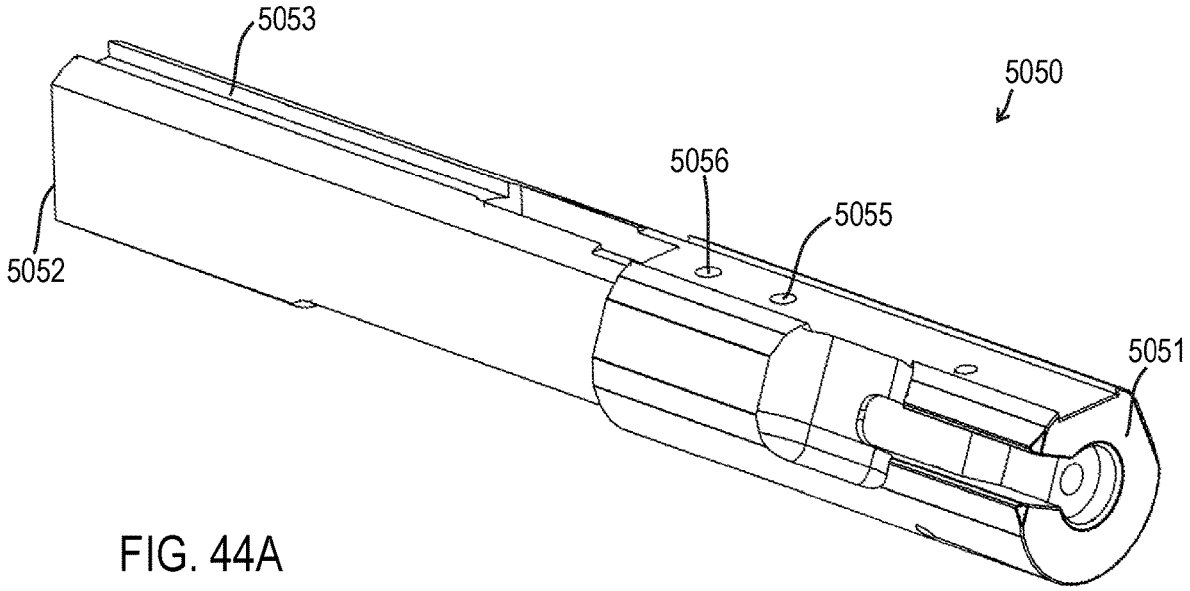
FIG. 44A is a front right side perspective view of a carrier of the firearm operating system of FIG. 39.
Figure 44B:
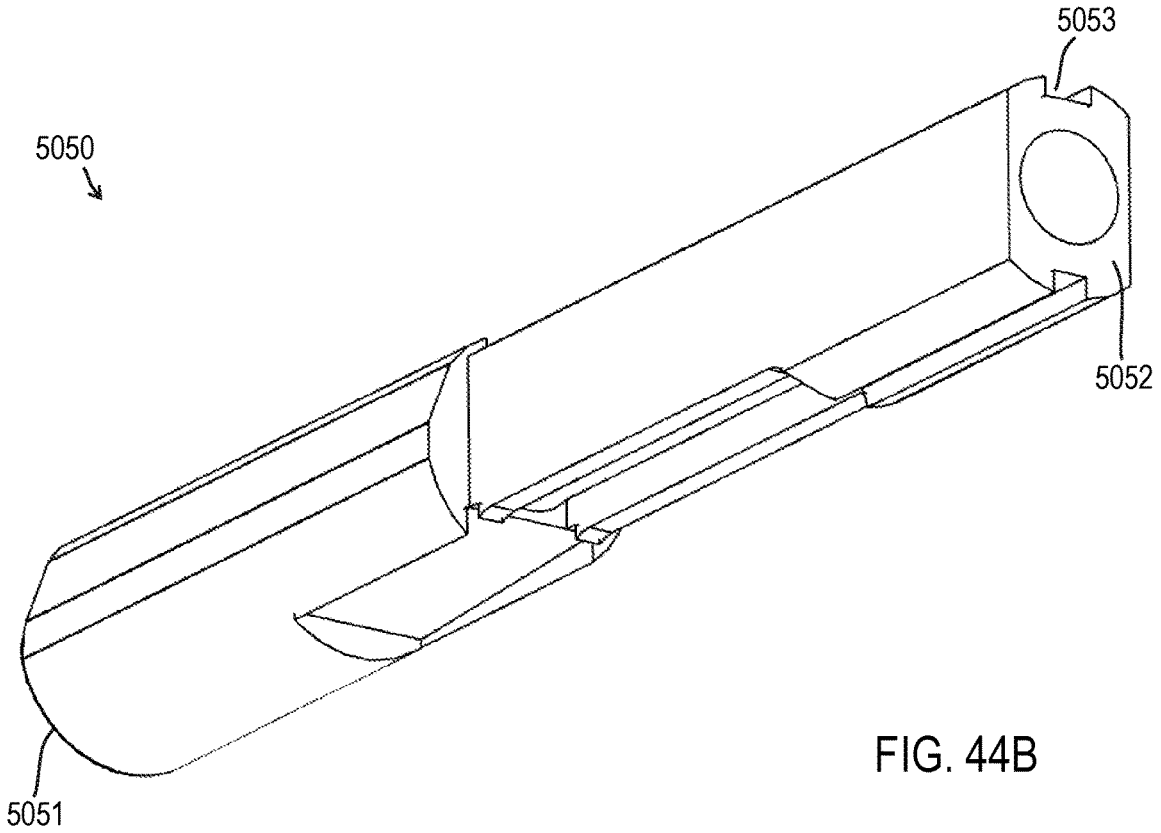
FIG. 44B is a rear left perspective view of the carrier of FIG. 44A.

As shown in FIGS. 43A and 43B, the rear bolt 5020 and the cam member 5030 may be movable relative to one another in the X-direction such that the firearm operating system 5000 has a deployed configuration and a retracted configuration. In some embodiments, in the retracted configuration as shown in FIG. 43B, the cam member 5030 is in a rear position relative to the rear bolt 5020, which creates the gap g between the rear face 5107 of the rear bolt 5020 and the forward face 5033 of the cam member 5030 (see FIG. 22). When the firearm operating system 5000 moves to the deployed configuration as shown in FIG. 43A, the cam member 5030 moves to a forward position relative to the rear bolt 5020, which reduces or eliminates the gap g between the rear face 5107 of the rear bolt 5020 and the forward face 5033 of the cam member 5030.

The distance or magnitude of gap g may be determined by the geometry of the interface between the rear bolt 5020, the cam member 5030, the bearings 5023, and the buffer tube insert 5060. In FIG. 43A, the cam member 5030 is biased toward the forward or the deployed configuration, which dictates that the forward section 5038 of the cam member 5030 interfaces with the bearings 5023. In particular, the forward surfaces 5036*a*, 5036*b* engage the first bearing 5023*a* and the second bearing 5023*b*, respectively. Rearward movement of the cam member 5030 causes the forward surfaces 5036*a* and 5036*b* of the cam member 5030 to move away from the bearings 5023 and thus allow the bearings 5023*a* and 5023*b* (respectively) to retract and move inward toward the interior of the rear bolt 5020 (as shown in FIG. 43B). In some cases, the retaining pin(s) that engage holes 5041, 5042 of the upper member 5040 and holes 5055, 5056 of the carrier 5050 allow the upper member 5040 to move with the cam member 5030 (and/or to cause the cam member 5030 to move). As discussed in greater detail below, forward movement of the cam member 5030 causes the forward surfaces 5036*a*, 5036*b* of the cam member 5030 to contact and push the bearings 5023*a*, 5023*b* (respectively) outward toward the exterior of the rear bolt 5020.

In addition, the firearm operating system 5000 allows the firearm 1 to include a barrel without a hole for venting/redirecting gas pressure to the operating system. In other words, another advantage compared to conventional systems is that the barrel of the firearm operating system 5000 is simpler and less likely to corrode or otherwise fail due to additional holes thus increasing longevity.

The carrier 5050 may include a forward face 5051, a rear face 5052, a groove 5053, a hole 5055, and a hole 5056. As shown in FIGS. 40, 41, 43A, and 43B, the groove 5053 may interface with at least one of the upper member 5040 and/or the upper protrusion 5031 of the cam member 5030. In some cases, the groove 5053 matches the groove 5027 of the rear bolt 5020.

Figure 45A:
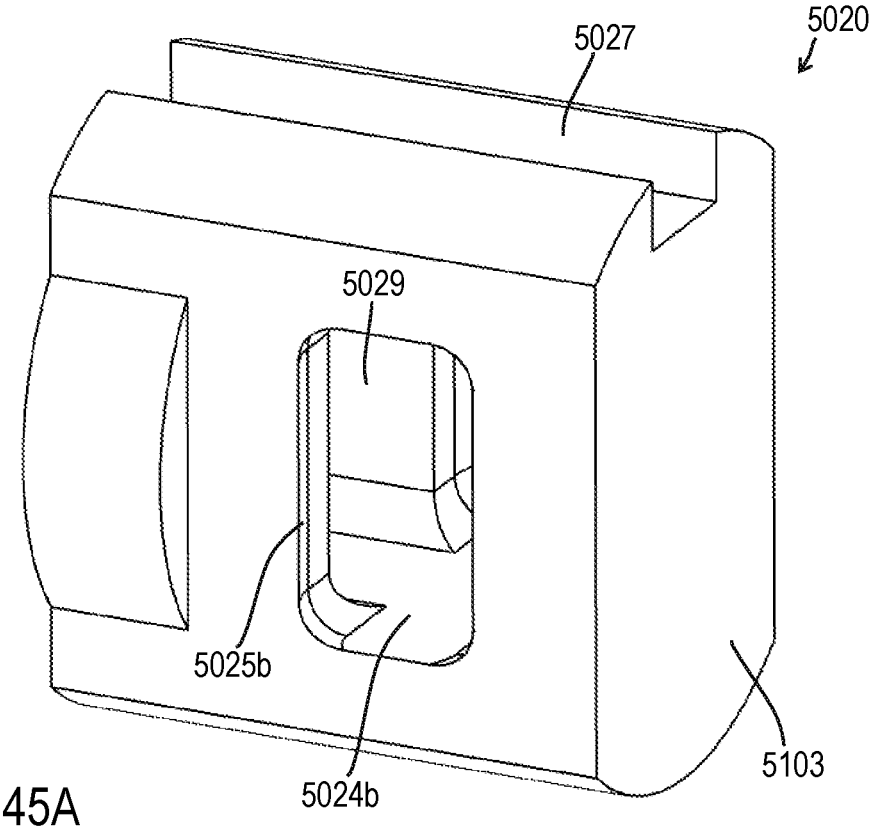
FIG. 45A is a front right side perspective view of a rear bolt of the firearm operating system of FIG. 39.
Figure 45B:
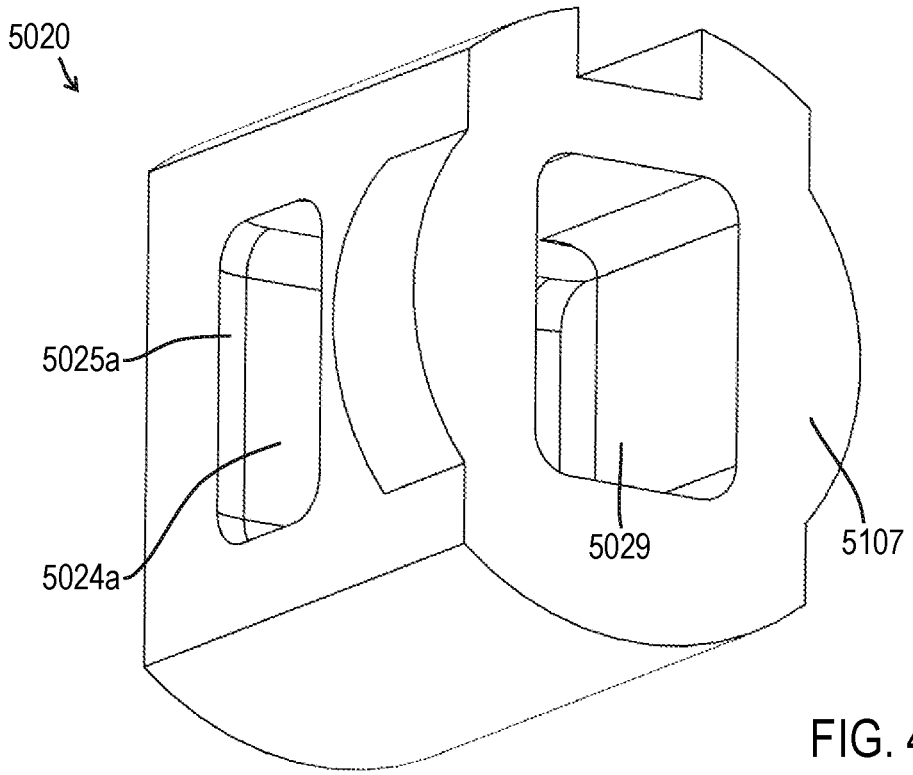
FIG. 45B is a rear left side perspective view of the rear bolt of FIG. 45A.
Figure 46A:
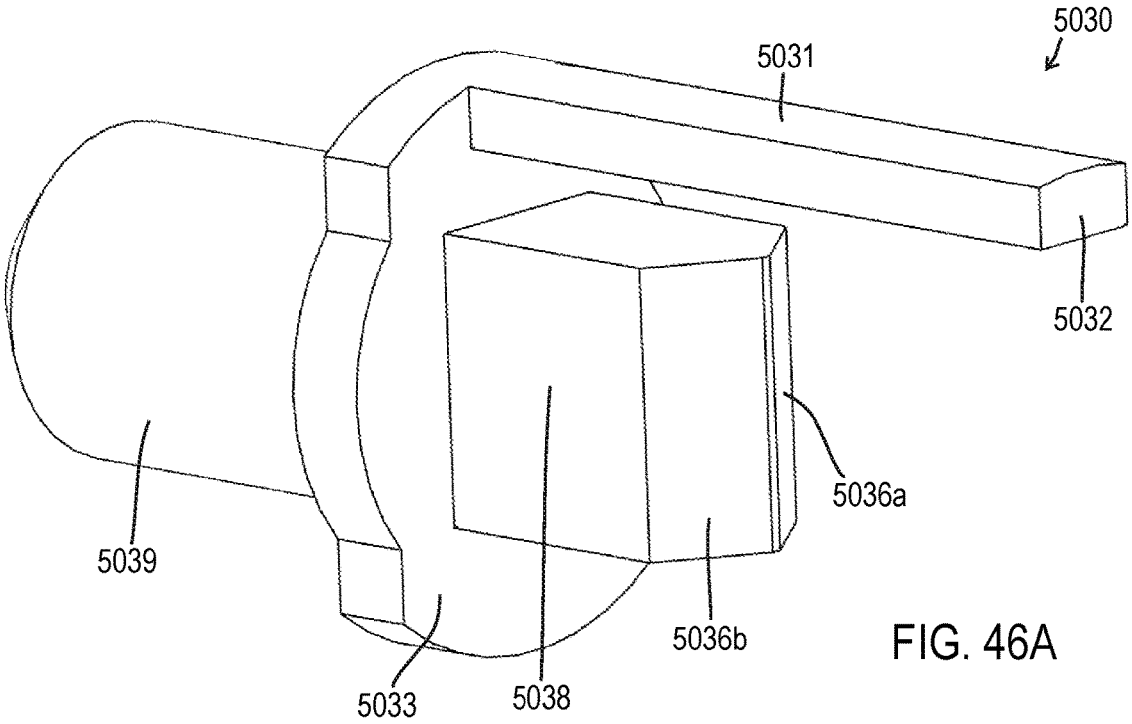
FIG. 46A is a front right side perspective view of a cam member of the firearm operating system of FIG. 39.
Figure 46B:
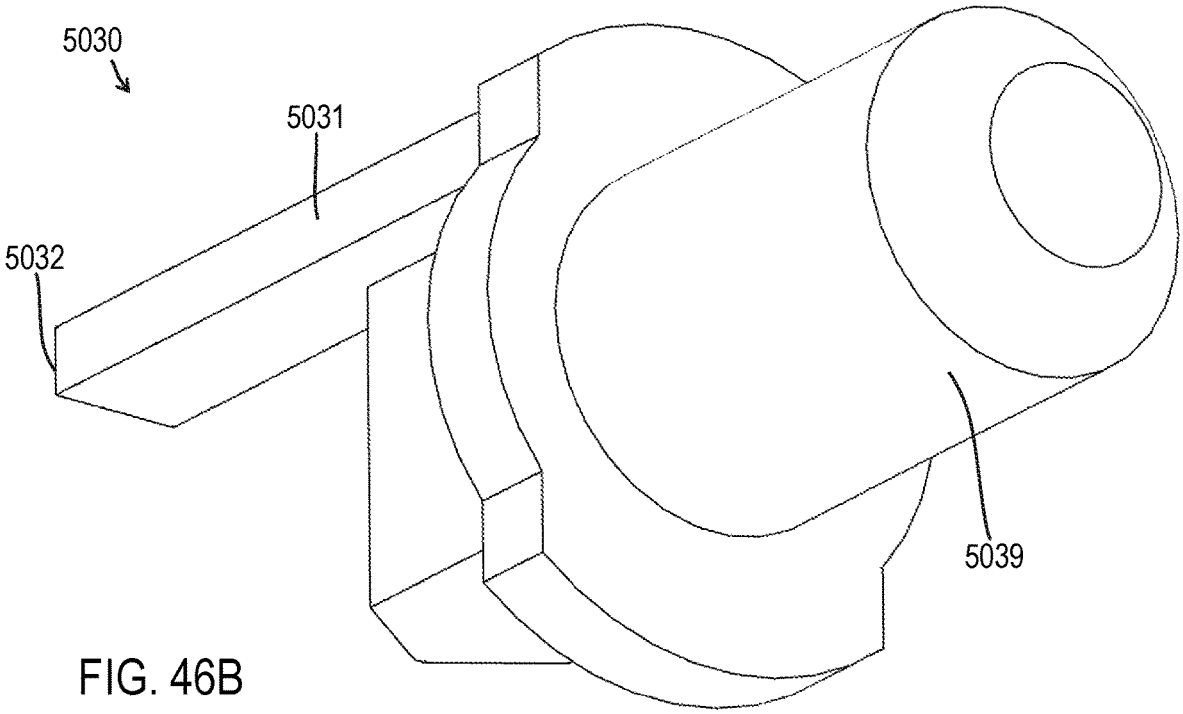
FIG. 46B is a rear left side perspective view of the cam member of FIG. 46A.
Figure 47A:
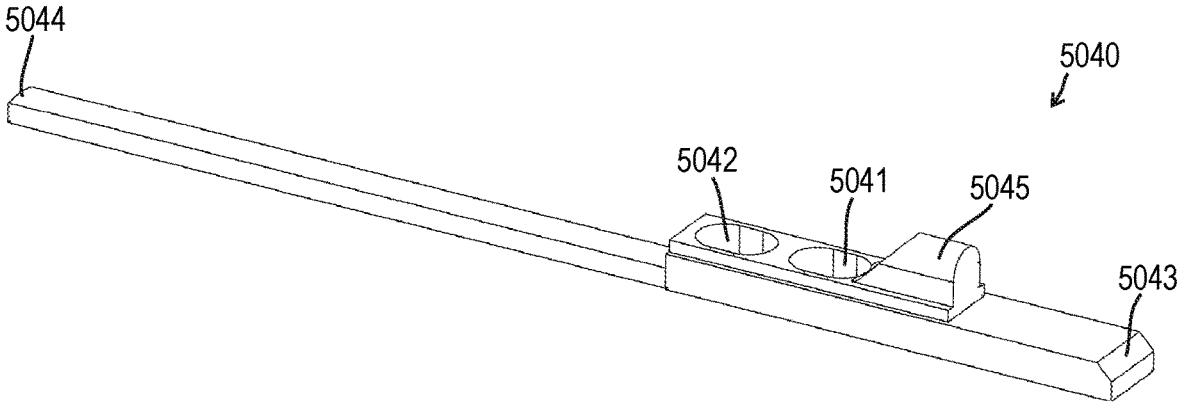
FIG. 47A is a front right side perspective view of an upper member of the firearm operating system of FIG. 39.
Figure 47B:
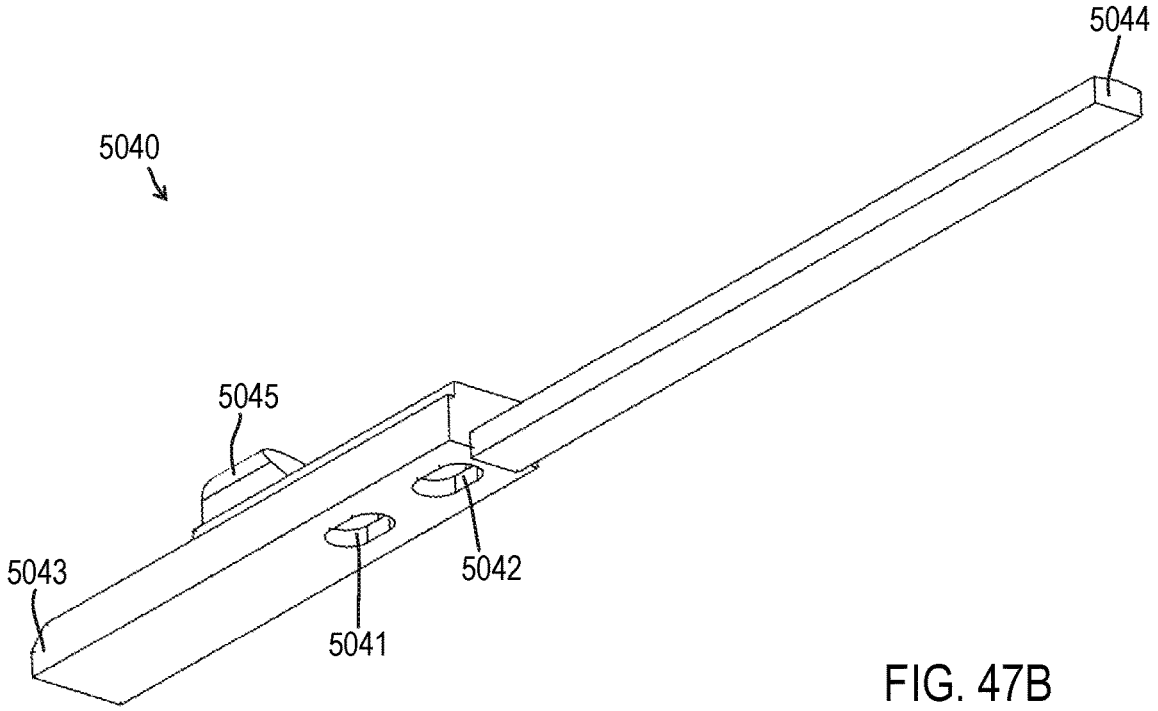
FIG. 47B is a rear left side perspective view of the upper member of FIG. 47A.
Figure 48A:
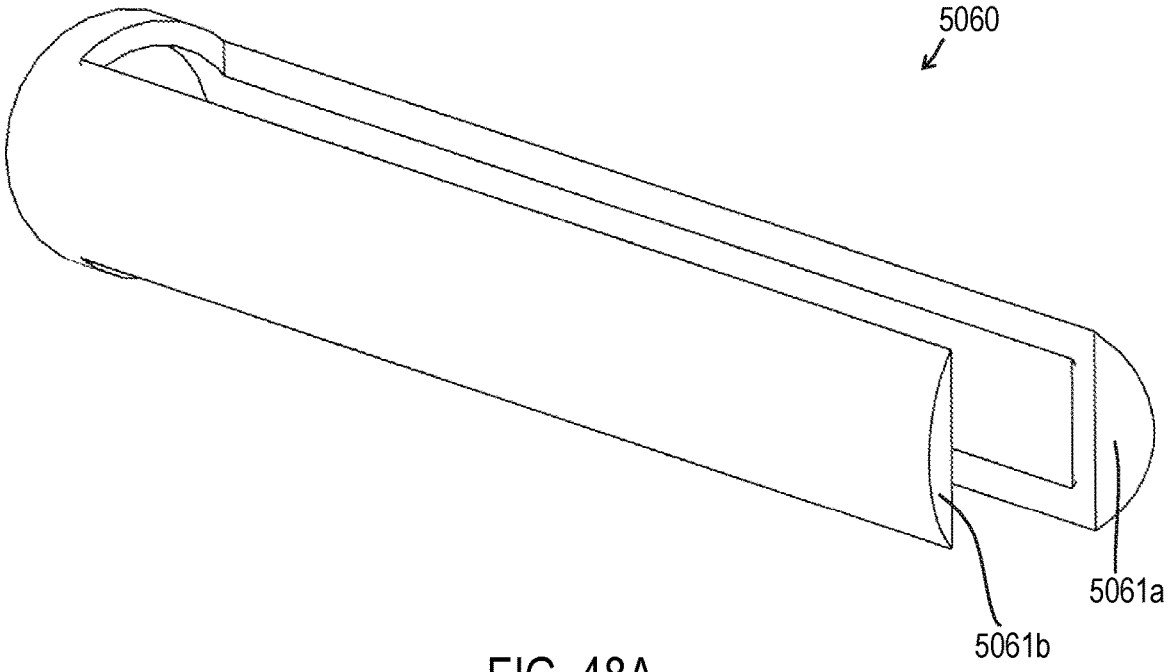
FIG. 48A is a front right side perspective view of a buffer tube insert of the firearm operating system of FIG. 39.
Figure 48B:
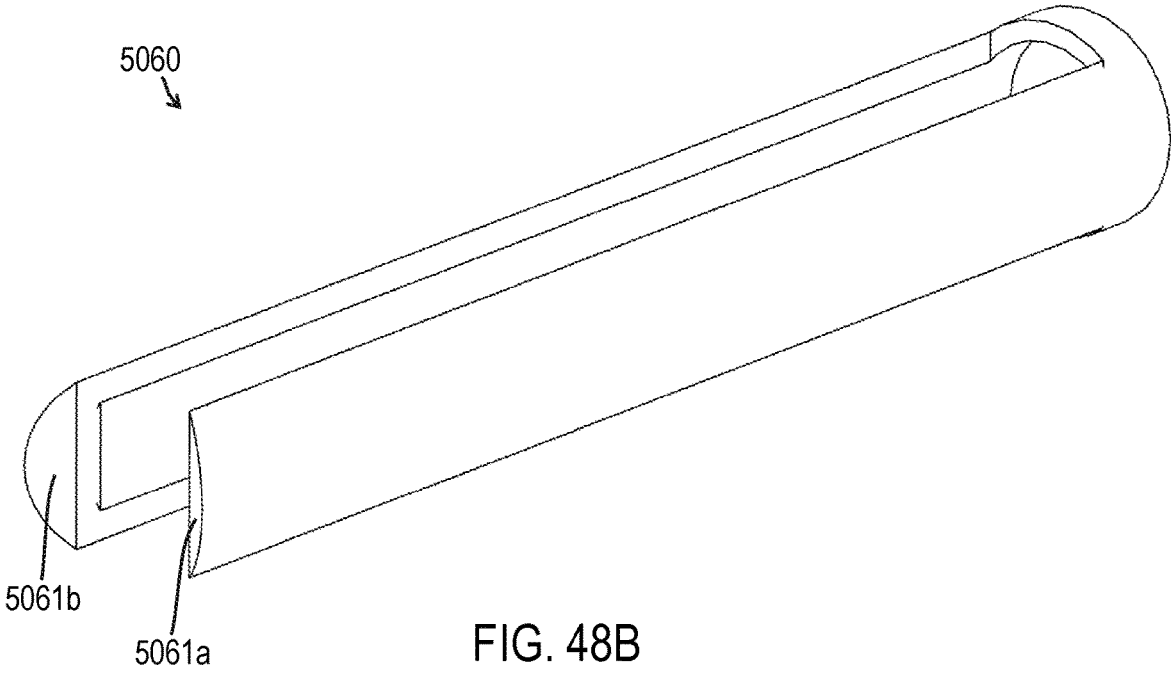
FIG. 48B is a front left side perspective view of the buffer tube insert of FIG. 48A.

The rear bolt 5020 may include a forward face 5103, a rear face 5107, a rear cavity 5029, and at least one bearing cavity 5024, (see FIGS. 45A and 45B). In some embodiments, the at least one bearing cavity 5024 includes a first bearing cavity 5024*a* and a second bearing cavity 5024*b*. As shown in FIGS. 40-43B, the rear bolt 5020 may interface with at least one bearing 5023. In some embodiments, the at least one bearing 5023 includes a first bearing 5023*a* and a second bearing 5023*b*. Although the bearings 5023 are illustrated as cylindrical bearings, the bearings 5023 may have any configuration, including, for example, spherical (ball), tapered, needle, toroidal, annular, etc. In some cases, the first bearing 5023*a* is disposed in the first bearing cavity 5024*a* and the second bearing 5023*b* is disposed in the second bearing cavity 5024*b*. The bearings 5023 may be retained within their respective cavities. For example, each cavity 5024 may include a retaining portion 5025 that prevents the bearing 5023 from passing entirely through the cavity 5024 (i.e., where the bearing 5023 can partially protrude but cannot move entirely through the cavity 5024). The first bearing cavity 5024*a* may include a first retaining portion 5025*a* and the second bearing cavity 5024*b* may include a second retaining portion 5025*b*. As one example, each retaining portion 5025 may include a machined profile near the outer edge where the dimension (e.g., distance front to rear parallel to the X-direction) of the cavity 5024 decreases when nearing the outer portion of the cavity 5024. The retaining portion 5025 may be an integral feature (e.g., a machined feature as described above, a welded feature, etc.) or may be an additional component added to the rear bolt 5020. In some embodiments, the retaining portion 5025 is a tapered surface that reduces the size of the cavity 5024 linearly. In other embodiments, the retaining portion 5025 is a tapered surface that reduces the size of the cavity 5024 non-linearly.

Based on the configuration of the cavities 5024 and the retaining portions 5025, the bearings 5023 cannot exit outward through the cavities 5024. In some embodiments, the only option for removing the bearings 5023 is to disassemble the rear bolt 5020 and the cam member 5030. The bearings 5023 could then be removed through rear cavity 5029.

Manual operation/cycling of the firearm operating system 5000 may include rearward movement of the charging handle 32 where the charging handle 32 engages a portion of the firearm operating system 5000. For example, in some embodiments, the charging handle 32 engages the forward end 5043 of the upper member 5040. In other embodiments, the charging handle 32 engages a gas key 5045. When the charging handle 32 is pulled rearward (and engages at least one of the forward end 5043 and/or the gas key 5045), the rear end 5044 of the upper member 5040 presses against the forward end 5032 of the upper protrusion 5031 of the cam member 5030. As a result, the cam member 5030 moves to the rear position relative to the rear bolt 5020 (see FIG. 43B) which allows the bearing(s) 5023 to move into the internal configuration. Accordingly, the movement of the charging handle 32 disengages the bearing(s) 5023 from the buffer tube insert 5060 such that the bolt assembly (the rear bolt 5020, the carrier 5050 and other related components) can move rearward into the buffer tube 33. As explained above, the upper member 5040 may include at least one slotted hole (e.g., holes 5041, 5042) to control movement in the X-direction.

In some embodiments, the forward face 5103 of the rear bolt 5020 is adjacent to and/or in contact with the rear face 5052 of the carrier 5050. Although illustrated as a separate component, in some embodiments, the rear bolt 5020 may be an integral component of the carrier 5050.

As described above, the firearm operating system 5000 may include at least one bearing 5023. In some embodiments, each bearing 5023 has a diameter of approximately 0.1" (0.25 cm) to approximately 0.4" (1.02 cm). In other cases, each bearing 5023 has a diameter of approximately 0.2" (0.51 cm) to approximately 0.3" (0.76 cm). In other cases, each bearing has a diameter of approximately 0.25" (0.635 cm).

The bearings 5023 may interface with other components of the firearm operating system 5000. For example, the bearings 5023*a* and 5023*b* may each have an internal configuration (see FIG. 43B) where a surface of each bearing 5023 is approximately flush with a respective surface of the rear bolt 5020. For example, in the internal configuration, a portion of the surface of the first bearing 5023*a* is approximately flush with the left side surface of the rear bolt 5020. Similarly, a portion of the outer surface of the second bearing 5023*b* is approximately flush with the right side surface of the rear bolt 5020. The bearings 5023*a* and 5023*b* may be capable of moving outward to an extended configuration where the bearings 5023*a* and 5023*b* move outward relative to their respective cavity 5024 such that at least a portion of each of the bearings 5023*a* and 5023*b* extend beyond the respective surfaces of the rear bolt 5020. For example, in the extended configuration, a portion of the surface of the first bearing 5023*a* protrudes beyond the left side surface of the rear bolt 5020 and a portion of the surface of the second bearing 5023*b* protrudes beyond the right side surface of the rear bolt 5020. In some embodiments, the bearings 5023*a* and 5023*b* may interface with (i) the cam member 5030 (internal to the rear bolt 5020) and/or (ii) the buffer tube insert 5060 (external to the rear bolt 5020).

When the firearm operating system 5000 is in the forwardmost configuration relative to the firearm 1, the bearings 5023 interface with both the cam member 5030 and the buffer tube insert 5060. There is forward pressure on the rear portion 5039 of the cam member 5030 (e.g., due to forward momentum of the components of firearm operating system 5000 and/or pressure from the buffer spring 36), which consequently pushes the cam member 5030 in the forward direction. The forward section 5038 of the cam member 5030 may include a tapered or narrowed portion. In some embodiments, the forward section 5038 includes a shape that is symmetric (about a plane perpendicular to the lateral direction) and/or includes portions with a conical profile that narrows toward the front. Forward pressure on the cam member 5030 causes the forward surfaces 5036*a* and 5036*b* to push the bearings 5023*a* and 5023*b* outward (respectively). Outward pressure on the bearings 5023*a* and 5023*b* causes each bearing to engage the relevant ramp 5061 of the buffer tube insert 5060. Specifically, outward pressure from forward surface 5036*a* pushes bearing 5023*a* into ramp 5061*a* and outward pressure from forward surface 5036*b* pushes bearing 5023*b* into ramp 5061*b*. Accordingly, when the firearm operating system 5000 is in the deployed configuration (FIG. 43A) and located in a forward position, the bearing(s) 5023 engage the buffer tube insert 5060 to lock the firearm operating system 5000 in a condition ready to fire (i.e., in battery). In other words, when the firearm operating system 5000 is in battery, the rear bolt 5020 and the carrier 5050 are pushed forward (due to the interface between the bearings 5023*a*, 5023*b* and the ramps 5061*a*, 5061*b*) such that the forward face 5051 of the carrier 5050 pushes a cartridge into the chamber.

After a cartridge is fired, the mechanisms described above cause a delay before the bolt assembly (the rear bolt 5020, the carrier 5050 and other related components) can move rearward away from the chamber. In particular, the bearings 5023*a* and 5023*b* press against the curved/tapered surface of the ramps 5061*a* and 5061*b*, respectively, of the buffer tube insert 5060. In other words, bearing 5023*a* presses against the surface of ramp 5061*a* and bearing 5023*b* presses against the surface of ramp 5061*b* (see FIGS. 48A and 48B). Each of the ramps 5061 may taper to a smaller size/diameter when moving rearward (i.e., the lateral distance between the ramps 5061). Although the ramps 5061 are illustrated as planar/flat, the ramps 5061 may include partial or fully curved surfaces in at least one direction. For example, the rearward taper of these surfaces of the ramps 5061 may be linear and/or may be curved. The interaction between these ramps 5061 of the buffer tube insert 5060 and the bearings 5023 presses the bearings 5023 inward (toward the interior of the rear bolt 5020) while other portions of the bearings 5023 press against the forward surfaces 5036 of the cam member 5030 (see FIGS. 42 and 46A). Although the forward surfaces 5036 are illustrated as planar/flat, the forward surfaces 5036 may include partial or fully curved surfaces in at least one direction. In some cases, the surface geometry of (i) the ramps 5061, (ii) the bearings 5023, and/or (iii) the forward surfaces 5036 may be designed to determine the distance, time, rate, force, etc. of the movement of the bearings 5023 after the cartridge has been fired. For example, the geometry of the ramps 5061 and/or the forward surfaces 5036 may be changed to increase/decrease cycling rate, adapt for different ammunition (e.g., caliber, powder charge, etc.), optimize for suppressed/unsuppressed, or any other appropriate purpose. Although the ramps 5061 are illustrated as being oriented in the lateral direction, the ramps 5061 may be oriented in any other appropriate direction.

In some embodiments, the firearm operating system 5000 can be tuned by replacing the cam member 5030. Each cam member 5030 includes a geometric relationship between the forward surfaces 5036 and the axial direction. To tune the firearm operating system 5000, an operator may replace the cam member 5030 to change the geometric relationship between the bearings 5023 and the cam member 5030. Different cam members 5030 can be used to account for changes in caliber, bullet weight, powder charge, barrel length, etc. or may be designed to optimize for suppressed/unsuppressed, to increase/decrease cycling rate, or any other appropriate purpose. In some cases, different cam members 5030 have a different angle between each forward surface 5036 and the axial direction. In other cases, different cam members 5030 have a more complex geometric relationship with the axial direction which may include a circular arc, a non-circular arc, a polynomial relationship, an average angle, and/or any other appropriate relationship. The operator may also replace the buffer tube insert 5060 to vary the geometric relationship between the ramps 5061 and the bearings 5023.

Accordingly, after sufficient force is applied to the forward surfaces 5036*a* and 5036*b*, the cam member 5030 moves rearward relative to the rear bolt 5020 due to the force applied between the ramps 5061 of the buffer tube insert 5060 and the bearings 5023, which causes the firearm operating system 5000 to move from the deployed configuration (where gap g is small or minimal and the bearings 5023 at least partially protrude from the rear bolt 5020 as shown in FIG. 43A) to the retracted configuration (where gap g is larger and the bearings 5023 are retracted relative to the rear bolt 5020 as shown in FIG. 43B). Once the bearings 5023 have moved inward a sufficient distance to allow clearance through the buffer tube insert 5060, the delay is over and the bolt assembly moves rearward. The subsequent cycling includes extracting/ejecting a cartridge or empty shell, compressing the buffer spring 36, pushing the upper-most cartridge out of the magazine and toward the chamber of the firearm 1, etc.

In some embodiments, the buffer tube insert 5060 may be removably attached to the buffer tube 33 while in other embodiments, the buffer tube insert 5060 is integral or permanently attached to the buffer tube 33. For embodiments where the buffer tube insert 5060 is removably attached to the buffer tube 33, the buffer tube insert 5060 may be threaded into the buffer tube 33, press-fit in the buffer tube 33, pinned to the buffer tube 33, welded to the buffer tube 33, and/or attached in any other appropriate way. Removable attachment of the buffer tube insert 5060 allows a buffer tube insert 5060 to be replaced if/when wear occurs to one or more of the ramps 5061.

The forward surfaces 5036*a* and 5036*b* of the cam member 5030 may include concave surfaces. To promote continuous contact with the surface of the bearings 5023, each of the forward surfaces 5036 may include a curved surface that approximately matches the shape of the bearing 5023. For example, if one of the bearings 5023 is spherical, the corresponding forward surface 5036 may be concave with a partially cylindrical shape (i.e., a partially circular cross section) to interface with the bearing 3023. In some cases, the corresponding forward surface 5036 may be concave with a partially conical shape (i.e., a partially circular cross section) to interface with the bearing 5023. In other embodiments, the corresponding forward surface 5036 may have other shapes including, for example, a planar shape, a curved surface with a partially elliptical shape, a partially oval shape, or any other appropriate shape. The dimensions of the corresponding forward surface 5036 may be similar to the bearing 5023 (e.g., similar width or diameter) or, in some cases, may be larger than the bearing 5023 to ensure the bearing 5023 remains in contact with the forward surface 5036.

Similarly, the ramps 5061*a* and 5061*b* of the buffer tube insert 5060 may include concave surfaces. To promote continuous contact with the surface of the bearings 5023, each of the ramps 5061 may include a curved surface that approximately matches the shape of the bearing 5023. For example, if one of the bearings 5023 is spherical, the corresponding ramp 5061 may be concave with a partially cylindrical shape (i.e., a partially circular cross section) to interface with the bearing 5023. In some cases, the corresponding ramp 5061 may be concave with a partially conical shape (i.e., a partially circular cross section) to interface with the bearing 5023. In other embodiments, the corresponding ramp 5061 may have other shapes including, for example, a planar shape, a curved surface with a partially elliptical shape, a partially oval shape, or any other appropriate shape. The dimensions of the corresponding ramp 5061 may be similar to the bearing 5023 (e.g., similar diameter) or, in some cases, may be larger than the bearing 5023 to ensure the bearing 5023 remains in contact with the ramp 5061.

Figure 49:
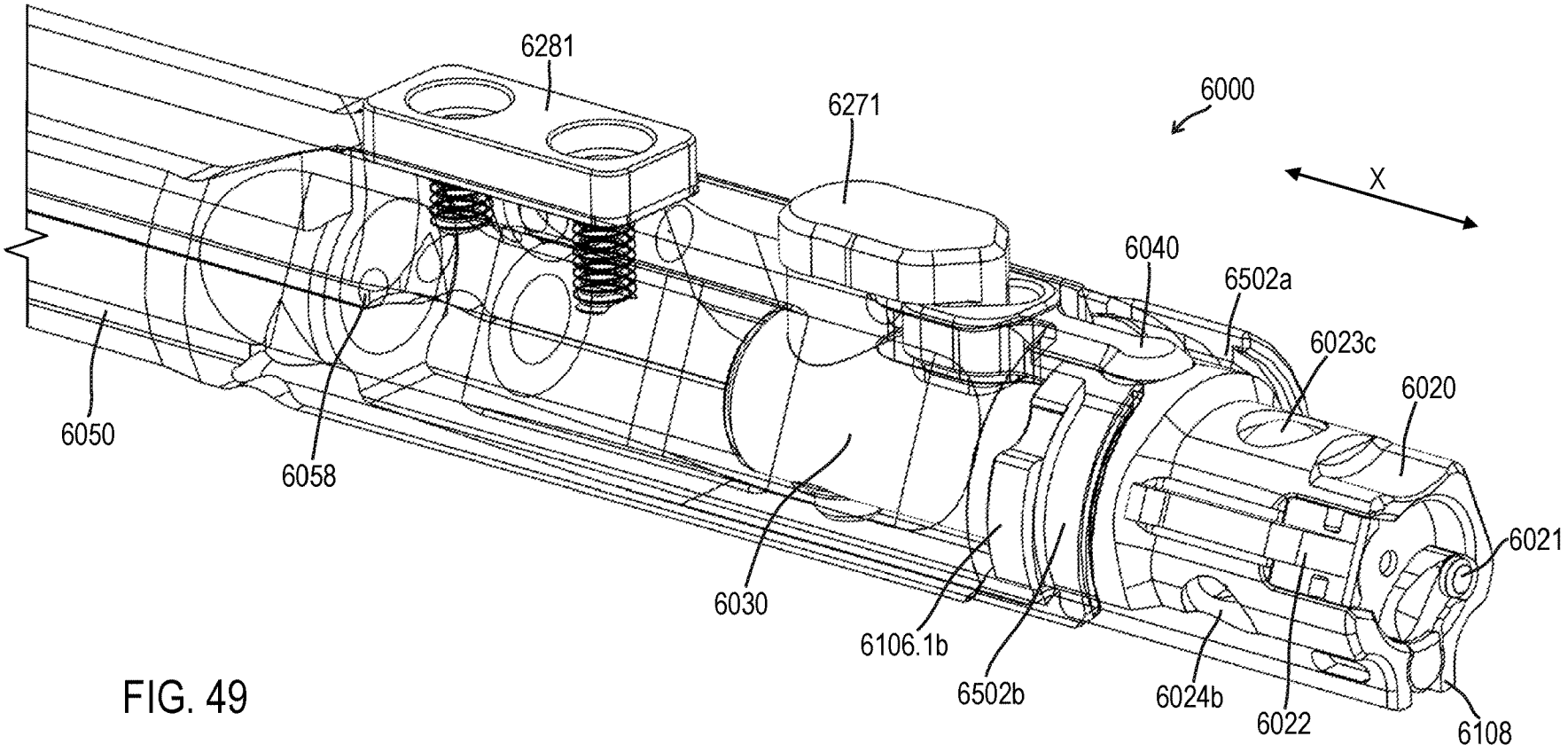
FIG. 49 is a perspective view of a firearm operating system for a firearm according to certain embodiments of the present invention.
Figure 50A:
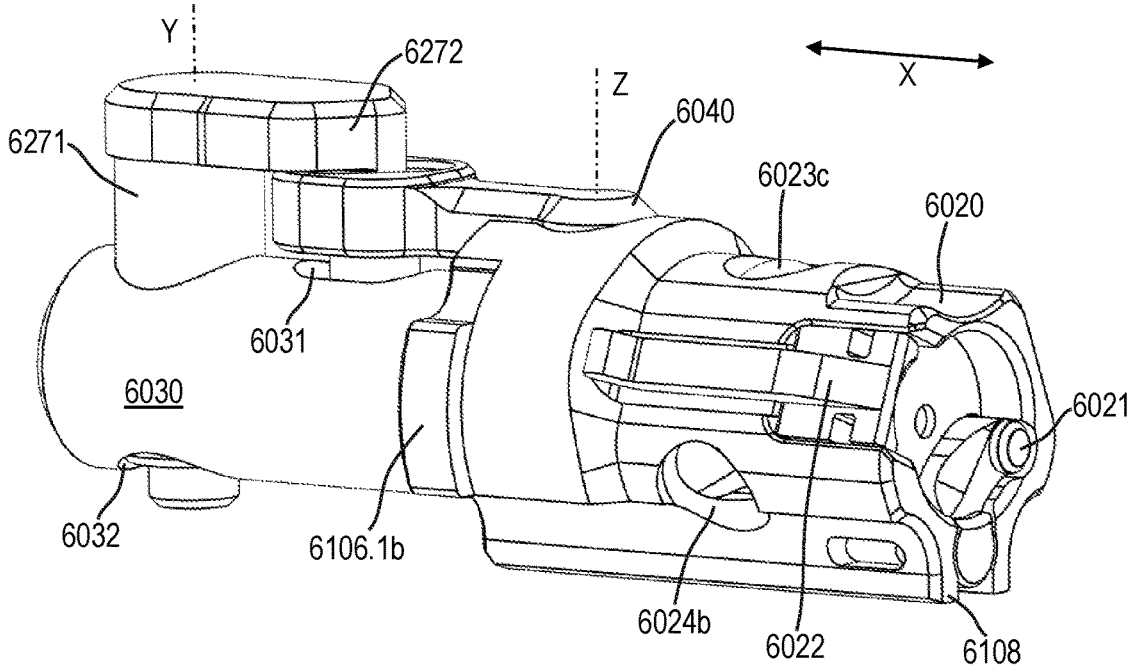
FIG. 50A is a partial perspective view of the firearm operating system of FIG. 49.
Figure 50B:
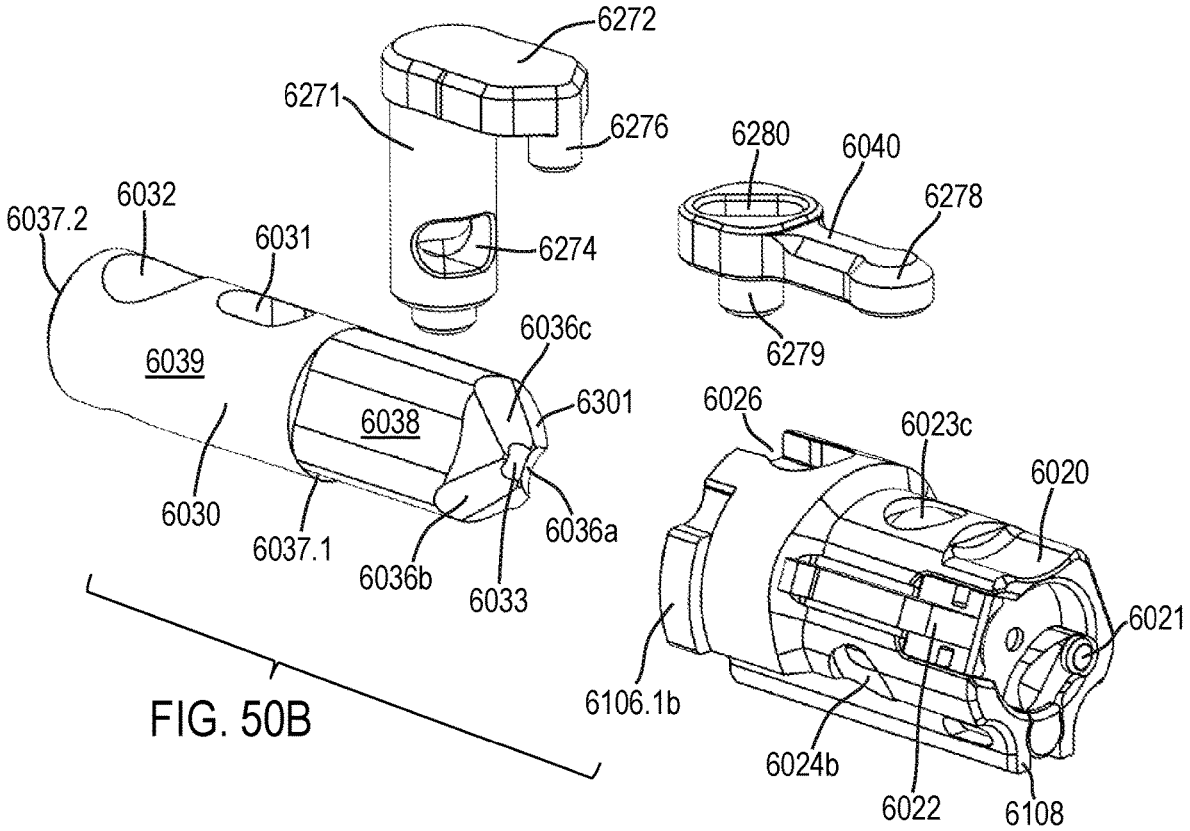
FIG. 50B is an exploded partial perspective view of the firearm operating system of FIG. 49.

According to certain embodiments of the present invention, as shown in FIGS. 49-50B, a firearm operating system 6000 may include a forward bolt 6020, a short cam pin 6030, and a carrier 6050. The firearm operating system 6000 may include many features and characteristics that are similar to that of firearm operating system 3000. Accordingly, the relevant descriptions related to firearm operating system 6000 will focus on the distinct features with the understanding that numerous features of firearm operating system 6000 are described above in the context of firearm operating system 3000. The carrier 6050 is shown transparent in FIG. 49 to better illustrate internal features.

In some embodiments, to limit or constrain movement of the bearing spacer 6040 and the rotating cam pin 6271, the firearm operating system 3000 may be designed with a linkage connecting the forward bolt 6020 and the rotating cam pin 6271. As shown above, in some embodiments shown for firearm operating system 3000, the bearing spacer 3040 may be an integral component of the forward bolt or may be a separate independent component (i.e., a cylindrical rod). However, as shown in FIGS. 50A and 50B, the forward end of the bearing spacer 6040 may be removably attached to the forward bolt 6020 and the rear end of the bearing spacer 6040 may engage one or both of (i) the rotating cam pin 6271 and (ii) the short cam pin 6030.

As shown in the exploded view in FIG. 50B, the forward bolt 6020 may include a recess 6026 with a partially round area. In some embodiments, the recess 6026 includes a circular (or partially circular) portion designed to correspond to the protrusion 6278 at the forward end of the bearing spacer 6040. This "lollipop" connection ensures that the bearing spacer 6040 moves with the forward bolt 6020 (e.g., when the forward bolt 6020 moves in the X-direction). In some embodiments, the lollipop connection also allows for a limited amount of rotation of the bearing spacer 6040 relative to the forward bolt 6020 (e.g., rotation about the Z-axis as shown in FIG. 50A).

The rear end of the bearing spacer 6040 may interface with the rotating cam pin 6271. For example, in some embodiments, the rotating cam pin 6271 includes a protrusion 6276 that extends downward from the head 6272 and engages a slot 6280 of the bearing spacer 6040. The slot 6280 may be angled (non-parallel) relative to the X-axis. In some embodiments, the slot 6280 is approximately 45° relative to the X-axis. Accordingly, rearward movement of the forward bolt 6020 causes the rotating cam pin 6271 to rotate counter-clockwise (when viewed from above) about the Y-axis such that the protrusion 6276 travels forward and to the left through slot 6280. As described above in the context of firearm operating system 3000, when the rotating cam pin 6271 interacts with the appropriate portion of the upper receiver 30 (within channel 34) the head 6272 is capable of rotating toward the left side of the firearm 1 (in the deployed configuration).

The firearm operating system 6000 may move between a deployed configuration and a retracted configuration. Similar to discussions above related to firearm operating system 3000, when the firearm operating system 6000 is in the deployed configuration and located in a forward position, the gap between the forward bolt 6020 and the carrier 6050 is minimal and the bearing(s) 6023 engage the barrel extension to lock the firearm operating system 6000 in a condition ready to fire (i.e., in battery). In the retracted configuration, the gap between the forward bolt 6020 and the carrier 6050 is larger and the bearings 6023 are retracted relative to (i.e., do not protrude from) the forward bolt 6020. In some embodiments, the firearm operating system 6000 is configured to move within the upper receiver 30 such that movement between the deployed configuration and the retracted configuration causes the protrusion 6276 to move within the slot 6280 without reaching either end of the slot 6280. In other words, the firearm operating system 6000 is designed to limit potential damage to the protrusion 6276 and/or to the slot 6280.

In some embodiments, as shown in FIGS. 50A and 50B, the bearing spacer 6040 may include a protrusion 6279 extending downward that interfaces with cavity 6031 of the short cam pin 6030. The cavity 6031 may be an elongated slot to accommodate motion in the X-direction of the forward bolt 6020 relative to the short cam pin 6030. In some embodiments, the lateral location (i.e., left/right, perpendicular to direction X and axis Y) varies for cavity 6031. For example, in some embodiments, each short cam pin 6030 (which are swapped to tune the firearm operating system 6000) may include a cavity 6031 in a different location (laterally). Accordingly, each short cam pin 6030 may dictate a different lateral location for the slot 6280 (of the bearing spacer 6040) which accounts for the geometric differences between the various short cam pins 6030.

According to certain embodiments of the present invention, as shown in FIGS. 51-57, a firearm operating system 7000 may include a forward bolt 7020, a short cam pin 7030, a carrier 7050, a barrel extension 7060, a bolt extension 7070, and a firing pin 7080. The firearm operating system 7000 may include many features and characteristics that are similar to that of firearm operating system 3000 and/or to firearm operating system 6000. Accordingly, the relevant descriptions related to firearm operating system 7000 will focus on the distinct features with the understanding that numerous features of firearm operating system 7000 are described above in the context of firearm operating system 3000 and/or firearm operating system 6000. The barrel extension 7060 is shown transparent in FIG. 51 to better illustrate various features.

The firearm operating system 7000 may be configured such that the forward bolt 7020 moves in the X-direction relative other component(s) (e.g., the short cam pin 7030, the carrier 7050, etc.), which is similar to firearm operating system 2000, 3000, 6000 described above. However, the firearm operating system 7000 may also include the bolt extension 7070, which moves with the forward bolt 7020.

Figure 51:
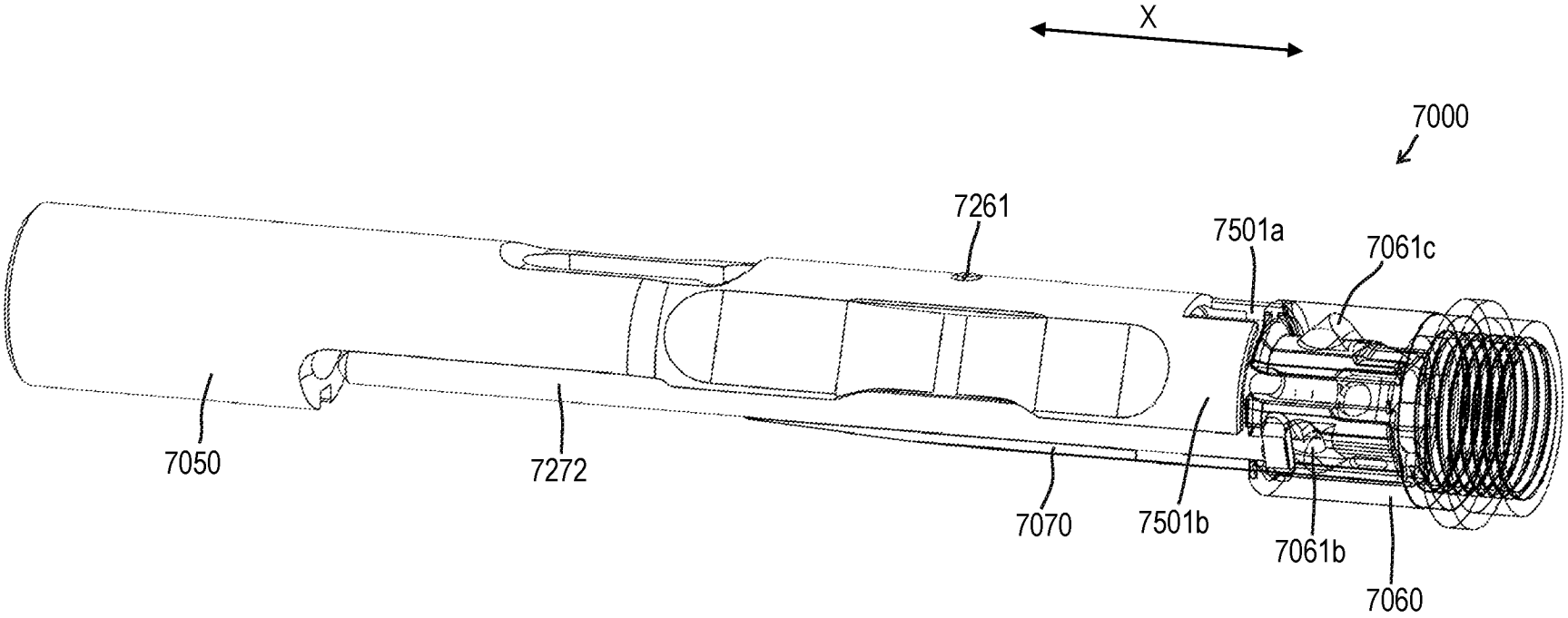
FIG. 51 is a perspective view of a firearm operating system for a firearm according to certain embodiments of the present invention.
Figure 52:
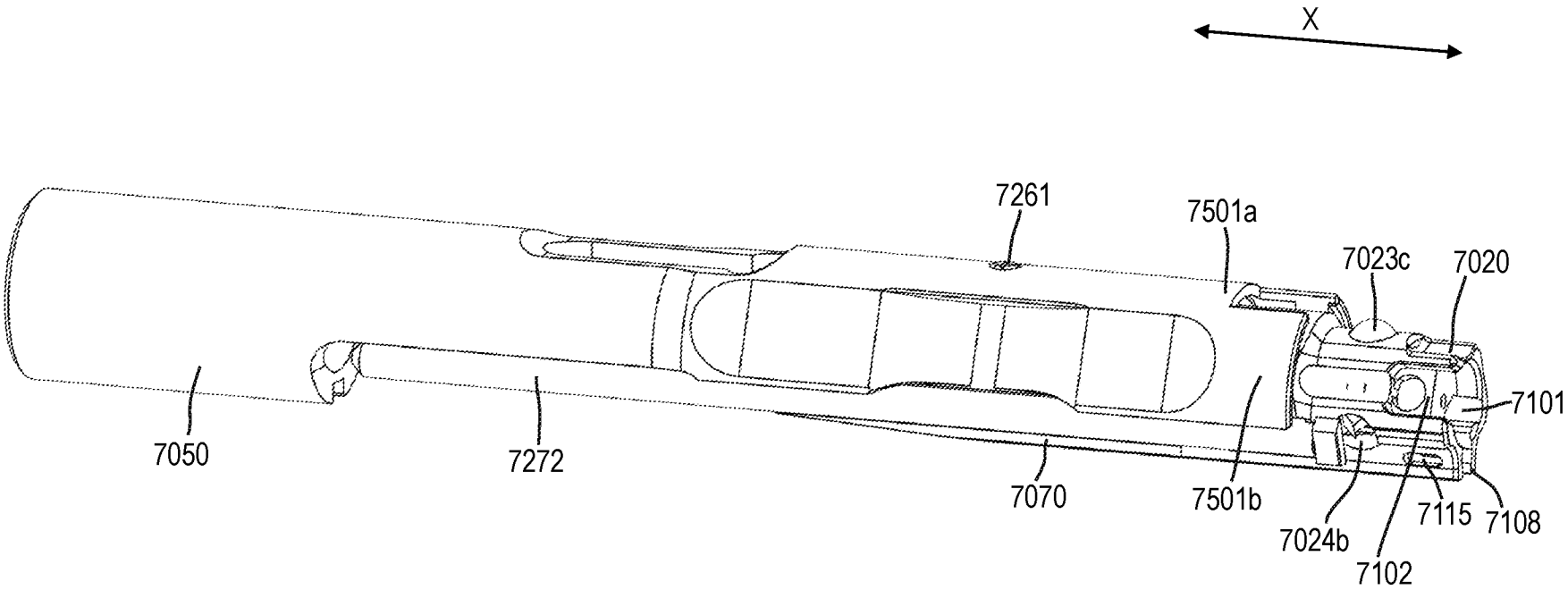
FIG. 52 is a right side perspective view of the firearm operating system of FIG. 51.
Figure 54:
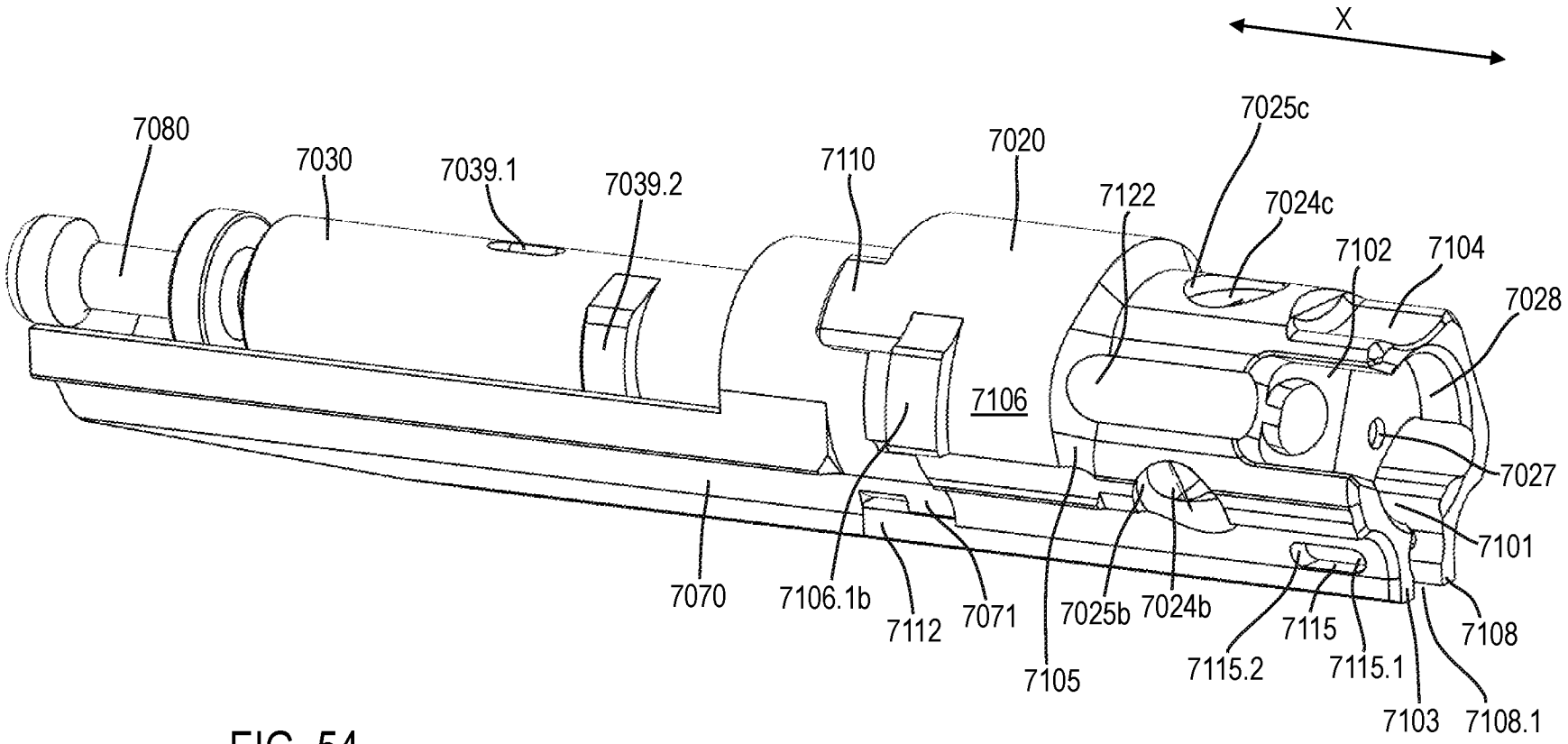
FIG. 54 is a right side partial perspective view of the firearm operating system of FIG. 51.

As shown in FIGS. 51, 52, and 54, in some embodiments, the firearm operating system 7000 may be configured to an approximately continuous lower surface for interfacing with other adjacent components of the firearm 1. For example, the forward bolt 7020 and the bolt extension 7070 may be configured to engage one another such that (i) the lower surface 7109 of the forward bolt 7020 and (ii) the lower surface 7075 of the bolt extension 7070 are approximately continuous. Such an arrangement may reduce friction and potential problems associated with sliding across adjacent components within the firearm 1 (e.g., the magazine, cartridges within the magazine, the hammer, etc.).

In some embodiments, the forward bolt 7020 and the bolt extension 7070 detachably engage one another with at least one interface. In some embodiments, the forward bolt 7020 and the bolt extension 7070 twist relative to one another and there are three interfaces. For example, in some cases, when the forward bolt 7020 and the bolt extension 7070 are engaged with one another, (i) the protrusion 7071 engages protrusion 7112, (ii) the protrusion 7073 engages protrusion 7109, and (iii) the protrusion 7074 engages protrusion 7110 (see FIGS. 54-56B). The gap between the rear end of the lower surface 7109 of the forward bolt 7020 and the front end of the lower surface 7075 of the bolt extension 7070 may be approximately 0.005" (0.127 mm). In some embodiments, this gap is approximately 0.002" (0.051 mm).

To secure the forward bolt 7020 and the carrier 7050, the forward bolt 7020 may include at least one protrusion 7106.1 (e.g., left protrusion 7106.1*a* and right protrusion 7106.1*b*) that engages a corresponding feature of the carrier 7050. In particular, as shown in FIG. 57, the carrier 7050 may include at least one side member 7501*a*, 7501*b* that extends forward such that each side member 7501*a*, 7501*b* includes a protrusion 7502 (e.g., left side member 7501*a* includes left protrusion 7502*a* and right side member 7501*b* includes right protrusion 7502*b*). The function of these components is similar to the analogous components in firearm operating system 3000 (see FIGS. 23D and 25C along with relevant description).

Figure 53:
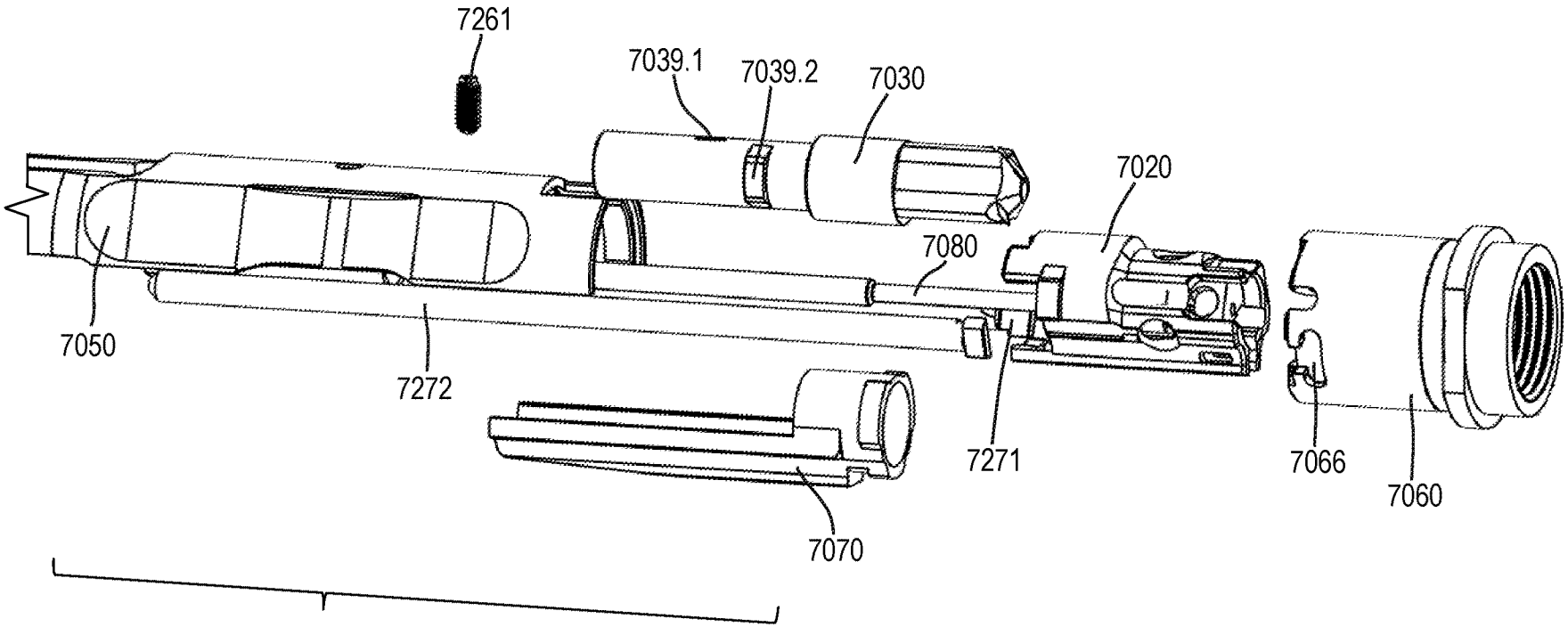
FIG. 53 is an exploded right side perspective view of the firearm operating system of FIG. 51.

As shown in FIGS. 51-53, the firearm operating system 7000 may include at least one retaining rod 7271, 7272. In some embodiments, the barrel extension 7060 includes at least one feature for securing the retaining rod(s) 7271, 7272. For example, each retaining rod 7271, 7272 may include a head that engages a recess 7066 in the barrel extension 7060. Each retaining rod 7271, 7272 may be designed such that, during rearward movement of the forward bolt 7020 away from the chamber, the retaining rod 7271, 7272 retains a bearing 7023 in an internal configuration where a surface of each bearing 7023 is approximately flush with a respective surface of the forward bolt 7020. In other words, the retaining rod(s) 7271, 7272 function to prevent the bearing(s) 7023 from being pushed outward (i.e., due to an interface with the short cam pin 7030) until the forward bolt 7020 is located within the barrel extension 7060 (i.e., see FIG. 51). In particular, the left retaining rod 7271 interfaces with the first bearing 7023*a* and the right retaining rod 7272 interfaces with the second bearing 7023*b*. Accordingly, the retaining rod(s) 7271, 7272 eliminate the need for a vertical cam pin 2271 and/or a rotating cam pin 3271, 6271 (as described above).

The retaining rod(s) 7271, 7272 may interface with one or more components of the firearm operating system 7000 (in addition to the bearings 7023). In some embodiments, the left retaining rod 7271 interfaces with (i) the surface 7113*a* of the forward bolt 7020 and (ii) the surface 7505 of the carrier 7050. Similarly, the right retaining rod 7272 interfaces with (i) the surface 7113*b* of the forward bolt 7020 and (ii) the surface 7506 of the carrier 7050.

In some embodiments, the retaining rod(s) 7271, 7272 may have a cross-section designed to interface with the upper receiver 30 and/or with the relevant bearing 7023. For example, the cross section of each retaining rod(s) 7271, 7272 may be circular, rectangular (flat plate), square, pentagonal, hexagonal, oval, other polygon, and/or any other appropriate shape. In addition, the retaining rod(s) 7271, 7272 may contact and/or bear against the interior surface(s) of the upper receiver 30.

The short cam pin 7030 may include at least one integral feature for engaging with the carrier 7050. For example, the short cam pin 7030 may include a lug 7039.2 such that, when the short cam pin 7030 is rotated into the proper orientation, the lug 7039.2 engages a slot 7503 in the carrier 7050. This interface between the lug 7039.2 and the slot 7503 may function to prevent relative motion in the X-direction between the short cam pin 7030 and the carrier 7050. In addition, the firearm operating system 7000 may include a pin 7261 to prevent rotational movement (i.e., rotation about an axis parallel to the X-direction) of the short cam pin 7030 relative to the carrier 7050. In some embodiments, the pin 7261 is inserted into the carrier 7050 from above and extends down to interface with a recess 7039.1 of the short cam pin 7030. In some embodiments, the pin 7261 is a spring-loaded detent, a set screw, a conventional fastener, and/or any other appropriate component. In some cases, one or both of the carrier 7050 and the short cam pin 7030 include threads for engaging with the pin 7261.

Figure 58A:
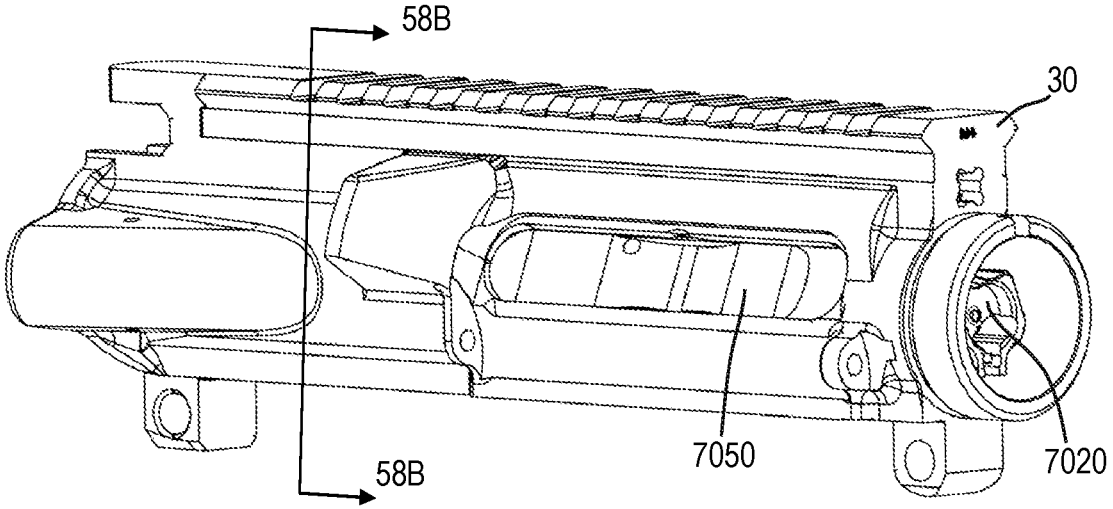
FIG. 58A is a right side perspective view of the firearm operating system of FIG. 51.
Figure 58B:
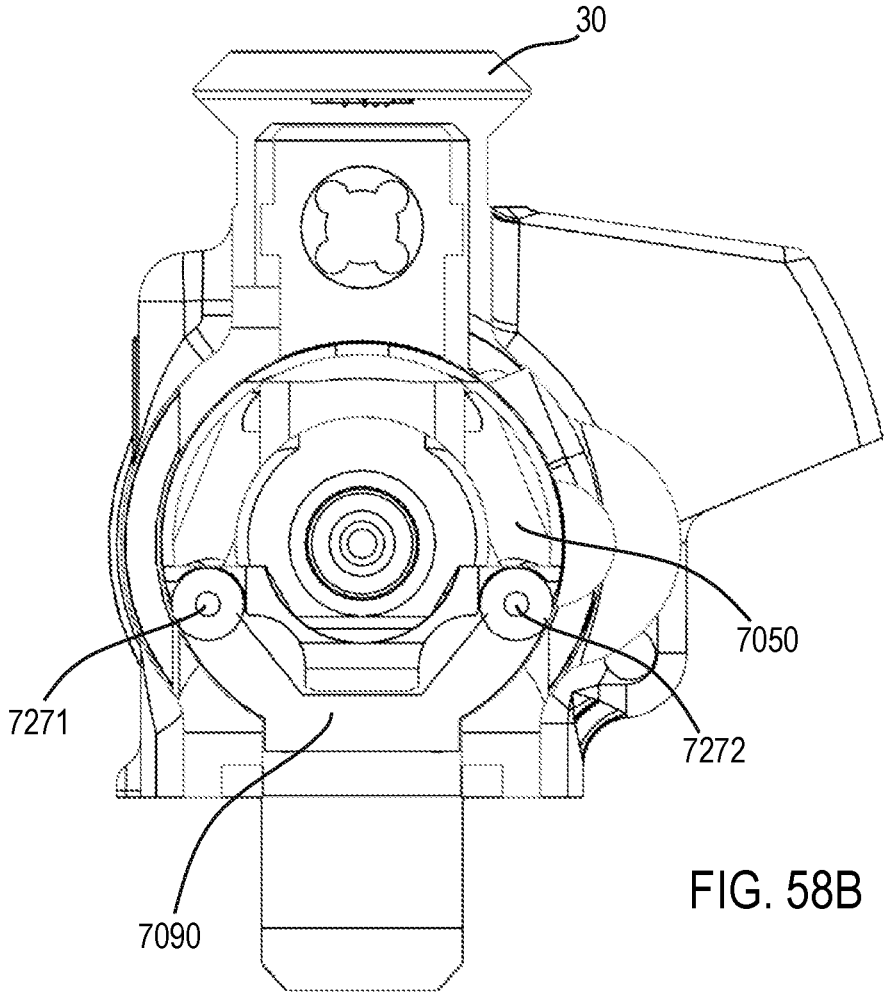
FIG. 58B is a section view of the firearm operating system of FIG. 58A.

As shown in FIG. 58B, in some embodiments, the firearm operating system 7000 may include a stabilizing member 7090 within the upper receiver 30. The stabilizing member 7090 may extend between and engage at least one of the retaining rod(s) 7271, 7272. In some embodiments, the stabilizing member 7090 includes an approximate "U" shape such that other portions of the firearm operating system 7000 can move past or above. The stabilizing member 7090 may be configured to ensure the retaining rod(s) 7271, 7272 remain in position with minimal deflection.

The components of any of the firearms 1 and firearm operating systems 2000, 3000, 5000, 6000, 7000 described herein may be formed of materials including, but not limited to, thermoplastic, carbon composite, plastic, nylon, glass-filled nylon, polyetherimide, steel, aluminum, stainless steel, high strength aluminum alloy, tool steel, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm operating system comprising:
a bolt comprising a rear cavity;
a plurality of bearings disposed at least partially within the bolt;
a carrier disposed on a rear side of the bolt, the carrier comprising a forward cavity; and
a cam pin comprising a forward section, wherein:
the forward section of the cam pin is disposed within the rear cavity of the bolt;
the forward section of the cam pin comprises a plurality of forward surfaces that each correspond to one of the plurality of bearings; and
each of the forward surfaces is oblique relative to a forward/aft direction of the firearm operating system.

2. The firearm operating system of claim 1, wherein each of the plurality of bearings comprises a spherical shape.

3. The firearm operating system of claim 1, wherein each of the plurality of bearings moves in a radial direction of the bolt.

4. The firearm operating system of claim 1, wherein:
the plurality of bearings comprises three bearings; and
the bolt comprises three cavities distributed around a perimeter of the bolt such that each bearing moves relative to the bolt at least partially through the respective cavity.

5. The firearm operating system of claim 4, further comprising a retracted bearing configuration and a deployed bearing configuration, wherein:
in the retracted bearing configuration the bearings are biased toward a center of the bolt and do not extend beyond an outer surface of the bolt; and
in the deployed bearing configuration the bearings are biased away from the center of the bolt and do at least partially extend beyond the outer surface of the bolt.

6. The firearm operating system of claim 4, wherein each cavity comprises a retaining portion that prevents the bearing from passing entirely through the cavity.

7. The firearm operating system of claim 1, wherein the bolt comprises an extractor and an ejector that are both disposed at a forward face of the bolt.

8. The firearm operating system of claim 1, further comprising a barrel extension comprising a plurality of recesses that each corresponds to one of the plurality of bearings.

9. The firearm operating system of claim 1, further comprising at least one retaining rod wherein each retaining rod restricts movement of one of the plurality of bearings.

10. The firearm operating system of claim 9, wherein the at least one retaining rod is attached to a barrel extension.

11. A firearm operating system comprising:
a bolt comprising a rear cavity;
at least two bearings disposed at least partially within the bolt;
a carrier disposed on a rear side of the bolt, the carrier comprising a forward cavity;
a cam pin comprising a forward section and a rear section, wherein the cam pin is disposed between the bolt and the carrier; and
a plurality of forward surfaces that each corresponds to one of the at least two bearings,
wherein each of the forward surfaces is oblique relative to a forward/aft direction of the firearm operating system.

12. The firearm operating system of claim 11, wherein:
the rear section of the cam pin is disposed within the forward cavity of the carrier; and
the forward section of the cam pin comprises the plurality of forward surfaces that each correspond to one of the at least two bearings.

13. The firearm operating system of claim 11, wherein each of the at least two bearings comprises a spherical shape.

14. The firearm operating system of claim 11, wherein each of the at least two bearings moves in a radial direction of the bolt.

15. The firearm operating system of claim 11, wherein:
the at least two bearings comprise three bearings; and
the bolt comprises three cavities distributed around a perimeter of the bolt such that each bearing moves relative to the bolt at least partially through the respective cavity.

16. The firearm operating system of claim 11, wherein the bolt comprises an extractor and an ejector that are both disposed at a forward face of the bolt.

17. The firearm operating system of claim 11, further comprising a barrel extension comprising a plurality of recesses that each corresponds to one of the at least two bearings.

18. The firearm operating system of claim 11, further comprising at least one retaining rod wherein each retaining rod restricts movement of one of the at least two bearings.

19. The firearm operating system of claim 18, wherein the at least one retaining rod is attached to a barrel extension.

20. A firearm operating system comprising:
a bolt comprising a rear cavity;
at least two bearings disposed at least partially within the bolt;
a carrier disposed on a rear side of the bolt, the carrier comprising a forward cavity;
a plurality of forward surfaces that each corresponds to one of the at least two bearings; and
a barrel extension comprising a plurality of recesses that each corresponds to one of the at least two bearings,
wherein each of the forward surfaces is oblique relative to a forward/aft direction of the firearm operating system.

* * * * *